US006759970B1

(12) United States Patent
Horita et al.

(10) Patent No.: US 6,759,970 B1
(45) Date of Patent: Jul. 6, 2004

(54) BROADCASTING SYSTEM, BROADCAST RECEIVING HARDWARE SYSTEMS, AND NAVIGATION TERMINAL

(75) Inventors: Masato Horita, Hitachi (JP); Takumi Fushiki, Hitachi (JP); Kimiya Yamaashi, Hitachi (JP); Takayoshi Yokota, Hitachiohta (JP); Yukihiro Kawamata, Hitachi (JP); Kenichiro Yamane, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/649,682

(22) Filed: Aug. 28, 2000

(30) Foreign Application Priority Data

Aug. 31, 1999 (JP) ..... 11-244785

(51) Int. Cl.[7] ..... G08G 1/09

(52) U.S. Cl. ..... 340/905; 340/988; 701/208; 701/213

(58) Field of Search ..... 340/905, 995, 340/988; 701/208, 211, 213

(56) References Cited

U.S. PATENT DOCUMENTS

| | | | | |
|---|---|---|---|---|
| 5,303,401 A | | 4/1994 | Duckeck et al. | 455/186.1 |
| 5,420,582 A | | 5/1995 | Kubbat et al. | 340/974 |
| 5,432,542 A | | 7/1995 | Thibadeau et al. | 348/6 |
| 5,596,332 A | | 1/1997 | Coles et al. | 342/455 |
| 5,635,924 A | * | 6/1997 | Tran et al. | 340/905 |
| 5,649,300 A | * | 7/1997 | Snyder et al. | 340/905 |
| 5,864,305 A | * | 1/1999 | Rosenquist | 340/905 |
| 5,900,825 A | * | 5/1999 | Pressel et al. | 340/905 |
| 5,933,094 A | * | 8/1999 | Goss et al. | 340/905 |
| 5,977,885 A | * | 11/1999 | Watanabe | 340/995 |
| 6,078,864 A | * | 6/2000 | Long et al. | 340/995 |
| 6,133,867 A | | 10/2000 | Eberwine et al. | 342/29 |
| 6,199,008 B1 | | 3/2001 | Aratow et al. | 701/120 |
| 6,255,963 B1 | * | 7/2001 | Heimann et al. | 340/905 |
| 6,259,377 B1 | * | 7/2001 | Noecker et al. | 340/933 |
| 6,281,807 B1 | * | 8/2001 | Kynast et al. | 340/905 |
| 6,438,492 B1 | | 8/2002 | Le Tallec et al. | 701/301 |
| 6,477,459 B1 | | 11/2002 | Wunderlich | 701/209 |

FOREIGN PATENT DOCUMENTS

| | | |
|---|---|---|
| DE | 43 22 288 | 1/1995 |
| DE | 197 27 751 | 2/1999 |
| EP | 0 866 576 | 9/1998 |
| JP | 8-269921 | 10/1996 |
| JP | 9-259398 | 10/1997 |
| JP | 10-170628 | 6/1998 |
| WO | WO 99/09374 | 2/1999 |

OTHER PUBLICATIONS

Meada, et al.—Strive2: "Development of an ITS Service Simulator" in IPS Research Reports Vo. 99, ITS–2, pp. 45–52 (IPS: Information Processing Society of Japan).
English Translation of the Rejection applied to Taiwanese Patent Application Ser. No. 89117666.

* cited by examiner

*Primary Examiner*—Brent A. Swarthout
(74) *Attorney, Agent, or Firm*—Hogan & Hartson, LLP

(57) ABSTRACT

To ensure that of all information transmitted through broadcast communications, only the information corresponding to the traveling route of a mobile body will be efficiently displayed at the information terminal of a car navigation system or the like, the information terminal is provided with: a means for receiving the spot or area information being transmitted, and receiving information that has been linked to the spot or area information being transmitted, a means for judging whether the spot or area information that has been received above is included in part of the spot or area information corresponding to the traveling route of the mobile body, and storage media for retaining the received spot or area information that the above-mentioned judgment means has judged to be included in the spot or area information corresponding to the traveling route of the mobile body.

17 Claims, 38 Drawing Sheets

| LATITUDE | LONGITUDE | RADIUS | ID CODE |
|---|---|---|---|
| 0 | 0 | 10 | 001 |
| 0 | 0 | 20 | 002 |
| | | | |
| 0 | 0 | 70 | 007 |
| 10 | 0 | 35 | 008 |

900

| | AREA | TIME OF DAY | |
|---|---|---|---|
| 902 | 3 | 10:00 | 901 |
| 904 | 2 | 10:05 | 903 |
| 906 | 6 | 10:10 | 905 |
| 908 | 10 | 10:15 | 907 |
| 912 | 14 | 10:20 | 909 |
| 914 | 13 | 10:25 | 911 |
| 916 | 12 | 10:30 | 913 |

910

| | AREA | TIME OF DAY | |
|---|---|---|---|
| 930 | 8 | 10:17~10:22 | 935 |
| 940 | 13 | 10:22~10:27 | 945 |
| 950 | 18 | 10:27~10:32 | 955 |
| 960 | 23 | 10:32~10:37 | 965 |

FIG. 33

3300

| | |
|---|---|
| DESTINATION: 43. 43′22N, 35. 33′22′E | 3310 |
| ROUTE RANGE: 20 TO 60km | 3320 |
| COURSE: EXPRESSWAY→ROUTE X→PREF. LINE @ | 3330 |
| -------XXX PARK-------<br>(1)APPROX. 60min FROM ○○ INTERCHANGE TOWARD XX CITY ALONG ROUTE X (CONGESTED NEAR THE INTERCHANGE)<br>(2)APPROX. 50min FROM ○○ INTERCHANGE TOWARD XX CITY ALONG ROUTE X | 3340 |

FIG. 34

3400

| | |
|---|---|
| DESTINATION: 43. 43′22N, 35. 33′22′E | 3410 |
| ROUTE RANGE: 2 TO 20km | 3320 |
| COURSE: EXPRESSWAY→ROUTE X→PREF. LINE @ | 3430 |
| -------XXX PARK-------<br>(1)1km AFTER RIGHT-TURNING AT THE "○○ TOWN" INTERSECTION.<br>CONGESTED NEAR THE "○○ TOWN" INTERCHANGE. | 3440 |

FIG. 35

3500

| | |
|---|---|
| DESTINATION: 43. 43′22N, 35. 33′22′E | 3510 |
| ROUTE RANGE: TO 2km | 3320 |
| COURSE: EXPRESSWAY→ROUTE X→PREF. LINE @ | 3530 |
| -------XXX PARK-------<br>PARKING LOT 1: OCCUPIED<br>PARKING LOT 2: OCCUPIED<br>PARKING LOT 3: VACANT<br>PARKING LOT 4: VACANT | 3540 |

FIG. 48

4800

MITO STATION INFORMATION

4810 TRAIN: JOHBAN LINE
4820 DISTANCE FROM STARTING POINT: 100km (FROM TOKYO)

------- MITO STATION INFORMATION -------

4830
- MITO FESTIVAL NOW TAKING PLACE AT:
  MITO PARK (2-min WALK FROM MITO STATION)
- VISIT THE MITO DEPARTMENT STORE FOR SHOPPING.
- VISIT "IBARAKI-YA" FOR SOUVENIRS.

FIG. 49

4900

IWAKI STATION INFORMATION

4910 TRAIN: JOHBAN LINE
4920 DISTANCE FROM STARTING POINT: 150km (FROM TOKYO)

------- IWAKI STATION INFORMATION -------

4930
- IWAKI FIREWORKS ON AUG. 15
  IWAKI PARK: 5-min WALK FROM IWAKI STATION
- VISIT THE FUKUSHIMA DEPARTMENT STORE FOR SHOPPING.
- VISIT "FUKUSHIMA-YA" FOR SOUVENIRS.

FIG. 50

5000

KOHFU STATION INFORMATION

5010 TRAIN: CHUOH LINE
5020 DISTANCE FROM STARTING POINT: 100km (FROM TOKYO)

------- KOHFU STATION INFORMATION -------

5030
- BUDOH FESTIVAL NOW TAKING PLACE AT:
  BUDOH PARK (5-min WALK FROM KOHFU STATION)
- VISIT THE KOHFU DEPARTMENT STORE FOR SHOPPING.
- VISIT "BUDOH-YA" FOR SOUVENIRS.

BROADCASTING SYSTEM, BROADCAST RECEIVING HARDWARE SYSTEMS, AND NAVIGATION TERMINAL

TECHNICAL FIELD OF THE INVENTION

The present invention relates to information-providing systems based on radio communications satellite broadcasting.

PRIOR ART

As set forth in Japanese Application Patent Laid-Open Publication No. Hei-170628(1998), one typical method of transmitting information to mobile bodies using a broadcasting system consists of the following steps:

- Segmenting the information transmission range into smaller areas
- Assigning an identification code to each area
- Linking a communications channel to each identification code
- Determining for each area the information to be transmitted
- Transmitting information using the corresponding channel
- Reading at the receiving side the identification code for the area corresponding to the current location of the mobile body
- Selecting the appropriate receiving channel
- Receiving the information linked to the corresponding area Also, as set forth in Japanese Application Patent Laid-Open Publication No. Hei-259398(1997), another typical method of transmission consists of the following steps:

- Segmenting the information transmission range into smaller areas
- Assigning an identification code to each area
- Determining for each area the information to be transmitted
- Transmitting information with each area. identification code added to the information
- Reading at the receiving side the identification code for the area corresponding to the current location of the mobile body
- Selecting from all received information only the information matching the added identification code The means of transmitting road regulation information to the drivers on the road in order to urge them to drive safely, refers to road signs or road markings. Drivers visually recognize the road signs or road markings located outside the respective vehicles. For such a road sign detection system as disclosed in Japanese Application Patent Laid-Open Publication No. Hei-269921(1997), radio signal transmitters are installed at each component of road infrastructure, such as a road sign, and regulation information is transmitted to each driver via a carborne receiver to notify alarms and the like to the driver. The "STRIVE2: Development of an ITS Service Simulator" in IPS Research Reports Vol. 99, No. ITS-2, pp. 45–52(IPS: Information Processing Society of Japan) reports that when viewing a road sign from a moving vehicle, it is difficult for the driver to momentarily confirm or judge details of the information contained in the road sign, such as time limits and the traffic ability specified for each vehicle type, and that when the vehicle is driven at night or the driver's vision is blocked by a large vehicle, the driver is prone to overlook the traffic sign or signal. In order to solve these problems, therefore, the report mentioned above suggests implementing a driver support function that automatically displays only the necessary sign information at the carborne information terminal according to the particular type of vehicle or the time zone applied.

BRIEF DESCRIPTION OF THE FIGURES

FIG. 33 is a system block diagram showing an embodiment of the present invention.

FIG. 34 is a system block diagram showing an embodiment of the present invention.

FIG. 35 is a system block diagram showing an embodiment of the present invention.

FIG. 48 shows an example of the contents of the information delivered from an information delivery station.

FIG. 49 shows another example of the contents of the information delivered from the information delivery station.

FIG. 50 shows still another example of the contents of the information delivered from the information delivery station.

DETAILED DESCRIPTION OF THE INVENTION

Figure 1:
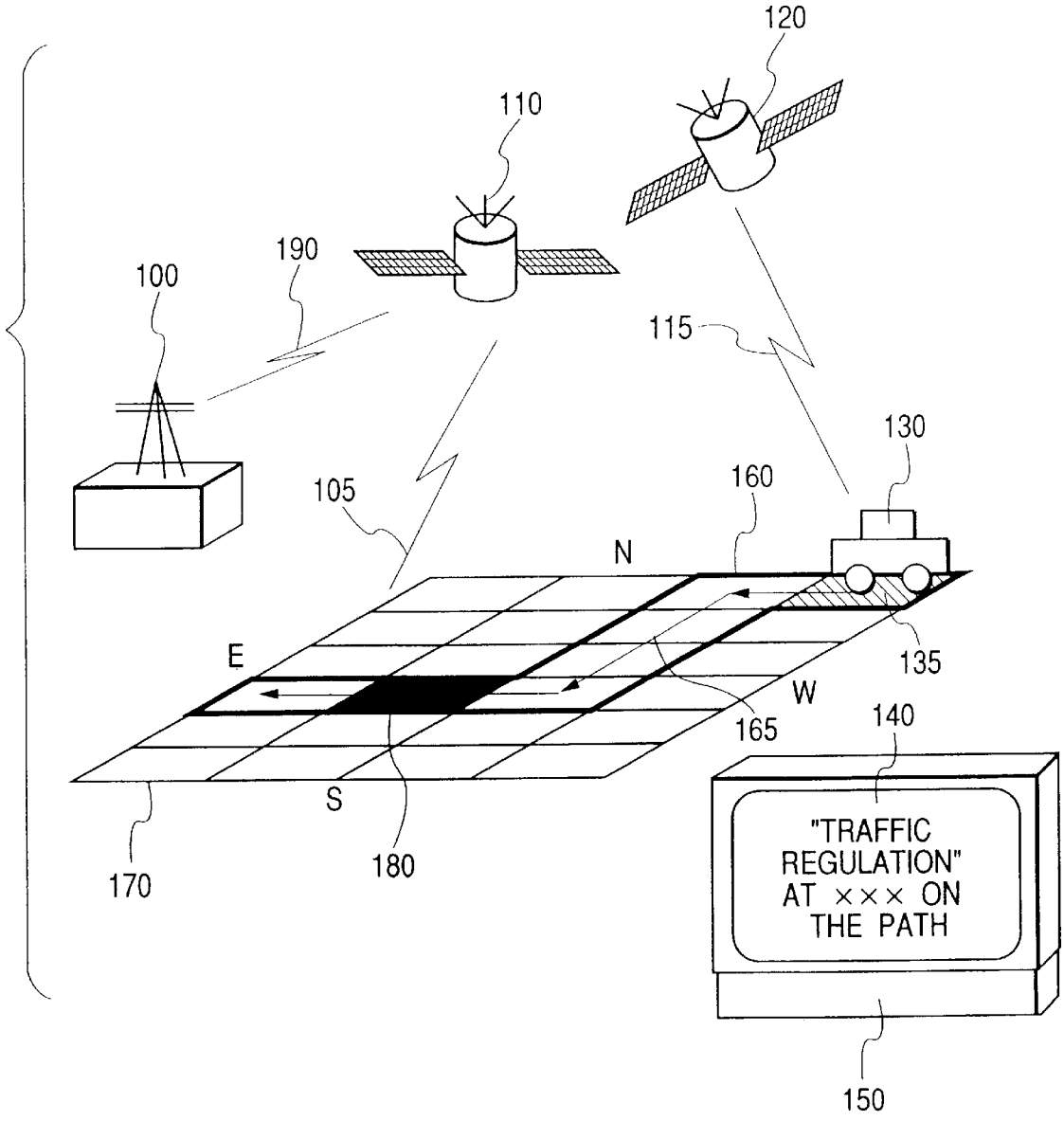
FIG. 1 is an explanatory diagram of a broadcasting system based on the present invention.

[Problems that the Invention is to Solve]

Car navigation systems and other hardware systems in mobile bodies so as to present information are capable of acquiring real-time information from external equipment and presenting accurate information according to the particular conditions of the external equipment. Thus, the convenience of users can be improved. The optimum route search functions of car navigation systems, for example, enable search accuracy to be improved by obtaining as appropriate the traffic trouble information relating to the events occurring ahead.

In that case, it is important "how to transmit real-time information from the external equipment". In view of factors such as communications costs and communicability, it is appropriate to use broadcast communications, a transmission method using a broadcasting system, to transmit information to multiple mobile bodies at the same time. This method suffices to transmit the same information to all mobile bodies.

Depending on the particular type of information, however, it may be necessary to limit the mobile bodies to which the information is to be transmitted. For example, even if traffic trouble information on the events occurring in areas not concerned with the corresponding vehicle is acquired and presented using the tourist guidance function of the car navigation system, convenience to the user will not improve significantly.

Also, when the broadcasting system is used, although a wide range of information is to be transmitted, processing these volumes of information applies a significant load to the car navigation terminal or the like.

In addition, traffic trouble information on not only the current event, but also the events occurring in the areas where the vehicle will enter in the future, must be presented beforehand to ensure that the tourist guidance function of the car navigation system is fully utilized.

The need arises, therefore, to consider transmitting information through broadcast communications and selecting the appropriate incoming information according to the current moving status of the mobile body and/or its further movement schedule.

The prior art described above poses the following problems:

Information can only be obtained in the area linked to the information.

Until the corresponding area has been reached, the information linked to that area cannot be selected.

Said prior art, therefore, has the inconvenience that:

Information related to the area to which the vehicle is about to move cannot be obtained beforehand.

For these reasons, it is not possible with said prior art to transmit information through broadcast communications and select the appropriate incoming information according to the current moving status of the mobile body and/or its further movement schedule.

One objective of the present invention is to realize the environment where the information matching the status of each mobile body can be presented by transmitting various information through broadcast communications and selecting only the appropriate incoming information according to the current moving status of each mobile body and/or its further movement schedule. In other words, enabling the preferential presentation of information highly convenient to specific users who move by car, especially, the users of car navigation terminals, is one objective of the present invention.

Another objective of the present invention is to provide support for the carborne information presentation system to present information according to the moving status of each mobile body and/or its further movement schedule.

Since they visually recognize the road signs, drivers are prone to overlook traffic signs. It is a very troublesome task to install communications equipment at each road sign in order to prevent oversight of a sign, and it is also difficult to update the regulation information that has once been set.

Still another objective of the present invention, therefore, is to supply traffic information editing equipment intended for concentrated management of traffic regulation information.

The present invention is intended to supply an information providing system by which the traffic regulation information specified by the conditions providing for the location, direction, and type of vehicle, the period of use of information, and details of the information, can be sent to the driver in the timing that the information is to be provided. That is, the present invention is intended to aid the user of the car navigation system in moving to the destination smoothly and in collecting information at the destination.

Still another objective of the present invention is to supply an information providing system that selectively delivers information according to the information stored within the vehicle or the particular geographical conditions of the vehicle.

Still another objective of the present invention is to supply an information providing system that enables traffic regulation information to be stored into the vehicle and updated as required.

Means of Solving the Problems

A broadcasting method for attaining the objectives described above is by combining: a transmitting method in which the information that specifies the spot or area to which the broadcasts are to be transmitted is added to these broadcasts and then the broadcasts are transmitted with the spot/area specifying information added; and a receiving method in which, after the information that specifies the spot or area where the intended vehicle currently exists or the spots or areas where the intended vehicle is likely to exist in the future has been retrieved as information 1 first, then the information specifying the spot or area to which the information that was added to the received broadcasts is to be transmitted has been retrieved as information 2, and above-mentioned information 1 and information 2 have been compared, only the necessary broadcast is selected on the basis of comparison results and then displayed.

Also, a broadcasting hardware system for attaining the objectives described above can be configured by combining: a transmitting hardware system that consists of equipment for transmitting broadcasts, equipment for entering the information specifying the spot or area to which the broadcasts are to be transmitted, and equipment for adding the entered spot/area specifying information to the broadcasts, and can transmit the spot/area specifying information in added form together with the broadcasts; and a receiving hardware system that consists of equipment for receiving broadcasts, equipment for retrieving the information that specifies the spot or area where the intended vehicle currently exists or the spots or areas where the intended vehicle is likely to exist in the future, equipment for retrieving the information specifying the spot or area to which the information that has been added to the received broadcasts is to be transmitted, equipment for comparing these types of spot/area specifying information, and equipment for selecting information, and can retrieve as information 1 the information that specifies either the spot or area where the intended vehicle currently exists or the spots or areas where the intended vehicle is likely to exist in the future, retrieve as information 2 the information that specifies the spot or area to which the information that has been added to the received broadcasts is to be transmitted, compare above-mentioned information 1 and information 2, select only the necessary broadcast on the basis of comparison results, and display the selected information.

The sequence from the transmission of broadcasts under the above-described method and hardware configuration to the selection of a broadcast is as follows: (1) the spot or area to which the broadcasts are to be transmitted is designated, (2) the information specifying the designated spot or area is added to the broadcasts, (3) the designated spot/area specifying information is transmitted in added form together with the broadcasts, (4) after receiving the broadcasts, retrieving either the spot or area information corresponding to the current location, or the information specifying the spots or areas to which the vehicle will enter in the future, (5) retrieving the spot/area specifying information that has been added to the received broadcasts, (6) comparing these types of information, and (7) selecting only the necessary information on the basis of comparison results and displaying the information.

Thus, the use of broadcast communications enables information to be transmitted and only the necessary information to be selected according to the moving status of each mobile body and/or its further movement schedule.

A broadcasting method for attaining the objective described above is by combining: a transmitting method in which the information that specifies the spot or area to which the broadcasts are to be transmitted is added to each broadcast and then these broadcasts are transmitted with the spot/area specifying information added; and a receiving method in which, after the information that specifies either the spot/area where the intended vehicle currently exists or the spots/areas where the intended vehicle is likely to exist in the future has been retrieved as information 1 first, then the information specifying the spot or area to which the information that was added to the received broadcasts is to be transmitted has been retrieved as information 2, and above-mentioned information 1 and information 2 have been compared, only the necessary broadcast is selected on the basis of comparison results and then displayed.

Also, a broadcasting hardware system for attaining the objectives described above can be configured by combining: a transmitting hardware system that consists of equipment for transmitting broadcasts, equipment for entering the information specifying the spot or area to which the broadcasts are to be transmitted, equipment for entering the effective time-of-day/available hours of information, equipment for adding spot/area specifying information to the broadcasts, equipment for adding the effective time-of-day/available hours of information to the broadcasts, and equipment for transmitting both the spot or area specifying information and the effective time-of-day/available hours of information in added form together with the broadcasts, and; a receiving hardware system that consists of equipment for receiving broadcasts, equipment for retrieving the information that specifies the spot or area where the intended vehicle currently exists or the spots or areas where the intended vehicle is likely to exist in the future, equipment for retrieving the information that specifies the spot or area to which the information that has been added to the received broadcasts is to be transmitted, equipment for retrieving the information that specifies the effective time-of-day/available hours of information for either the spot/area where the intended vehicle currently exists or the spots/areas where the intended vehicle is likely to exist in the future, equipment for retrieving the effective time-of-day/available hour information that has been added to the received broadcasts, equipment for comparing the information that specifies the effective time-of-day/available hours of information, equipment for selecting information, and equipment for displaying information, and can retrieve as information 1 the information that specifies the spot or area where the intended vehicle currently exists or the spots or areas where the intended vehicle is likely to exist in the future, retrieve as information 2 the information that specifies the spot or area to which the information that has been added to the received broadcasts is to be transmitted, retrieve as information 3 the information that specifies the effective time-of-day/available hours of information for either the spot/area where the intended vehicle currently exists or the spots/areas where the intended vehicle is likely to exist in the future, retrieve as information 4 the effective time-of-day/available hour information that has been added to the received broadcasts, compare above-mentioned information 1 and information 2, comparing above-mentioned information 3 and information 4, select only the necessary broadcast on the basis of comparison results, and display the selected information.

The sequence from the transmission of broadcasts under the above-described method and hardware configuration to the selection of a broadcast is as follows: (1) the spot or area to which the broadcasts are to be transmitted is designated, (2) the effective time-of-day/available hours of information are designated, (3) the information specifying the designated spot or area and the information specifying the designated effective time-of-day/available hours is added to the broadcasts, (4) the designated spot/area specifying information and the designated effective time-of-day/available-hour specifying information are transmitted in added form together with the broadcasts, (5) after receiving the broadcasts, retrieving either the spot/area information corresponding to the current location, or the information specifying the spots/areas to which the vehicle will enter in the future, (6) retrieving the spot/area specifying information that has been added to the received broadcasts, (7) retrieving the information that specifies the effective time-of-day/available hours of information for either the spot/area where the vehicle currently exists or the spots/areas where the intended vehicle is likely to exist in the future, (8) retrieving the effective time-of-day/available-hour specifying information that has been added to the received broadcasts, (9) comparing the information that specifies these spots or areas, (10) comparing the time-of-day/available hour information, (11) selecting only the necessary information on the basis of comparison results, and (12) displaying the information.

Thus, the use of broadcast communications enables information to be transmitted and only the necessary information to be selected according to the moving status of each mobile body and/or its further movement schedule.

Also, in order to achieve the above-mentioned objective of implementing the concentrated management of traffic regulation information, traffic information editing equipment based on the present invention has a means for specifying the information-providing location, direction, period, and conditions, and entering road regulation information and event regulation information, and a means for storing the above-mentioned road regulation information and event regulation information into a memory.

An information providing system based on the present invention comprises the above-mentioned traffic information editing equipment, a communications base station that contains all or part of the traffic regulation information stored within the traffic information editing equipment, a vehicle, and a means for communicating between the communications base station and the vehicle. This vehicle has a means for receiving traffic regulation information from the communications base station, and a means for presenting the information to the persons within the vehicle. In this information providing system, the means for presenting traffic regulation information to the persons within the vehicle further includes either a visual display means or an audio notification means, or both, and a means for selecting whether traffic regulation information is to be presented.

In order to achieve the above-mentioned objective of supplying traffic regulation information to the driver in the necessary timing, the information providing system has absolute location measuring equipment, a means for deriving the direction of the vehicle from its absolute location information, a means for acquiring the traveling speed of the vehicle, a means for storing road regulation information into a memory, and either a means for presenting memory-stored road regulation information to the persons within the vehicle under the specified location, direction, period, and information providing conditions, or a means for calculating the timing of providing information and presenting memory-stored road regulation information to the persons within the vehicle, in the calculated timing; all these pieces of equipment and means being arranged in the vehicle interior.

In addition, in order to achieve the objective of delivering information selectively according to the particular geographical conditions of the vehicle, the information providing system comprises the above-mentioned traffic information editing equipment, a communications base station that contains all or part of the traffic regulation information stored within the traffic information editing equipment, a vehicle with absolute location measuring equipment, and a narrow-area radio communications means for communicating from the communications base station to the vehicle. The vehicle with absolute location measuring equipment has a means for deriving the direction of the vehicle from its absolute location information, a means for acquiring the current time of day, a means for acquiring the traveling speed of the vehicle, a means for receiving traffic regulation information from the communications base station, a means for storing traffic regulation information into a memory, and either a means for presenting memory-stored road. regulation information to the persons within the vehicle under the specified location, direction, period, and information providing conditions, or a means for calculating the timing of providing information and presenting memory-stored road regulation information to the persons within the vehicle, in the calculated timing.

In addition, in order to achieve the objective of delivering information according to the information stored within the vehicle, another information providing system based on the present invention comprises the above-mentioned traffic information editing equipment, a communications base station that contains all or part of the traffic regulation information stored within the traffic information editing equipment, a vehicle with absolute location measuring equipment, and a mobile two-way communications means for communicating between the communications base station and the vehicle. The communications base station has a means for picking traffic regulation information selectively on the basis of the information received from the vehicle, and transmitting the picked information to the vehicle. The vehicle with absolute location measuring equipment has a means for deriving the direction of the vehicle from its absolute location information, a means for acquiring the current time of day, a means for acquiring the traveling speed of the vehicle, a means for receiving traffic regulation information from the communications base station, a means for storing traffic regulation information into a memory, and either a means for presenting memory-stored traffic regulation information to the persons within the vehicle under the specified location, direction, period, and information providing conditions, or a means for calculating the timing of providing information and presenting memory-stored traffic regulation information to the persons within the vehicle, in the calculated timing.

Furthermore, in order to achieve the above-mentioned objective, still another information providing system based on the present invention comprises the above-mentioned traffic information editing equipment, a communications base station that contains all or part of the traffic regulation information stored within the traffic information editing equipment, a vehicle with absolute location measuring equipment, and a multi-channel broadcast communications means for communicating from the communications base station to the vehicle. The communications base station has a means for classifying internally stored traffic regulation information on the basis of the location, direction, period, and information providing conditions that have been specified from the traffic information editing equipment, then assigning the classified information to each channel, and transmitting the information. The vehicle with absolute location measuring equipment has a means for deriving the direction of the vehicle from its absolute location information, a means for acquiring the current time of day, a means for acquiring the traveling speed of the vehicle, a means for receiving electrical signals, a means for receiving traffic regulation information from the communications base station by changing the channel according to the particular absolute location, traveling direction, and vehicle type information of the vehicle, a means for storing traffic regulation information into a memory, and either a means for presenting memory-stored traffic regulation information to the persons within the vehicle under the specified location, direction, period, and information providing conditions, or a means for calculating the timing of providing information and presenting memory-stored traffic regulation information to the persons within the vehicle, in the calculated timing.

Furthermore, in order to achieve the objective of storing traffic regulation information inside the vehicle and updating the information as required, information providing systems based on the present invention comprise traffic information editing equipment provided with a storage means for storing the version number of the traffic regulation information, and a vehicle capable of internally storing either the road regulation information that has been acquired beforehand, or the traffic regulation information that has been received before. These information providing systems also have a storage means for containing the version number of the traffic regulation information stored within the vehicle, and a means for comparing this version number and the version number of the latest traffic regulation information that has been acquired through communications, and if both version numbers differ, updating the traffic regulation information stored within the vehicle.

Another possible configuration uses a combination of: an information delivering method, which comprises the step of, prior to the broadcasting of information, adding to the information broadcast the information relating to the spot of the information transmission source, the distance herefrom, and the route hereto, and the step of broadcasting the information, and; an information receiving method, which comprises the step of calculating the route and the distance from the information specifying the current spot of the vehicle and from the spot information of the information transmission source that has been added to the delivered information, the step of comparing the calculated route and the route to the information transmission source that has been added to the delivered information, the step of comparing the calculated distance and the distance to the information transmission source that has been added to the delivered information, and the step of receiving only the necessary information on the basis of comparison results.

Another possible configuration uses the receiving hardware system that receives information to which the information relating to the spot of the information transmission source, the distance herefrom, and the route hereto, has been added; wherein the receiving hardware system has a means for calculating the route and the distance from the information specifying the current spot of the vehicle and from the spot information of the information transmission source that has been added to the delivered information, a means for comparing the calculated route and the route to the information transmission source that has been added to the delivered information, a means for comparing the calculated distance and the distance to the information transmission source that has been added to the delivered information, and a means for receiving only the necessary information on the basis of comparison results.

Still another possible scheme of providing information is by the information provider's creating the optimum independent information beforehand for each situation of the user, then adding the user's situation information to the corresponding broadcast information that has been created, and delivering the broadcast information with the user's situation information added.

It is desirable that the user's situation information under this information-providing scheme should be information relating to the position of the user.

It is also desirable that the user's situation information should be information relating to either the overall width, overall height, and overall length of the vehicle, or the type of engine of the vehicle, or the light-duty/medium-duty/heavy-duty classification of the vehicle.

It is also desirable that the user's situation information should be information relating to the location or railway line of the train.

Embodiments of the Invention

One embodiment of the present invention is described below seeing figures.

An overview of the terms used in the present invention is given below in order to make it easy to understand the invention.

"Broadcast communications" refers to television broadcasting, radio broadcasting, or other forms of information delivery not specifying the transmission destination.

The "effective time-of-day and/or available hours of information" refers to the limited time-of-day and/or hours during which traffic regulation information and other information on events can be acquired and used.

The term "spot" refers to the location specified by factors such as: the latitude, the longitude, and the relative distance from a reference point whose latitude and longitude are known.

The term "area" refers to the area specified by factors such as: the latitude, the longitude, and the relative distance from a reference point whose latitude and longitude are known.

An outline of a broadcasting system based on the present invention is given in FIG. 1.

In FIG. 1, numerals 100, 110, 120, 130, 150, and 140 denote a broadcasting station, a digital radio broadcasting satellite, a global positioning system (GPS) satellite, a vehicle, a car navigation system, and information display by the car navigation system, respectively. Car navigation system 150 has receiving equipment based on the present invention. Also, car navigation system 150 is mounted in vehicle 130 and performs location detection, route search, and information presentation functions.

Likewise, numeral 190 denotes a satellite broadcast transmission signal from broadcasting station 100, numeral 105 denotes a location confirmation signal from GPS satellite 120, numeral 170 denotes the entire area range over which the information is to be transmitted, numeral 165 denotes the traveling route of vehicle 130, numeral 160 denotes the area corresponding to traveling route 165 of vehicle 130 in entire area range 170, numeral 180 denotes the information transmission area in entire area range 170, numeral 135 denotes the area in entire area range 170 where vehicle 130 currently exists.

FIG. 1 assumes that entire area range 170 over which the information is to be transmitted is segmented into smaller areas. FIG. 1 also assumes that the same information relating to the segmentation of the area range is stored in both broadcasting station 100 and car navigation system 150 and that the car navigation system is capable of identifying the location of vehicle 130, receiving satellite broadcast signal 105, and presenting information.

At broadcasting station 100, after the area to which the traffic regulation information is to be transmitted has been set as area 180, information that specifies area 180 is added to the traffic regulation information, which is then sent as satellite broadcast transmission signal 190 to digital radio broadcasting satellite 110. After receiving satellite broadcast transmission signal 190, digital radio broadcasting satellite 110 transfers the signal as satellite broadcast signal 105.

Car navigation system 150 receives location confirmation signal 115 from GPS satellite 120 and derives the location of vehicle 130 from the signal. Car navigation system 150 also identifies area 135 as the area in entire area range 170 where vehicle 130 exists. In addition, car navigation system 150 derives area 160 from internally stored traveling route 165, which has been entered by the driver beforehand or obtained using the route search function of the navigation system.

After receiving a broadcast, car navigation system 150 receives satellite broadcast signal 105 and retrieves traffic regulation information and area specifying information from the signal. In this embodiment of the present invention, information that specifies area 180 is retrieved. Car navigation system 150 compares the relationship between area 135 in which vehicle currently exists, area 160 corresponding to the traveling route, and retrieved-information transmission area 180. In this embodiment of the present invention, since area 160 corresponding to the traveling route includes broadcasting area 180, car navigation system 150 judges that there is a need to select the traffic regulation information included in satellite broadcast signal 105. The traffic regulation information that has thus been selected is displayed as information 140. Thus, traffic regulation information existing on traveling route 165 of vehicle 130 is displayed as information 140 at the terminal of car navigation system 150.

It is thus possible to implement a broadcasting system that uses broadcast communications to transmit information, select only the necessary information from all received information according to the particular moving status of the mobile body and its future moving schedule, and present the selected information according to the particular situation of the mobile body.

A terrestrial wave transmission signal and a terrestrial broadcasting signal can be used, instead of satellite broadcast transmission signal 190 and satellite broadcast signal 105, respectively. Also, terrestrial repeater equipment can be used, instead of digital radio broadcasting satellite 110. In addition, broadcasting station 100 and navigation system 150 can respectively transmit and receive terrestrial waves also. In such a case, it is likewise possible by using terrestrial equipment only, not using a digital radio broadcasting satellite, to implement a broadcasting system that uses broadcast communications to transmit information, select only the necessary information from all received information according to the particular travel status of the mobile body and its future travel schedule, and present the selected information according to the particular situation of the mobile body.

Digital radio broadcasting satellite 110 can also be such that it is a digital radio satellite always positioned in the zenithal direction when viewed from the ground level, and navigation system 150 can also be such that its receiving gains are with respect to the corresponding digital radio satellite only. In such cases, it is possible to reduce receiving trouble due to the presence of buildings and other structures and to implement a broadcasting system that presents information according to the particular situation of the mobile body and without interrupting the broadcast.

Figure 2:
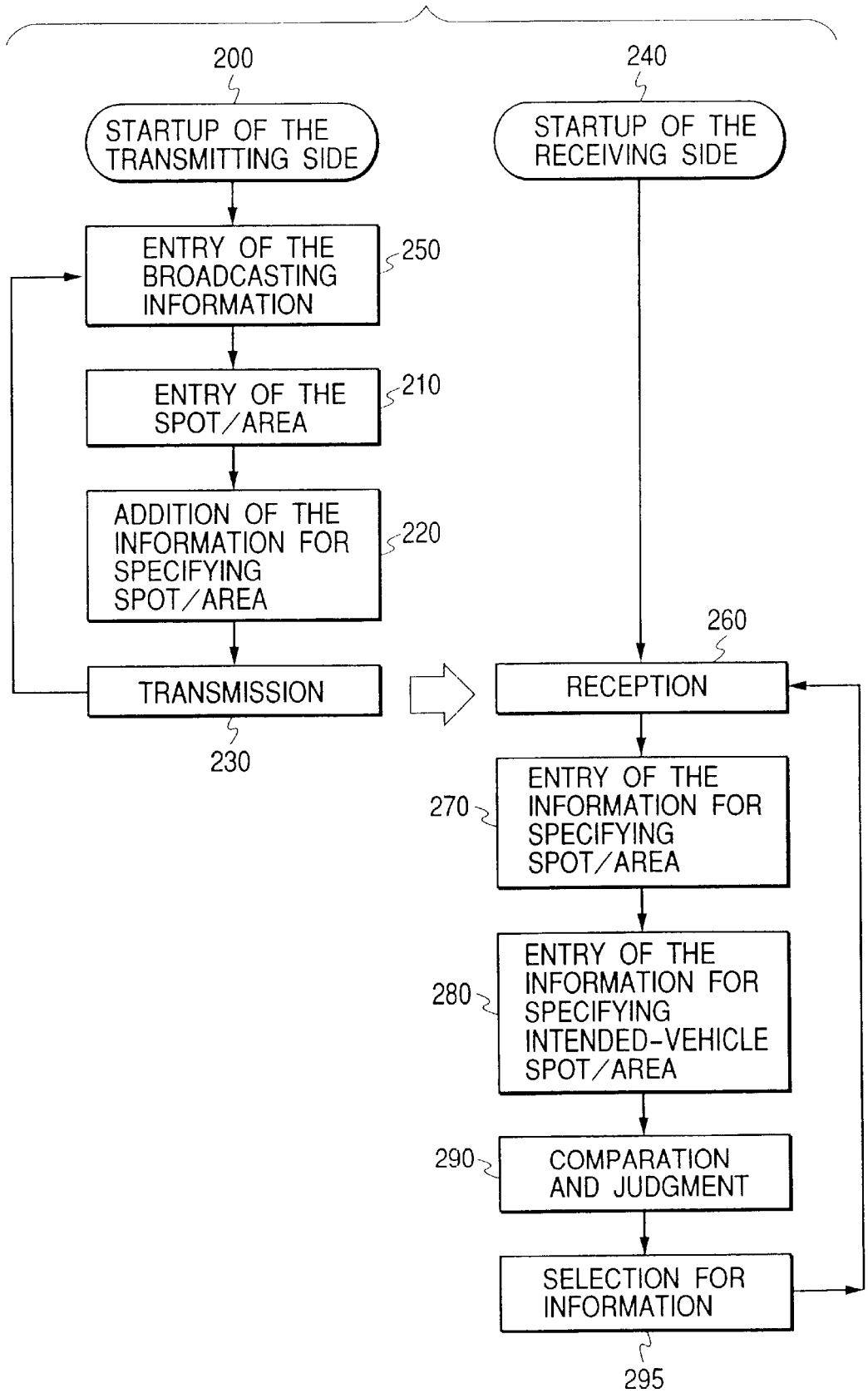
FIG. 2 is a processing flow diagram of a broadcasting method based on the present invention.

The flow of processing of a broadcasting method based on the present invention is shown in FIG. 2.

In FIG. 2, the processing steps taken at the transmitting side are shown as numerals 200, 210, 220, 230, and 250. Similarly, the processing steps taken at the receiving side are shown as numerals 240, 250, 260, 270, 280, 290, and 295.

In FIG. 2, numeral 200 denotes the start of processing at the transmitting side, numeral 250 denotes the process of entering the information to be broadcast, numeral 210 denotes the process of entering the spot or area to which the information broadcast is to be transmitted, numeral 220 denotes the process of adding to the information broadcast the information that specifies the spot or area to which the information broadcast is to be transmitted, and numeral 230 denotes the process of transmitting the information.

Numeral 240 denotes the start of processing at the receiving side, numeral 260 denotes the process of receiving broadcasts, numeral 270 denotes the process of retrieving the transmission destination information (the information specifying the spot or area to which the broadcast information is to be transmitted) that has been added to received information, numeral 280 denotes the process of retrieving the information that specifies the spot or area where the vehicle currently exists or the spots or areas where the intended vehicle is likely to exist in the future, numeral 290 denotes the process of comparing and analyzing the transmission destination information (the information specifying the spot or area to which the broadcast information is to be transmitted) that has been added to received information and the information specifying the spot or area where the vehicle currently exists or the spots or areas where the intended vehicle is likely to exist in the future, and numeral denotes the process of selecting only the necessary information from all received information.

For the transmission that begins with process 200, the information to be broadcast is entered during process 250, which is followed by processes 210, 220, and 230, in that order. In process 210, the spot or area to which the broadcast information is to be transmitted is entered; in process 220, the information specifying the spot or area to which the broadcast information is to be transmitted is added to the information broadcast, and; in process 230, the information is transmitted. Subsequently, control is returned to process 250, from which the processing sequence is restarted again.

In receive processing that begins with process 240, broadcasts are received during process 260-first. Subsequently, processes 270, 280, 290, and 295 are performed in that order. In process 270, the information specifying the spot or area to which the information broadcast is to be transmitted is retrieved from received information; in process 280, the spot or area where the vehicle currently exists or the spots or areas where the intended vehicle is likely to exist in the future are derived and the information specifying these spots or areas is derived; in process 290, the information that was retrieved in process 270 above (namely, the information specifying the spot or area to which the information broadcast is to be transmitted) and the information that was derived in process 280 above (namely, the information specifying the spot or area where the vehicle currently exists, or the information specifying the spots or areas where the vehicle is likely to exist in the future) are compared and analyzed, and; in process 295, information is selected on the basis of the results of process 290 above. Subsequently, control is returned to process 260, from which the processing sequence is restarted again.

In this way, the broadcasting method described above as an embodiment of the present invention can be implemented.

Figure 3:
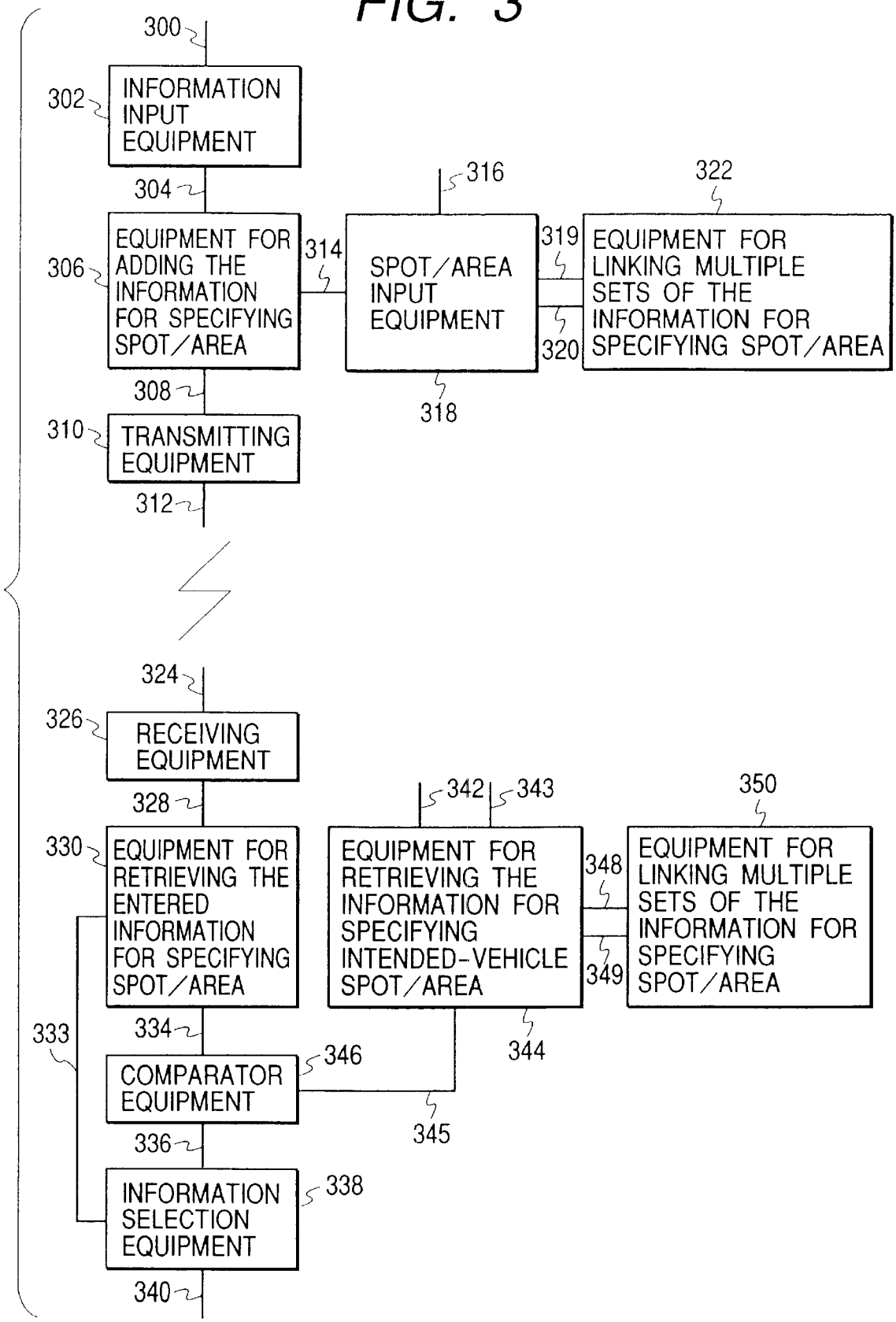
FIG. 3 is a functional block diagram of a broadcasting hardware system based on the present invention.

A functional block diagram of transmitting and receiving hardware systems based on the present invention is shown as FIG. 3.

In FIG. 3, numerals 300, 302, 304, 306, 308, 310, 312, 314, 316, 318, 319, 320, and 322 denote the components of the transmitting hardware system. Likewise, numerals 324, 326, 328, 330, 322, 334, 336, 338, 340, 342, 344, 346, 348, and 350 denote the components of the receiving hardware system.

In FIG. 3, equipment for entering the information to be broadcast is shown as 302; equipment for adding transmission destination (spot or area) specifying information to the information to be broadcast, as 306; equipment for transmitting the information, as 310; equipment for entering the spot or area to which the information broadcast is to be transmitted, as 318, and; equipment for linking the spot/area information and the spot/area specifying information, as 322.

Likewise, the path for entering the information to be broadcast is shown as 300; the path for transmitting the information to be broadcast, as 304; the path for, transferring the information to be transmitted, as 308; the path for transferring spot/area specifying information, as 314; the path for entering the spot or area, as 316; the path for transmitting information, as 312; the path for transmitting entered spot/area information, and; the path for transferring spot/area specifying information, as 320.

Likewise, in FIG. 3, equipment for receiving broadcasts is shown as 326; equipment for retrieving transmission destination (spot or area) specifying information from received information, as 330; equipment for retrieving the information that specifies the spot or area where the vehicle currently exists or the spots or areas where the intended vehicle is likely to exist in the future, as 344; equipment for linking entered spot/area information and spot/area specifying information, as 350; equipment for comparing and analyzing the transmission destination (spot or area) specifying information and the information that specifies the spot or area where the vehicle currently exists or the spots or areas where the intended vehicle is likely to exist in the future, as 334, and; equipment for selecting from all received information only the information to be transmitted.

The path for receiving information is shown as 324; the path for displaying selected information, as 340; the path for transferring received information, as 328; the path for transferring the information that specifies the spot or area to which the information broadcast is to be transmitted, as 332; the path for transmitting comparative judgment results, as 336; the path for transmitting the information that specifies the spot or area where the vehicle currently exists or the spots or areas where the intended vehicle is likely to exist in the future, as 345; the path for transmitting entered spot/area information, as 348; the path for transmitting the spot/area specifying information, as 349; the path for entering information on the spot or area where the vehicle currently exists, as 342, and; the path for entering information on the spots or areas where the vehicle is likely to exist in the future, as 343.

At the transmitting side, equipment 302, equipment 306, and equipment 318 are each provided with an information processing unit, a data processing unit, an input unit, an output unit, and storage units (such as a RAM, a magnetic tape unit, a magnetic disk unit, and/or an magneto-optid disk).

Likewise, equipment 322 has an information processing unit, a data comparative processing unit, an input unit, an output unit, and storage units (such as a RAM, a ROM, a magnetic tape unit, a magnetic disk unit, an magneto-optic disk, and/or an optical disk).

Likewise, equipment 310 has an information processing unit, an input unit, an output unit, storage units (such as a RAM, a ROM, a magnetic tape unit, a magnetic disk unit, an magneto-optic disk, and/or an optical disk), and an terrestrial communications signal output unit or a satellite communications signal output unit.

Likewise, equipment 302, equipment 306, equipment 318, equipment 322, and equipment 310 can have the respective processing functions divided by programming to share an "information processing unit". Equipment 302, equipment 306, equipment 318, equipment 322, and equipment 310 can also have the respective work areas divided to share "storage units".

At the receiving side, equipment 326 has an information processing unit, an input unit, an output unit, storage units (such as a RAM, a magnetic tape unit, a magnetic disk unit, and/or an magneto-optic disk), and an terrestrial communications signal input unit or a satellite communications signal input unit.

Likewise, both equipment 330 and equipment 344 are provided with an information processing unit, an input unit, an output unit, and storage units (such as a RAM, a magnetic tape unit, a magnetic disk unit, and/or an magneto-optic disk).

Likewise, equipment 350, equipment 334, and equipment 338 are each provided with an information processing unit, a data comparative processing unit, an input unit, an output unit, and storage units (such as a RAM, a magnetic tape unit, a magnetic disk unit, and/or an magneto-optic disk).

Equipment 326, equipment 330, equipment 332, equipment 334, equipment 338, equipment 344, or equipment 350 can have the respective processing functions divided by programming to share an "information processing unit". Equipment 326, equipment 330, equipment 332, equipment 334, equipment 338, equipment 344, or equipment 350 can also have the respective work areas divided to share "storage units".

During communications, paths 312 and 324 are realized as, for example, a terrestrial communications path and a satellite communications path, respectively.

At the transmitting side, equipment 302 receives via path 300 the information broadcast, and transfers the information to equipment 306 via path 306.

Equipment 318 receives transmission destination (spot/area) information via path 316 and transfers the information to equipment 322 via path 319. Equipment 318 also receives via path 320 the spot/area specifying information corresponding to the transmission destination (spot/area) information, and sends the information to equipment 306 via path 314.

Equipment 322, after receiving transmission destination (spot/area) information and obtains spot/area specifying information via path 319, sends the information to equipment 318 via path 320.

After receiving the information broadcast and the information that specifies the transmission destination (spot or area), equipment 306 creates the information to be transmitted, by adding the transmission destination (spot/area) specifying information to the information broadcast, and then transfers the information to equipment 310 via path 308.

After receiving the information broadcast, equipment 310 transmits the information via path 312.

At the receiving side, equipment 326 receives broadcasts via path 324 and transfers the information to equipment 330 via path 328.

Equipment 330, after receiving information, retrieves broadcast information and transmission destination (spot/area) specifying information from the received information and transfers the broadcast information to equipment 338 via path 333. Equipment 330 also transfers the transmission destination (spot/area) specifying information to equipment 334 via path 332.

Equipment 344 receives via path 342 the information relating to the spot or area where the vehicle currently exists, and transfers the information to equipment 350 via path 348. Equipment 344 also receives via path 349 the information that specifies the corresponding spot or area, and transfers the information to equipment 334 via path In addition, equipment 344 receives via path 343 the information relating to the spots or areas where the vehicle is likely to exist in the future, and transfers the information to equipment 350 via path 348. Furthermore, equipment 344 receives via path 349 the information that specifies the corresponding spots or areas, and transfers the information to equipment 334 via path 345.

After receiving spot/area specifying information and the information that specifies the spot or area where the vehicle currently exists or the spots or areas where the intended vehicle is likely to exist in the future, equipment 334 performs comparative judgments on both types of information and sends the results to equipment 338 via path 336.

After receiving all broadcast information and the comparative judgment result information, equipment 338 displays only the appropriate broadcast information according to the particular results of the comparative judgment, via path 340.

Suppose that:

The information to be broadcast is character string information denoting "oo?XX traffic regulation".

The entire area over which the information is to be transmitted is a rectangular area with its diagonal vertex set to "(latitude, longitude)=(0, 0) (10, 10)".

The entire area range over which the information is to be transmitted is segmented into rectangular areas each having "(differential longitude, differential latitude) =(2, 2)".

Also, suppose that the information specifying each area is numeric character information represented as follows:

Rectangular area with its diagonal vertex set to "(latitude, longitude)=(0, 0) (2, 2)" . . . "0"

Rectangular area with its diagonal vertex set to "(latitude, longitude)=(0, 2) (2, 4)" . . . "1"

Rectangular area with its diagonal vertex set to "(latitude, longitude)=(0, 4) (2, 6)" . . . "2"

Rectangular area with its diagonal vertex set to "(latitude, longitude)=(0, 6) (2, 8)" . . . "3"

Rectangular area with its diagonal vertex set to "(latitude, longitude)=(0, 8) (2, 10)" . . . "4"

Rectangular area with its diagonal vertex set to "(latitude, longitude)=(2, 0) (4, 2)" . . . "5"

Rectangular area with its diagonal vertex set to "(latitude, longitude)=(2, 2) (4, 4)" . . . "6"

Rectangular area with its diagonal vertex set to "(latitude, longitude)=(2, 4) (4, 6)" . . . "7"

Rectangular area with its diagonal vertex set to "(latitude, longitude)=(2, 6) (4, 8)" . . . "8"

Rectangular area with its diagonal vertex set to "(latitude, longitude)=(2, 8) (4, 10)" . . . "9"

Rectangular area with its diagonal vertex set to "(latitude, longitude)=(4, 0) (6, 2)" . . . "10"

Rectangular area with its diagonal vertex set to "(latitude, longitude)=(4, 2) (6, 4)" . . . "11"

Rectangular area with its diagonal vertex set to "(latitude, longitude)=(4, 4) (6, 6)" . . . "12"

Rectangular area with its diagonal vertex set to "(latitude, longitude)=(4, 6) (6, 8)" . . . "13"

Rectangular area with its diagonal vertex set to "(latitude, longitude)=(4, 8) (6, 10)" . . . "14"

Rectangular area with its diagonal vertex set to "(latitude, longitude)=(6, 0) (8, 2)" . . . "15"

Rectangular area with its diagonal vertex set to "(latitude, longitude)=(6, 2) (8, 4)" . . . "16"

Rectangular area with its diagonal vertex set to "(latitude, longitude)=(6, 4) (8, 6)" . . . "17"

Rectangular area with its diagonal vertex set to "(latitude, longitude)=(6, 6) (8, 8)" . . . "18"

Rectangular area with its diagonal vertex set to "(latitude, longitude)=(6, 8) (8, 10)" . . . "19"

Rectangular area with its diagonal vertex set to "(latitude, longitude)=(8, 0) (10, 2)" . . . "20"

Rectangular area with its diagonal vertex set to "(latitude, longitude)=(8, 2) (10, 4)" . . . "21"

Rectangular area with its diagonal vertex set to "(latitude, longitude)=(8, 4) (10, 6)" . . . "22"

Rectangular area with its diagonal vertex set to "(latitude, longitude)=(8, 6) (10, 8)" . . . "23"

Rectangular area with its diagonal vertex set to "(latitude, longitude)=(8, 8) (10, 10)" . . . "24"

In addition, suppose that:

The area to which the information broadcast is to be transmitted is a rectangular area with its diagonal vertex set to "(latitude, longitude)=(4, 4) (6, 6)".

The location where the vehicle currently exists is represented as "(latitude, longitude)=(1, 1)".

The locations where the vehicle will exist in the future are planned as "(latitude, longitude)=(3, 3) (5, 5) (7, 7)".

First, the information broadcast, namely, "oo?XX traffic regulation" is entered into equipment 302 via path 300.

The character string information denoting "oo?XX traffic regulation" is sent from equipment 302 to equipment 306 via path 304.

The transmission destination (area) information "rectangular area with its diagonal vertex set to "(latitude, longitude)=(4, 4) (6, 6)" is entered into equipment 318 via path 316.

The transmission destination (area) information "rectangular area with its diagonal vertex set to "(latitude, longitude)=(4, 4) (6, 6)" is sent from equipment 318 to equipment 322 via path 319.

After receiving the transmission destination (area) information "rectangular area with its diagonal vertex set to "(latitude, longitude)=(4, 4) (6, 6)", equipment 322 obtains "12" as the numeric character information specifying the corresponding area, and transfers the information to equipment 318 via path 320.

After receiving the numeric character information "12", equipment 318 transfers the information to equipment 306 via path 314.

Equipment 306 adds numeric character information "12" to the character string information "oo?XX traffic regulation" by inserting the delimiter identifier "+" between both, and transfers to equipment 310 via path 308 the resulting "oo?XX traffic regulation +12" information to be transmitted.

After receiving "oo?XX traffic regulation +12" as the information to be transmitted, equipment 310 transmits the information via path 312.

Meanwhile, equipment 326 receives the characterizing information "oo?XX traffic regulation +12" via path 324 and transfers the information to equipment 330 via path 328.

After receiving the character string information "oo?XX traffic regulation +12", equipment 330 identifies the "+" delimiter identifier, then removes "12", which is information that was added to specify the spot or area to which the information broadcast is to be transmitted, and sends the remaining information to equipment 334 via path 332.

Also, all the broadcast information "oo?XX traffic regulation +12", except the transmission destination (spot/area) specifying information "12", is sent to equipment 338 via path 333.

Meanwhile, the information "(latitude, longitude)=(1, 1)" that denotes the current location of the vehicle is entered into equipment 344 via path 342.

Also, the information "(latitude, longitude)=(3, 3) (5, 5) (7, 7)" that denotes the locations to which the vehicle is scheduled to move in the future is entered into equipment 344 via path 343.

After receiving the information that denotes the current location of the vehicle and the information that denotes the locations to which the vehicle is scheduled to move in the future, equipment 344 derives the areas corresponding to the current and future locations, and sends the following area information to equipment 350 via path 348:

Rectangular area with its diagonal vertex set to "(latitude, longitude)=(0, 0) (2, 2)"

Rectangular area with its diagonal vertex set to "(latitude, longitude)=(2, 2) (4, 4)"

Rectangular area with its diagonal vertex set to "(latitude, longitude)=(4, 4) (6, 6)"

Rectangular area with its diagonal vertex set to "(latitude, longitude)=(6, 6) (8, 8)"

Equipment 350, after receiving the area information shown above, acquires the information specifying the corresponding areas, and sends the following codes in area-linked form to equipment 344 via path 349:

"0"

"6"

"12"

"18"

After receiving both the information "0" that specifies the area where the vehicle currently exists, and the codes "6", "12", and "18" that specify the areas where the vehicle is likely to exist in the future, equipment 344 sends both types of information to equipment 334 via path 346.

After receiving the area information-added transmission destination (spot/area) specifying information "12", the information "0" that specifies the area where the vehicle currently exists, and the "6", "12", and "18" information that specifies the areas where the vehicle is likely to exist in the future, equipment 334 compares the three types of information , then judges that since part of the information specifying the areas where the vehicle is likely to exist in the future matches the information specifying the broadcast destination area, the corresponding information is to be selected from all received information, and sends the results to equipment 338 via path 336.

Equipment 338, after receiving the broadcast information "oo?XX traffic regulation" and the comparative judgment results, sends the broadcast information "oo?XX traffic regulation" to the required output unit via path 340.

Thus, broadcast transmitting and receiving hardware systems based on the present invention can be configured.

In the above, it is possible, after adding broadcast destination area information to the information to be broadcast, instead of replacing the broadcast destination area information with the information that specifies the corresponding area, to transmit the broadcast destination area information intact as follows:

Rectangular area with its diagonal vertex set to "(latitude, longitude)=(4, 4) (6, 6)"

Likewise, the information specifying the area where the vehicle currently exists, and the information specifying the areas where the vehicle is likely to exist in the future, can also be left intact as follows, instead of being replaced with the information that specifies the corresponding area:

Rectangular area with its diagonal vertex set to "(latitude, longitude)=(0, 0) (2, 2)"

Rectangular area with its diagonal vertex set to "(latitude, longitude)=(2, 2) (4, 4)"

Rectangular area with its diagonal vertex set to "(latitude, longitude)=(4, 4) (6, 6)"

Rectangular area with its diagonal vertex set to "(latitude, longitude)=(6, 6) (8, 8)"

In addition, it is possible under this state to determine whether an included/overlapped relationship exists between areas, and to adopt the results as the results of comparative judgment in equipment 334. In such a case, equipment can be configured without component 322 or 350. Equipment can also be configured without segmenting the broadcasting range into small areas beforehand.

The likely future locations of the vehicle, set forth in this embodiment of the present invention, can likewise be set using the trip predicting information presented by a navigation system function such as a route search function. In this case, it is possible to configure equipment not requiring the selection of the information relating to the spots or areas where the vehicle is likely to exist in the future.

Figure 4:
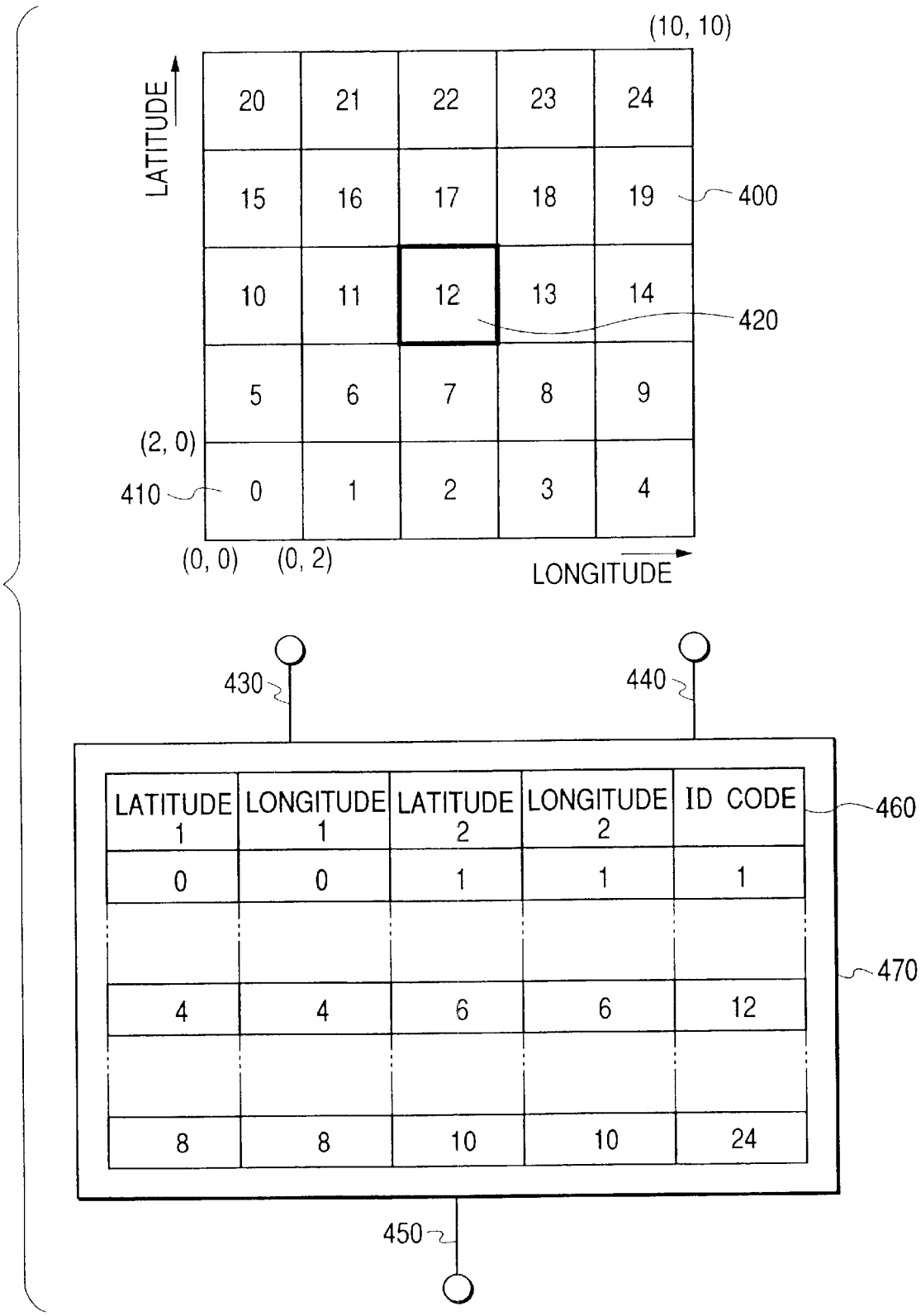
FIG. 4 is an explanatory diagram of segmented-area data structure based on the present invention.
Figure 5:
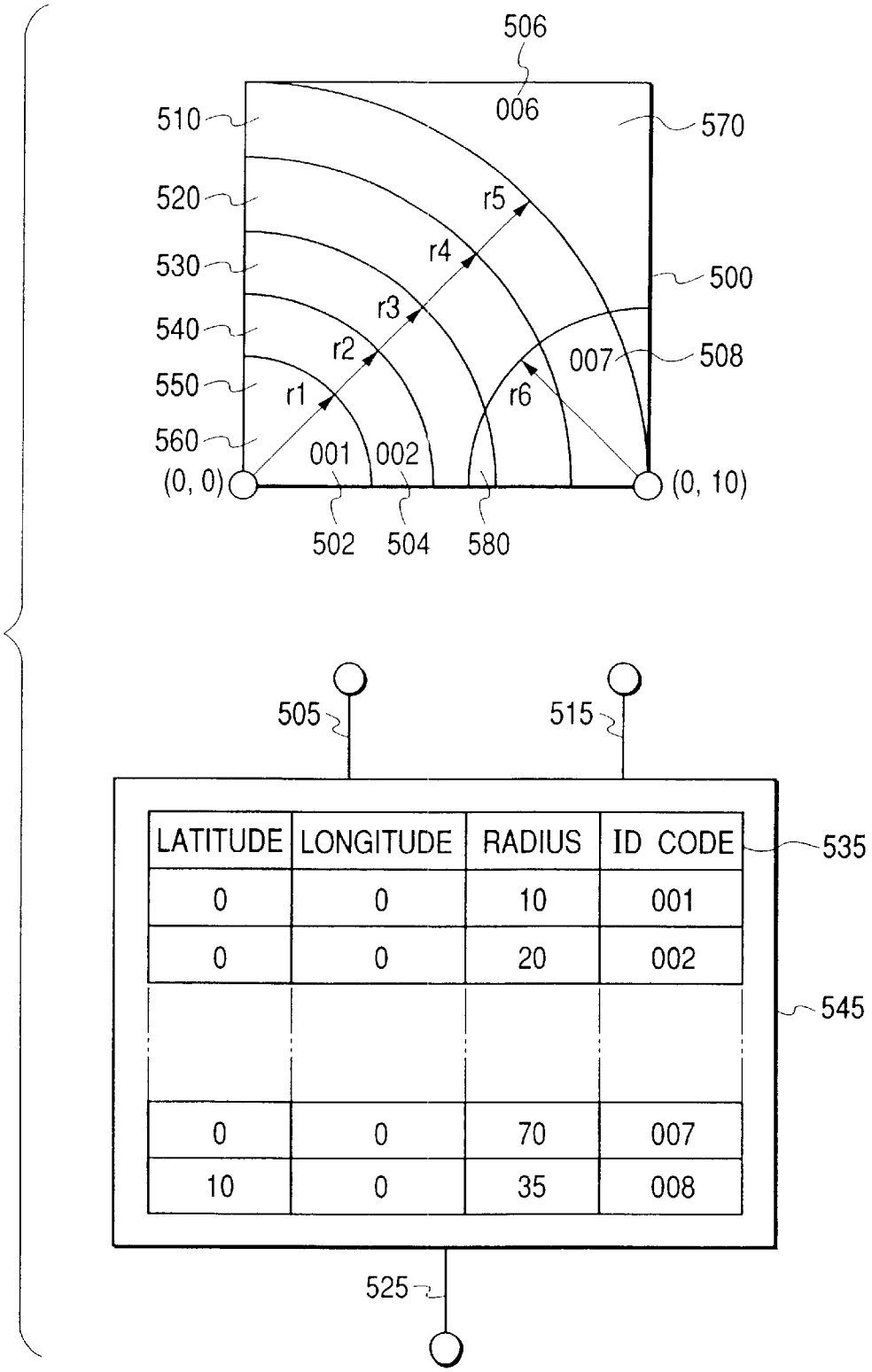
FIG. 5 is an explanatory diagram of range-area data structure based on the present invention.

Methods of linking spot/area information and spot/area specifying information and examples of such linking equipment are shown in FIGS. 4 and 5.

In FIG. 4, numeral 400 denotes the entire range over which the information is to be transmitted, numeral 410 denotes an area code, and numeral 420 denotes the corresponding area.

FIG. 4 assumes that numeral 400 denoting the entire range over which the information is to be transmitted is divided as a rectangular area having "(differential longitude, differential latitude)=(2, 2)".

FIG. 4 also assumes that an area identification code is assigned to each area.

Thus, all areas in range 400 where a certain location having "(latitude X, longitude Y)" is included can be uniquely identified by the respective identification codes.

Also, in FIG. 4, numerals 470, 430, 440, 450, and 460 denote spot/area information—spot/area specifying information linking equipment, an area information input terminal, an identification code input terminal, an output terminal, and a spot/area information—spot/area specifying information linking table, respectively.

The spot/area information and spot/area specifying information mentioned above are linked in the spot/area information—spot/area specifying information linking table.

When the area information "(latitude 1, longitude 1, latitude 2, longitude 2)"is sent to spot/area information—spot/area specifying information linking equipment 470 through area information input terminal 430, the corresponding spot/area specifying information (identification code) within the spot/area information—spot/area specifying information linking table will be searched for and then retrieved through output terminal 450.

When spot/area specifying information (identification code) is received through spot/area specifying information input terminal 440, the corresponding spot/area information "(latitude 1, longitude 1, latitude 2, longitude 2)" within the spot/area information—spot/area specifying information linking table will be searched for and then retrieved through. output terminal 450.

At this time, when the area information "(latitude 1, longitude 1, latitude 2, longitude 2)=(4, 4, 6, 6)" is received through spot/area information input terminal 430, identification code 12 will be retrieved as the corresponding spot/area specifying information through output terminal 450.

Thus, one method of linking spot/area information and spot/area specifying information, and one example of such linking equipment can be realized without any spots or areas being overlapped.

The latitude and longitude used in this example can likewise be expressed as the relative distance in the orthogonal direction from a reference point.

In FIG. 5, numeral 500 denotes the entire range over which the information is to be transmitted, numerals 502, 504, 506, and 508 denote area codes, and numerals 510, 520, 530, 540, 550, 560, 570, and 580 denotes the corresponding areas.

FIG. 4 assumes that each area in the entire range over which the information is to be transmitted exists within certain radial distance of a reference point and that an area identification code is assigned to each area. Thus, all areas in range 400 where a certain location having "(latitude X, longitude Y)" is included can be identified as a plurality of areas maintained in an included relationship.

Also, in FIG. 5, numerals 545, 505, 515, 525, and 535 denote spot/area information—spot/area specifying information linking equipment, a spot/area information input terminal, an identification code input terminal, an output terminal, and a spot/area information—spot/area specifying information linking table, respectively.

The spot/area information and spot/area specifying information mentioned above are linked in the spot/area information—spot/area specifying information linking table.

When area information consisting of "(latitude, —longitude, radius)" is sent to spot/area information—spot/area specifying information linking equipment 545 through spot/area information input terminal 505, all the corresponding-area information (identification codes) within the spot/area information—spot/area specifying information linking table will be searched for and then retrieved through output terminal 525.

When spot/area specifying information (identification code) is received through spot/area specifying information input terminal 515, the corresponding area information "(latitude, longitude, radius)" within the spot/area information—spot/area specifying information linking table will be searched for and then retrieved through output terminal 525.

Thus, another method of linking spot/area information and spot/area specifying information, and another example of such linking equipment can be realized with any spots or areas being overlapped.

The latitude and longitude used in this example can likewise be expressed as the relative distance in the orthogonal direction from a reference point.

Figure 6:
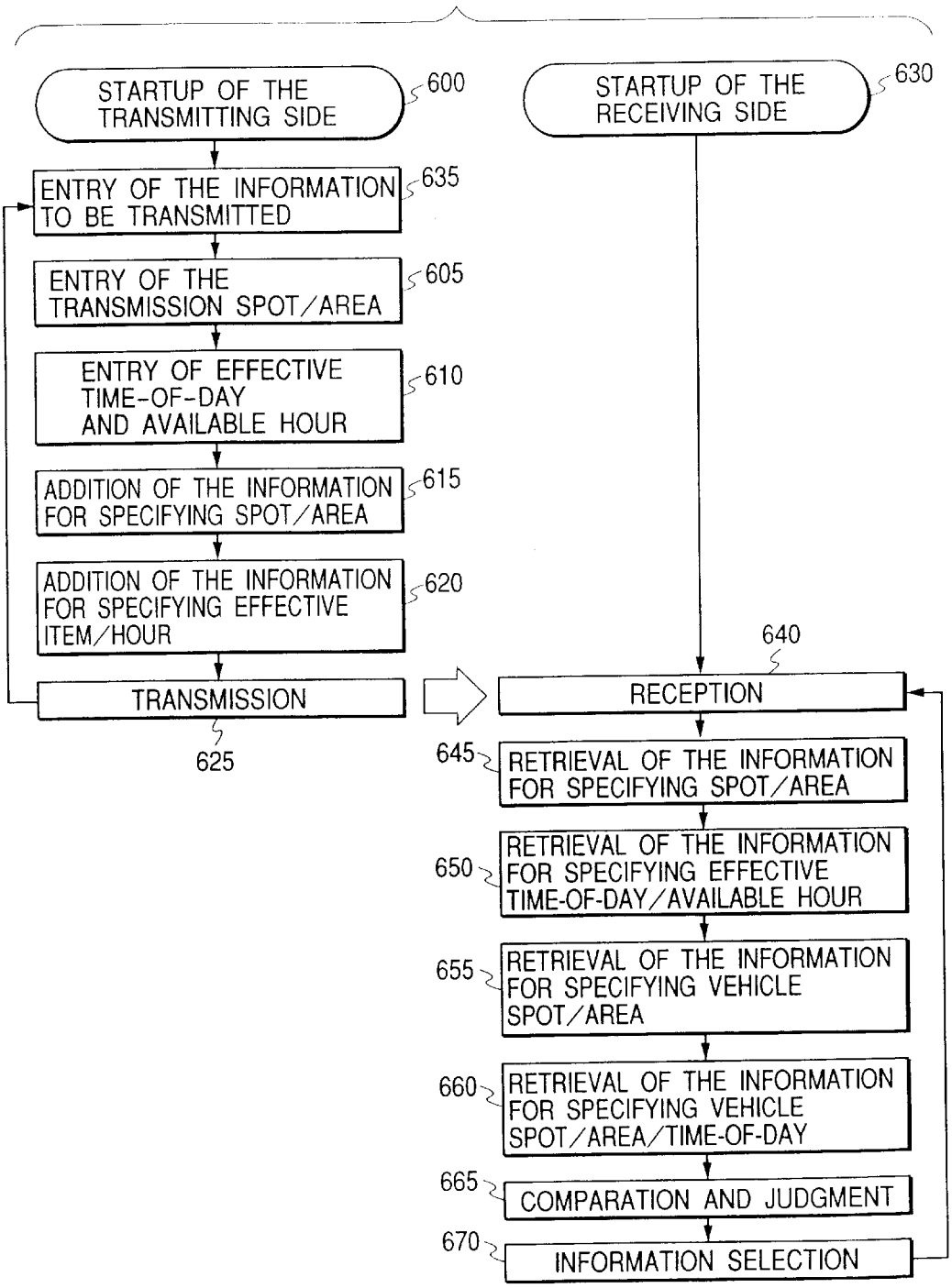
FIG. 6 is a processing flow diagram of the broadcasting method that covers time processing.

The flow of processing in the information broadcasting method (based on the present invention) that takes the available hours of information into account is shown in FIG. 6.

FIG. 6, the processing steps taken at the information-transmitting side are shown as numerals 600, 605, 610, 615, 620, 625, and 635. Similarly, the processing steps taken at the information-receiving side are shown as numerals 630, 640, 645, 650, 655, 660, 665, and 670.

In FIG. 6, numeral 600 denotes the start of processing at the information-transmitting side, numeral 635 denotes the process of entering the information to be broadcast, numeral 605 denotes the process of selecting the spot or area to which the information broadcast is to be transmitted, numeral 610 denotes the process of entering the effective time-of-day/available hours of the information to be broadcast, numeral 615 denotes the process of adding to the information broadcast the information that specifies the spot or area to which the information broadcast is to be transmitted, numeral 620 denotes the process of adding to the information broadcast the information that specifies the effective time-of-day/available hours of the information to be broadcast, and numeral 625 denotes the process of transmitting the information.

Also, in FIG. 6, numeral 630 denotes the start of processing at the information-receiving side, numeral 640 denotes the process of receiving broadcasts, numeral 645 denotes the process of retrieving from received information the transmission destination information (the information specifying the spot or area to which the broadcast information is to be transmitted), numeral 650 denotes the process of retrieving from received information the information that specifies the effective time-of-day/available hours of the information to be broadcast, numeral 655 denotes the process of retrieving the information that specifies the spot or area where the vehicle currently exists or the spots or areas where the intended vehicle is likely to exist in the future, numeral 660 denotes the process of comparing and analyzing the transmission destination information (the information specifying the spot or area to which the broadcast information is to be transmitted), the information specifying either the spot/area where the vehicle currently exists or the spots/areas where the intended vehicle is likely to exist in the future, and the information that specifies the effective time-of-day/available hours of information for either the current spot/area or likely future spots/areas of the vehicle, and numeral 670 denotes the process of selecting only the necessary information from all received information.

In transmission processing that begins with process 600, the information to be broadcast is entered during process 635 first. Subsequently, processes 605, 610, 615, 620, and 625 performed in that order. In process.605, the spot or area to which the information broadcast is to be transmitted is entered; in process 610, information that specifies the effective-of-day/available hours of the information to be broadcast is entered; in process 615, the information specifying the spot or area to which the information broadcast is to be transmitted is added to the information broadcast; in process 620, information that specifies the effective-of-day/available hours of the information to be broadcast is added to the information broadcast, and; in process 625, the information to be broadcast is transmitted. Subsequently, control is returned to process 635, from which the processing sequence is restarted again.

In receive processing that begins with process 630, broadcasts are received during process 640 first. Subsequently, processes 645, 650, 655, 660, 665, and 670 are performed in that order. In process 645, the information specifying the spot or area to which the information broadcast is to be transmitted is retrieved from received information; in process 655, information that specifies either the spot/area where the vehicle currently exists or the spots/areas where the intended vehicle is likely to exist in the future is retrieved; in process 655, information that specifies the spot or area to which the information broadcast is to be transmitted, information that specifies either the spot/area where the vehicle currently exists or the spots/areas where the vehicle is likely to exist in the future, information that specifies the effective-of-day/available hours of information, and information that specifies either the spot/area where the vehicle currently exists or the spots/areas where the vehicle is likely to exist in the future, are compared and analyzed, and; in process 670, information is selected on the basis of the results of process 665 above. Subsequently, control is returned to process 635, from which the processing sequence is restarted again.

In this way, the broadcasting method that takes time into-account, described above as an embodiment of the present invention, can be implemented.

If processing relating to the available hours of information is omitted from the above embodiment, the information broadcasting method shown in FIG. 2 is to be adopted.

Figure 7:
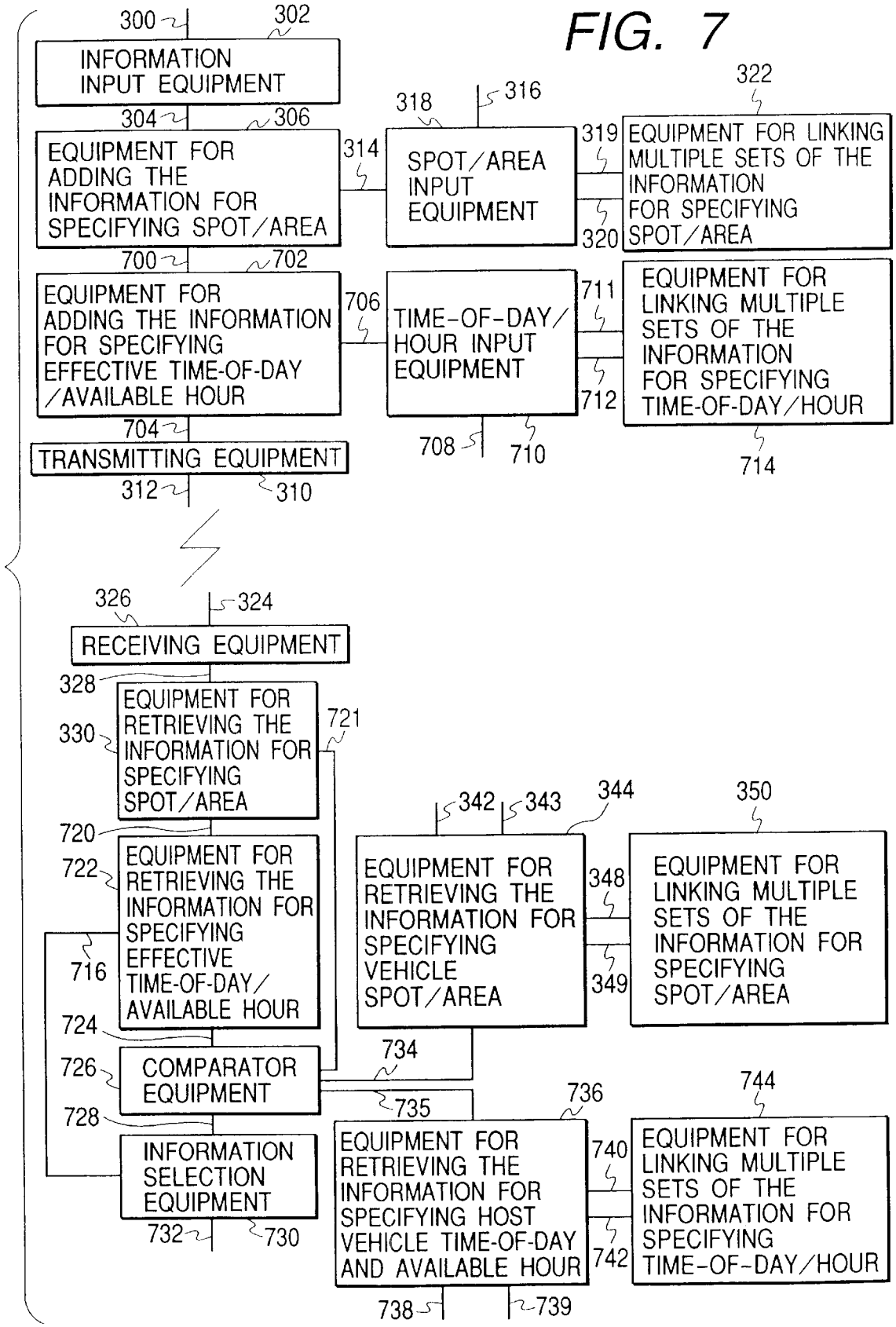
FIG. 7 is a processing flow diagram of the broadcasting hardware system that covers time processing.

A functional block diagram of the information broadcasting hardware system (based on the present invention) that takes time into account, is shown as FIG. 7.

In FIG. 7, numerals 300, 302, 304, 306, 700, 702, 704, 310, 312, 314, 316, 318, 319, 320, 322, 706, 708, 710, 711, 712, and 714 denote the components of the information-transmitting hardware system.

Likewise, numerals 324, 326, 328, 330, 716, 720, 721, 722, 724, 726, 728, 730, 732, 734, 342, 343, 344, 348, 349, 350, 735, 736, 738, 739, 740, 742, and 744 denote the components of the information-receiving hardware system.

In FIG. 7, equipment for entering the information to be broadcast is shown as 302; equipment for adding transmission destination (spot or area) specifying information to the information to be broadcast, as 306; equipment for adding effective-of-day/available hours information to the information to be broadcast, as 702; equipment for transmitting the information, as 310; equipment for entering the spot or area to which the information broadcast is to be transmitted, as 718; equipment for linking the spot/area information and the spot/area specifying information, as 322, and; equipment for linking the effective-of-day/available hours information and the information specifying:this information.

Also, in FIG. 7, the path for entering the information to be broadcast is shown as 300; the path for transmitting the information to be broadcast, as 304; the path for transferring the spot/area specifying information that has been added to the information to be broadcast, as 700; the path for transferring the spot/area specifying information and time-of-day/available-hour specifying information that have been added to the information to be broadcast, as 704; the path for transferring the spot/area specifying information, as 314; the path for entering spots or areas, as 316; the path for transferring the spot/area specifying information, as 320; the path for transferring the time-of-day/available-hour specifying information, as 706; the path for entering the effective time-of-day/available hours of information, as 708; the path for transferring the effective time-of-day/available hours of information, as 711; the path for transferring the effective time-of-day/available-hour specifying information, as 712.

Likewise, in FIG. 7, equipment for receiving broadcasts is shown as 326; equipment for retrieving transmission destination (spot or area) specifying information from received information, as 330; equipment for retrieving from received information the information that specifies the effective time-of-day/available hours of the information to be broadcast, as 722; equipment for retrieving the information that specifies either the spot/area where the vehicle currently exists or the spots/areas where the intended vehicle is likely to exist in the future, as 344; equipment for linking entered spot/area information and spot/area specifying information, as 350; equipment for retrieving the information that specifies the time-of-day/available hours for the current spot or area of the vehicle or for the future likely spots or areas of the vehicle, as 736; equipment for linking the time-of-day/available hours information and the time-of-day/available-hour specifying information, as 744; equipment for comparing and analyzing the transmission destination (spot or area) specifying information, the information that specifies either the spot/area where the vehicle currently exists or the spots/areas where the intended vehicle is likely to exist in the future, the effective time-of-day/available-hour specifying information, and the information that specifies the time of day/available hours for either the spot/area where the vehicle currently exists or the spots/areas where the intended vehicle is likely to exist in the future, as 726, and; equipment for selecting from all received information only the information to be transmitted, as 730.

Furthermore, in FIG. 7, the path for receiving information is shown as 324; the path for displaying selected information, as 340; the paths for transferring received information, as 328 and 716; the path for deleting spot/area specifying information from received information, as 721; the path for transmitting the information that specifies the effective time-of-day/available hours of the information to be broadcast, as 724; the path for transmitting the information that specifies the current spot or area of the vehicle or the likely future spots or areas of the vehicle, as 734; the path for entering the information that specifies the current spot or area of the vehicle, as 342; the path for entering the information that specifies the likely future spots or areas of the vehicle, as 343; the path for transmitting the specified spot/area information, as 348; the path for transmitting the spot/area specifying information, as 349; the path for transmitting the information that specifies the time of day/available hours for the current spot or area of the vehicle or for the likely future spots or areas of the vehicle, as 735; the path for entering the information that specifies the time of day/available hours for the current spot or area of the vehicle, as 738; the path for entering the information that specifies the time of day/available hours for the likely future spots or areas of the vehicle, as 739; the path for transmitting time-of-day/available hours information, as 740; the path for transmitting time-of-day/available-hour specifying information, as 742; the path for transmitting comparative judgment results, as 728; and the path for transferring transmitted information to the required output unit.

Both equipment 702 and equipment 710 are provided with an information processing unit, a data processing unit, an input unit, an output unit, and storage units (such as a RAM, a magnetic tape unit, a magnetic disk unit, and/or an magneto-optic disk).

Equipment 714 has an information processing unit, a data comparative processing unit, an input unit, an output unit, and storage units (such as a RAM, a magnetic tape unit, a magnetic disk unit, and/or an magneto-optic disk).

Equipment 302, equipment 306, equipment 318, equipment 322, equipment 702, equipment 710, equipment 714, and equipment 310 can have the respective processing functions divided by programming to share an "information processing unit".

Equipment 302, equipment 306, equipment 318, equipment 322, equipment 702, equipment 710, equipment 714, and equipment 310 can also have the respective work areas divided to share "storage units".

Both equipment 722 and equipment 736 have an information processing unit, an input unit, an output unit, and storage units (such as a RAM, a magnetic tape unit, a magnetic disk unit, and/or an magneto-optic disk).

Equipment 744, equipment 726, and equipment 730 are each provided with an information processing unit, a data comparative processing unit, an input unit, an output unit, and storage units (such as a RAM, a magnetic tape unit, a magnetic disk unit, and/or an magneto-optic disk).

Equipment 326, equipment 330,equipment 722, equipment 726, equipment 730, equipment 344, equipment 350, equipment 736, and equipment 744 can have the respective processing functions divided by programming to share an "information processing unit".

Equipment 326, equipment 330, equipment 722, equipment 726, equipment 730, equipment 344, equipment 350, equipment 736, and equipment 744 can also have the respective work areas divided to share "storage units".

Equipment 302 receives via path 300 the information broadcast, and transfers the information to equipment 306 via path 304.

Equipment 318 receives transmission destination (spot/area) information via path 316 and transfers the information to equipment 322 via path 319. Equipment 318 also receives via path 320 the spot/area specifying information corresponding to the transmission destination (spot/area) information, and sends the information to equipment 306 via path 314.

Equipment 322, after receiving spot/area information and obtains the linked spot/area specifying information via path 319, sends the information to equipment 318 via path 320.

After receiving the information broadcast and the information that specifies the transmission destination (spot or area), equipment 306 creates the information to be transmitted, by adding the transmission destination (spot/area) specifying information to the information broadcast, and then transfers the information to equipment 700 via path 702.

Equipment 710 receives via path 708 the effective time-of-day/available hours of the information to be broadcast, and transfers the information to equipment 714 via path 711. Equipment 710 also receives via path 712 the linked information specifying the effective time-of-day/available hours of the information to be broadcast, and transfers the information to equipment 702 via path 706.

Equipment 714, after receiving via path 711 the time-of-day/available hours information and obtains the linked information specifying the time-of-day/available hours, sends the information to equipment 710 via path 712.

After receiving the information broadcast, the transmission destination (spot/area) specifying information added hereto, and the information that specifies the effective time-of-day/available hours of the information broadcast, equipment 702 creates the information to be transmitted, by adding to the information broadcast the information that specifies the transmission destination (spot/area) and the information that specifies the effective time-of-day/available hours of the information broadcast, and then transfers the information to equipment 704 via path 310.

After receiving the information broadcast, equipment 310 transmits the information via path 312.

Equipment 326 receives broadcasts via path 324 and transfers the information to equipment 330 via path 328.

Equipment 330, after receiving information, retrieves from the received information the information that specifies the transmission destination (spot/area) information and transfers all the remaining information, except the transmission destination (spot/area) specifying information, to equipment 722 via path 720. Equipment 330 also transfers the transmission destination (spot/area) specifying information to equipment 726 via path 721.

Equipment 722, after receiving the information obtained by deleting the transmission destination (spot/area) specifying information from received information, retrieves the information that specifies the effective time-of-day/available hours of information, and then transfers broadcast information to equipment 726 via path 724.

Equipment 344 receives via path 342 the information relating to the spot or area where the vehicle currently exists, and transfers the information to equipment 350 via path 348. Equipment 344 also receives via path 349 the information that specifies the corresponding spot or area, and transfers the information to equipment 726 via path 734.

In addition, equipment 344 receives via path 343 the information relating to the spots or areas where the vehicle is likely to exist in the future; and transfers the information to equipment 350 via path 348. Furthermore, equipment 344 receives via path 349 the information that specifies the corresponding spots or areas, and transfers the information to equipment 726 via path 734.

Equipment 350 receives spot/area information via path 348, then obtains the information specifying the corresponding spot(s) or area(s), and transfers the information to equipment 736 via path 349.

Equipment 736 receives via path 738 the time-of-day/available hours information corresponding to the spot or area where the vehicle currently exists, and transfers the information to equipment 744 via path 740. Equipment 736 also receives via path 742 the information that specifies the corresponding time-of-day/available hours, and transfers the information to equipment 726 via path 735.

Equipment 736 receives via path 739 the time-of-day/available hours information corresponding to the spots or areas where the vehicle is likely to exist in the future, and transfers the information to equipment 744 via path 740. Equipment 736 also receives via path 742 the information that specifies the-corresponding time of day, available hours, and/or area, and transfers the information-to equipment 726 via path 734.

Equipment 744 receives time-of-day/available hour information via path 740, then obtains the information specifying the corresponding time-of-day-/available hours, and transfers the information to equipment 736 via path After receiving the information that specifies the spot(s) or area(s), the information that specifies the spot or area where the vehicle currently exists or the spots or areas where the intended vehicle is likely to exist in the future, and the time-of-day/available hours information corresponding to the spot/area where vehicle currently exists or the spots/areas where the vehicle is likely to exist in the future, equipment 726 performs comparative judgments on all these types of information and sends the results to equipment 730 via path 728.

After receiving all broadcast information and the comparative judgment result information, equipment 730 displays only the appropriate broadcast information according to the particular results of the comparative judgment, via path 732.

Suppose that:

The information to be broadcast is character string information denoting "oo?XX traffic regulation".

The entire area over which the information is to be transmitted is a rectangular area with its diagonal vertex set to "(latitude, longitude)=(0, 0) (10, 10)".

The entire area range over which the information is to be transmitted is segmented into rectangular areas each having "(differential longitude, differential latitude) =(2, 2)".

Also, suppose that the information specifying each area is numeric character information represented as follows:

Rectangular area with its diagonal vertex set to "(latitude, longitude)=(0, 0) (2, 2)" . . . "0"

Rectangular area with its diagonal vertex set to "(latitude, longitude)=(0, 2) (2, 4)" . . . "1"

Rectangular area with its diagonal vertex set to "(latitude, longitude)=(0, 4) (2, 6)" . . . "2"

Rectangular area with its diagonal vertex set to "(latitude, longitude)=(0, 6) (2, 8)" . . . "3"

Rectangular area with its diagonal vertex set to "(latitude, longitude)=(0, 8) (2, 10)" . . . "4"

Rectangular area with its diagonal vertex set to "(latitude, longitude)=(2, 0) (4, 2)" . . . "5"

Rectangular area with its diagonal vertex set to "(latitude, longitude)=(2, 2) (4, 4)" . . . "6"

Rectangular area with its diagonal vertex set to "(latitude, longitude)=(2, 4) (4, 6)" . . . "7"

Rectangular area with its diagonal vertex set to "(latitude, longitude)=(2, 6) (4, 8)" . . . "8"

Rectangular area with its diagonal vertex set to "(latitude, longitude)=(2, 8) (4, 10)" . . . "9"

Rectangular area with its diagonal vertex set to "(latitude, longitude)=(4, 0) (6, 2)" . . . "10"

Rectangular area with its diagonal vertex set to "(latitude, longitude)=(4, 2) (6, 4)" . . . "11"

Rectangular area with its diagonal vertex set to "(latitude, longitude)=(4, 4) (6, 6)" . . . "12"

Rectangular area with its diagonal vertex set to "(latitude, longitude)=(4, 6) (6, 8)" . . . "13"

Rectangular area with its diagonal vertex set to "(latitude, longitude)=(4, 8) (6, 10)" . . . "14"

Rectangular area with its diagonal vertex set to "(latitude, longitude)=(6, 0) (8, 2)" . . . "15"

Rectangular area with its diagonal vertex set to "(latitude, longitude)=(6, 2) (8, 4)" . . . "16"

Rectangular area with its diagonal vertex set to "(latitude, longitude)=(6, 4) (8, 6)" . . . "17"

Rectangular area with its diagonal vertex set to "(latitude, longitude)=(6, 6) (8, 8)" . . . "18"

Rectangular area with its diagonal vertex set to "(latitude, longitude)=(6, 8) (8, 10)" . . . "19"

Rectangular area with its diagonal vertex set to "(latitude, longitude)=(8, 0) (10, 2)" . . . "20"

Rectangular area with its diagonal vertex set to "(latitude, longitude)=(8, 2) (10, 4)" . . . "21"

Rectangular area with its diagonal vertex set to "(latitude, longitude)=(8, 4) (10, 6)" . . . "22"

Rectangular area with its diagonal vertex set to "(latitude, longitude)=(8, 6) (10, 8)" . . . "23"

Rectangular area with its diagonal vertex set to "(latitude, longitude)=(8, 8) (10, 10)" . . . "24"

In addition, suppose that:

The area to which the information broadcast is to be transmitted is a rectangular area with its diagonal vertex set to "(latitude, longitude)=(4, 4) (6, 6)".

The available hours of the information to be broadcast is "(start, end)=(10:00, 11:00)".

The location where the vehicle currently exists is represented as "(latitude, longitude, time of day)=(1, 1, 09:00)".

The locations where the vehicle will exist in the future are planned as "(latitude, longitude, time of day) =(3, 3, 09:30) (5, 5, 10:00) (7, 7, 10:30)".

The information to be broadcast, namely, "oo?XX traffic regulation" is then be assigned to equipment 302 via path 300.

The character string information denoting "oo?XX traffic regulation" is transferred from equipment 302 to equipment 306 via path 304.

The broadcast destination area information "rectangular area with its diagonal vertex set to "(latitude, longitude)=(4, 4) (6, 6)" is entered into equipment 318 via path 316.

The broadcast destination area information "rectangular area with its diagonal vertex set to "(latitude, longitude)=(4, 4) (6, 6)" is transferred from equipment 318 to equipment 322 via path 319.

After receiving the broadcast destination area information "rectangular area with its diagonal vertex set to "(latitude, longitude)=(4, 4) (6, 6)", equipment 322 obtains "12" as the numeric character information specifying the corresponding area, and transfers the information to equipment 318 via path 320.

After receiving the numeric character information "12", equipment 318 transfers the information to equipment 306 via path 314.

Equipment 306 adds numeric character information "12" to the character string information "oo?XX traffic regulation" by inserting the delimiter identifier "+" between both, and transfers the resulting "oo?XX traffic regulation +12" information to equipment 702 via path 700.

Meanwhile, "10:00? 11:00", which is character string information denoting the available hours of the information to be broadcast, is entered into equipment 710 via path 708.

Equipment 710 transfers "10:00? 11:00", which is character string information denoting the available hours of the information to be broadcast, to equipment 714 via path 711.

After receiving "10:00? 11:00" that is the character string information denoting the available hours of the information to be broadcast, equipment 714 obtains the information that specifies the corresponding time of day, and then sends the numeric character information "10001100" to equipment 710 via path 712.

Equipment 702 adds numeric character information "1001100" to the character string information "oo?XX traffic regulation +12" by inserting the delimiter identifier "@" between both, and transfers the resulting "oo?XX traffic regulation +12@1001100" information to equipment 316 via path 704.

After receiving the character string information "oo?XX traffic regulation +12@1001100", equipment 310 transmits the information via path 312.

Meanwhile, equipment 326 receives the character string information "oo?XX traffic regulation +12@1001100" via path 324 and transfers the information to equipment 330 via path 328.

After receiving the character string information " oo?XX traffic regulation +12@1001100", equipment 330 identifies the "+" and "@" delimiter identifiers, then remove "12", which is information that was added to specify the spot or area to which the broadcast information is to be transmitted, and sends the remaining information to equipment 726 via path 721.

Equipment 330 also sends the character string information "oo?XX traffic regulation@10001100", which is information left after the transmission destination area specifying information "12" has been deleted, to equipment 722 via path 720.

After-receiving the character string information "oo?XX traffic regulation@10001100", equipment 330 identifies the "@" delimiter identifier, then removes "10001100", which is information that was added to specify the available hours of information, and sends the remaining information to equipment 726 via path 724.

Equipment 722 also sends the character string information "oo?XX traffic regulation", which is information left after the available-hour specifying information "10001100" has been deleted, to equipment 730 via path 716.

Meanwhile, the information "(latitude, longitude)=(1, 1)"that denotes the current location of the vehicle is entered into equipment 344 via path 342.

Also, the information "(latitude, longitude)=(3, 3) (5, 5) (7, 7)" that denotes the locations to which the vehicle is scheduled to move in the future is entered into equipment 344 via path 343.

After receiving the information that denotes the current location of the vehicle and the information that denotes the locations to which the vehicle is scheduled to move in the future, equipment 344 derives the areas corresponding to the current and future-locations, and sends the following area information to equipment 350 via path 348:

Rectangular area with its diagonal vertex set to "(latitude, longitude)=(0, 0) (2, 2)"

Rectangular area with its diagonal vertex set to "(latitude, longitude)=(2, 2) (4, 4)"

Rectangular area with its diagonal vertex set to "(latitude, longitude)=(4, 4) (6, 6)"

Rectangular area with its diagonal vertex set to "(latitude, longitude)=(6, 6) (8, 8)"

Equipment 350, after receiving the area information shown above, acquires the information specifying the corresponding-areas, and sends the following codes in-area-linked form to equipment 344 via path 349:

"0"
"6"
"12"
"18"

After receiving both the information "0" that specifies the area where the vehicle currently exists, and. the codes "6", "12", and "18" that specify the areas where the vehicle is likely to exist in the future, equipment 344 sends both types of information to equipment 334 via path 346.

Meanwhile, the information "(latitude, longitude, time of day)=(1, 1, 09:00)"that denotes the time at the current location of the vehicle is entered into equipment 736 via path 738.

Also, the information "(latitude, longitude, time of day)=(3, 3, 09:30) (5, 5, 10:00) (7, 7, 10:30)" that denotes the time at the likely future locations of the vehicle is entered into equipment 736 via path 739.

Equipment 736 derives, from the information that denotes the time at the current and likely future locations of the vehicle, the information that specifies the corresponding time, and then transfers the information to equipment 736 via path 742, as follows:

"09000900"
"09300930"
"10001000"
"10301030"

Equipment 736, after receiving the information that specifies the current area of the vehicle, the information that specifies the likely future areas of the vehicle, the information that specifies the time at the current area of the vehicle, and the information that specifies the time at the likely future areas of the vehicle, transfers these types of information to equipment 726 via path 734, as follows:

(area specifying information, time specifying information)=("0", "09000900"), ("6", "09300930"), ("12", "10001000"), ("18", "103010030")

After receiving the broadcast destination area specifying information and the available-hour specifying information ("12", "10001100"), the vehicle's current area specifying information and time-of-day specifying information ("0", "09000900"), the vehicle's likely future area specifying information and time-of-day specifying information ("6", "09300930"), ("12", "10001000"), ("18", "10301030"), equipment 726 compares these types of information, then judges that since part of the information specifying the areas where the vehicle is likely to exist in the future matches the information: specifying the broadcast destination area and the available hours, the corresponding information is to be selected from all the received information, and sends the results to equipment 730 via path 728.

Equipment 730, after receiving the broadcast information "oo?XX traffic regulation" and the comparative judgment results, sends the broadcast information "oo?XX. traffic regulation" to the required output unit via path 732.

Thus, the information selecting equipment, based on the present invention, that takes the time of day into account, can be configured.

The likely future locations and time of the information-receiving vehicle, set forth in this embodiment of the present invention, can likewise be set using the trip predicting information presented by a navigation system function such as a route search function. In this case, it is possible to configure equipment that selects information according to the particular trip status of the driver and taking time into account.

Figure 8:
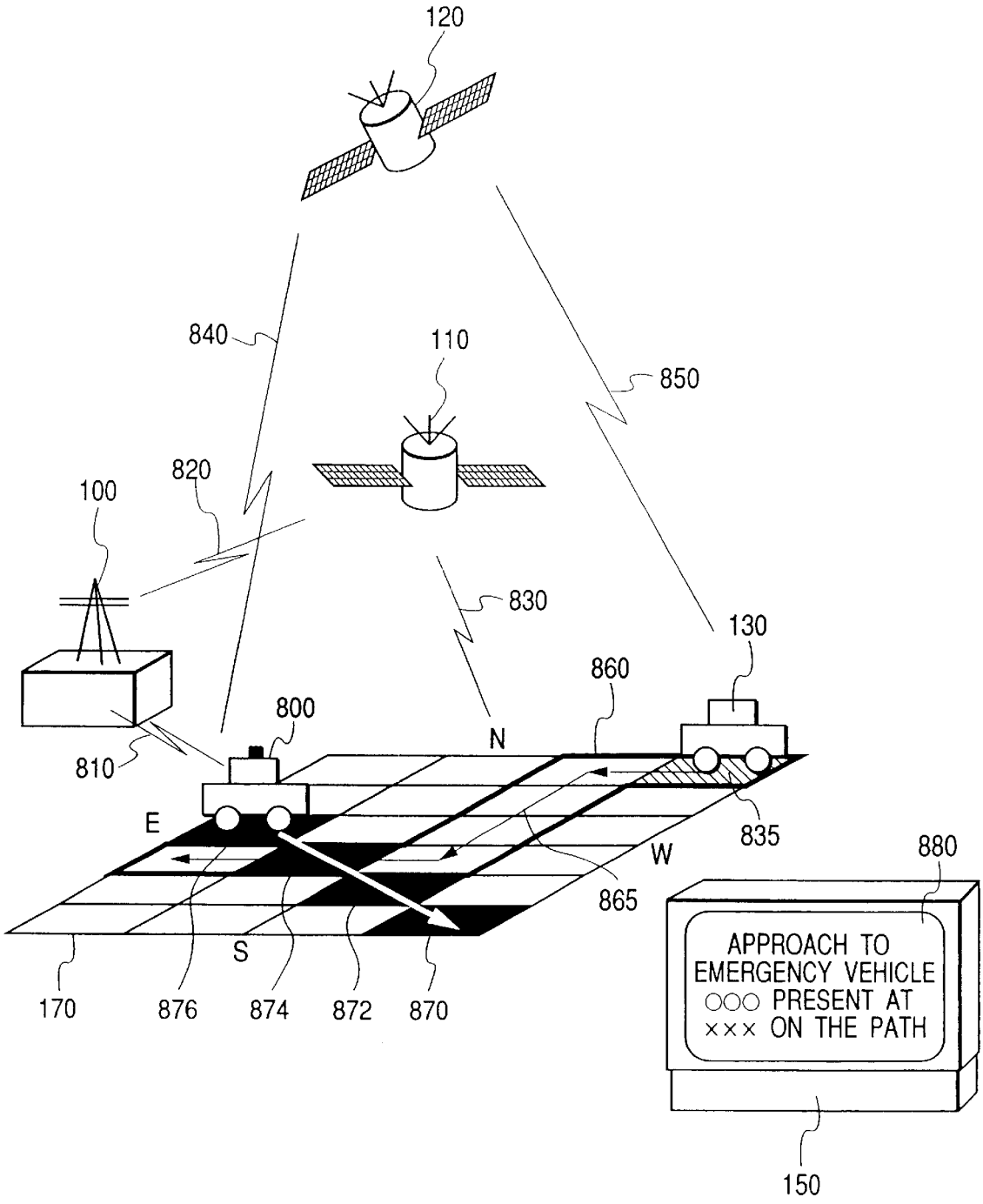
FIG. 8 is an explanatory diagram of an approaching mobile body information transmission system based on the present invention.
Figure 9:
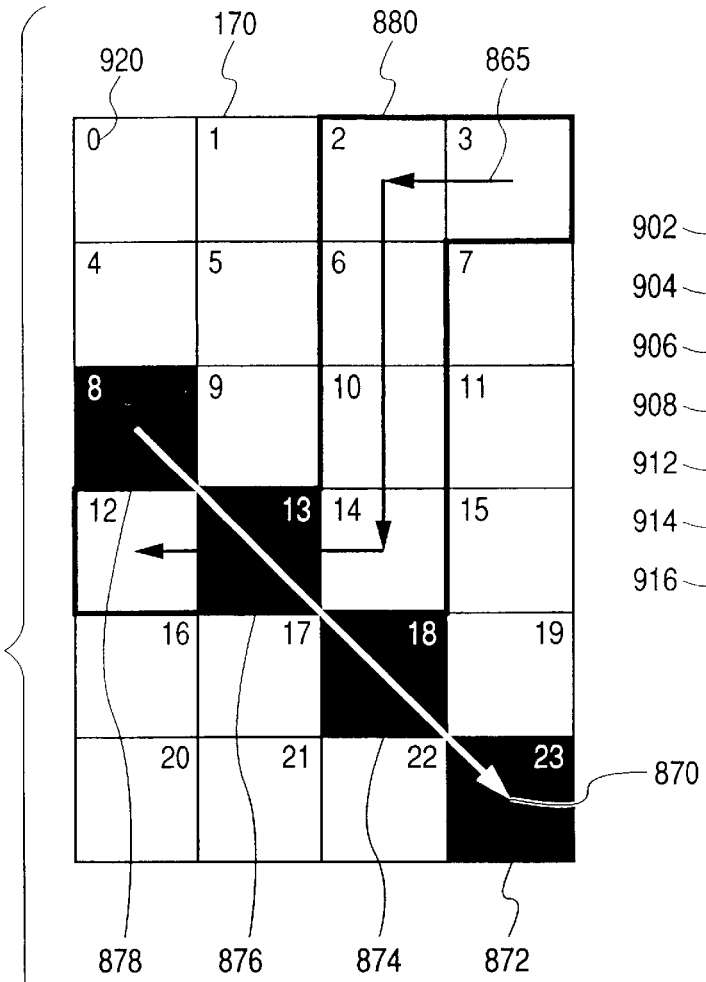
FIG. 9 is an explanatory diagram of the area and available hour assignments in the approaching mobile body information transmission system.

Explanatory diagrams of an approaching mobile body information transmission system based on the present invention are shown as FIGS. 8 and 9.

In FIG. 8, numeral 150 denotes a car navigation system having receiving equipment based on the present invention.

In FIG. 8, numerals 100, 110, 120, and 130 denote a broadcasting station, a digital radio communications satellite, a GPS satellite, and a vehicle, respectively.

Also, in FIG. 8, numeral 800 denotes the emergency vehicle to which the information is to be transmitted, and numeral 880 denotes the display of information at the terminal of car navigation system 150.

Likewise, numeral 820 denotes a satellite broadcast transmission signal from broadcasting station 100, numeral 830 denotes a satellite broadcasting signal from digital radio broadcasting satellite 110, numerals 840 and 850 denote location confirmation signals from global positioning system (GPS) satellite 120, numeral 170 denotes the entire spot/area range over which the information is to be transmitted, numeral 865 denotes the traveling route of vehicle 130, numeral 860 denotes the area corresponding to traveling route 865 of vehicle 130 in the broadcasting range 170 of the digital radio broadcasting satellite, numerals 870, 872, 874, and 876 denote the areas to which the information is to be transmitted, and numeral 810 denotes the terrestrial communications signal sent from emergency vehicle 800 to broadcasting station 100.

Assume that car navigation system 150 is mounted in vehicle 130 and performs location detection, route search, and information presentation functions.

A plan view of the range, areas, and paths, is shown as FIG. 9.

In FIG. 9, numeral 900 denotes the area/time linking table for the travel of vehicle 130, and numeral 900 denotes the table of linking the information specifying the information transmission destination areas and the information specifying the available hours of information.

In FIG. 9, numerals 902, 904, 906, 908, 912, 914, and 916 denote the information that specifies the areas on the traveling route of vehicle 130.

In FIG. 9, numerals 901, 903, 905, 907, 909, 911, and 913 denote the information that specifies the time of day on the traveling route of vehicle. 130.

FIGS. 8 and 9 assume that entire transmission range 170 is segmented into smaller areas.

FIGS. 8 and 9 also assume that the same information relating to the segmentation of the area range is stored in both broadcasting station 100 and car navigation system 150.

In addition, FIGS. 8 and 9 assume that the information is to be transmitted to areas 870, 872, 874, and 876.

Furthermore, FIGS. 8 and 9 assume that vehicle 130 moves within the range of area 860 that includes traveling route 865.

Also, FIGS. 8 and 9 assume that car navigation system 150 is capable of identifying the location of vehicle 130, receiving satellite broadcast signal 830, and presenting information.

Broadcasting station 100 has the capabilities to: obtain traveling route information on emergency-vehicle 800; derive areas 870, 872, 874, and 876, as the corresponding areas; pick "Emergency vehicle approaching" as the information to be broadcast, and area specifying information 930, area specifying information 940, area specifying information 950, and area specifying information 960, as the information that specifies the transmission destination areas; pick a certain range of time existing before and after the estimated time of arrival at each area (namely, time 935, time 945, time 955, and time 965) as the available hours of the information to be transmitted; add area specifying information and time/available-hour specifying information to the information to be broadcast; and send the information to digital radio broadcasting satellite 110.

Digital radio broadcasting satellite 110 that has received satellite broadcast transmission signal 820 converts the signal into satellite broadcast signal 830 and transfers this signal.

Car navigation system 150 receives location confirmation signal 850 from GPS satellite 120 and identifies the location of vehicle 130.

Car navigation system 150 also identifies area 835 as the area in entire transmission destination area range 170 where vehicle 130 exists.

In addition, car navigation system 150 retrieves from internally stored traveling route 865, which has been entered by the driver beforehand or obtained using the route search function of the navigation system: area specifying information 902, area specifying information 904, area specifying information 906, area specifying information 908, area specifying information 912, area specifying information 914, area specifying information 916, estimated-arrival time specifying information 901, time specifying information 901, time specifying information 901, time specifying information 903, time specifying information 905, time specifying information 907, time specifying information 909, time specifying information 911, time specifying information 913, and time specifying information 915.

Furthermore, car navigation system 150 receives satellite broadcast signal 830 and retrieves the information that has been broadcast, the information specifying the transmission destination areas, and the information specifying the available hours of the broadcast information.

In this embodiment of the present invention, area specifying information 930, area specifying information 940, area specifying information 950, and area specifying information 960 are retrieved as the information that specifies the transmission destination areas.

Also, information 935, information 945, information 955, and information 965 are retrieved as the information that specifies the time corresponding to each area mentioned above.

Car navigation system 150 compares the relationship between the information that specifies the current area 835 of the vehicle and the area 860 corresponding to the traveling route (namely, area specifying information 902, area specifying information 904, area specifying information 906, area specifying information 908, area specifying information 912, area specifying information 914, and area specifying information 916) and the information that has been retrieved from received information (namely, area specifying information 930, area specifying information 940, area specifying information 950, and area specifying information 960). Car navigation system 150 also compares the relationship between the information that specifies the available hours of the retrieved information (namely, time specifying information 935, time specifying information 945, time specifying information 955, and time specifying information 965), information 902, which denotes the time of day in the current area of the vehicle, and information 904, 906, 908, 912, 914, and 916, which denotes the time of day in each likely future area of the vehicle.

At this time, since in the area 860 corresponding to the traveling route, the time "10:25" the vehicle 130 exists is included in the available hours information 940 (area "131", time "10:22?10:27"), car navigation system 150 selects broadcast information "Emergency vehicle approaching" included in transferred signal 830.

Thus, car navigation system 150 presents display 880.

It is thus possible to implement a system that uses broadcast communications to select information according to the particular relative position with respect to a mobile body and transmit the information.

In this embodiment of the present invention, emergency vehicle 800 can likewise use GPS satellite 120 to: detect the position of the vehicle itself, send this information to broadcasting station 100 through terrestrial or satellite communications, and determine/transmit the appropriate transmission destination spot/area and effective time-of-day/available hours of information according to the moving status of the emergency vehicle itself.

The determination of a transmission destination spot/area and effective time-of-day/available hours of information, based on the real-time location information relating to emergency vehicle 800, is possible in that case.

Figure 10:
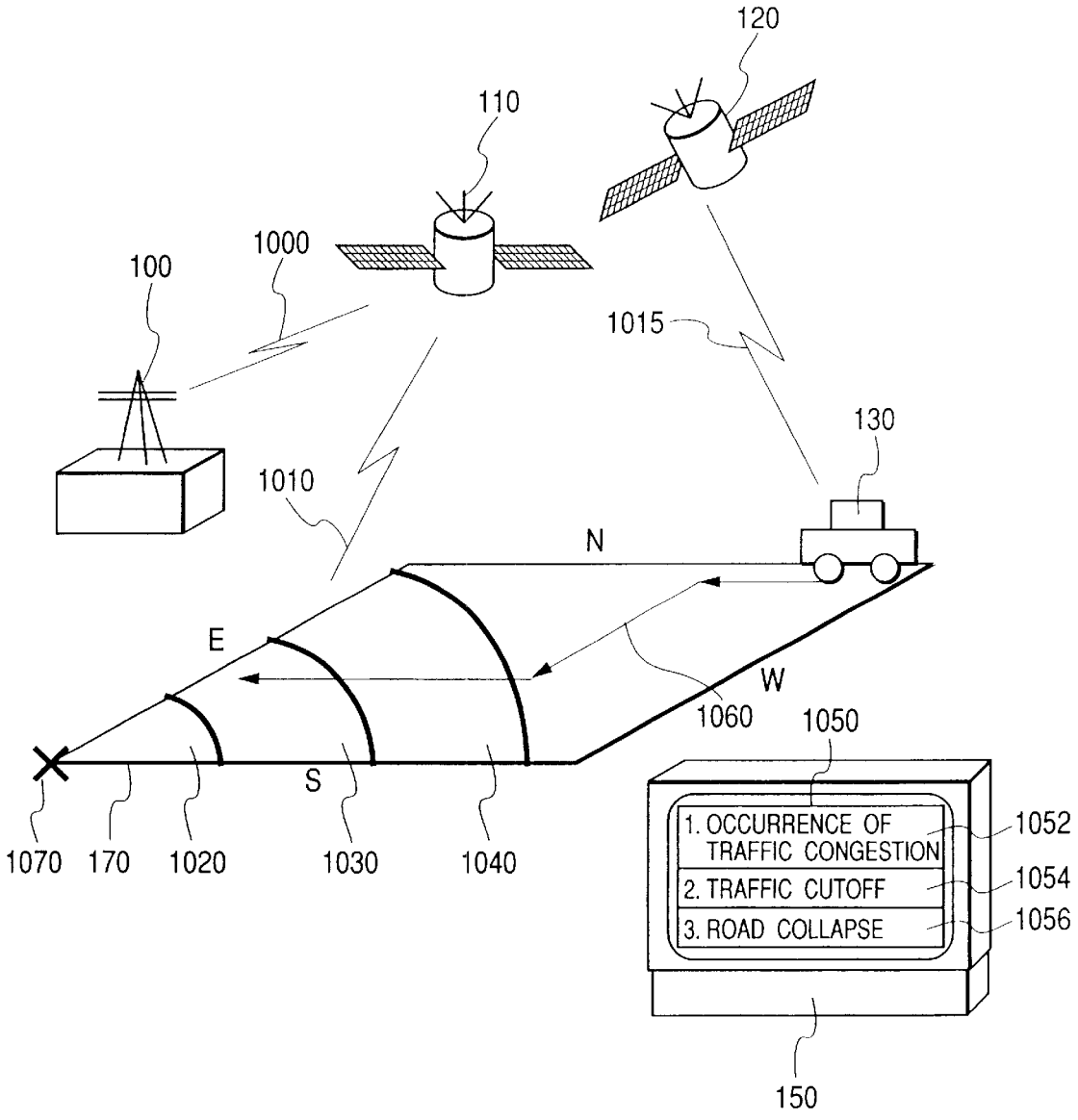
FIG. 10 is an explanatory diagram of a range-of-influence information transmission system based on the present invention.

An explanatory diagram of a range-of-influence information transmission system based on the present invention is shown as FIG. 10.

In FIG. 10, numeral 150 denotes a car navigation system having receiving equipment based on the present invention Also, numeral 1070 denotes the spot where an emergency occurred.

In addition, in FIG. 10, numeral 1050 denotes the information display presented by the car navigation system, and numerals 1052, 1054, and 1056 denote the information items that constitute information display 150.

Furthermore, in FIG. 10, numerals 100, 110, 120, and 130 denote a broadcasting station, a digital radio communications satellite, a GPS satellite, and a vehicle, respectively.

Also, numeral 1000 denotes a satellite broadcast transmission signal from broadcasting station 100, numeral 1010 denotes a satellite broadcasting signal from digital radio broadcasting satellite 110, numerals 1015 denotes a location confirmation signal from GPS satellite 120, numeral 170 denotes the entire spot/area range over which the information is to be transmitted, numeral 1060 denotes the traveling route of vehicle 130, and numerals 1020, 1030, and 1040 denote the areas to which the information is to be transmitted.

Assume that car navigation system 150 is mounted in vehicle 130 and performs location detection, route search, and information presentation functions.

Also, assume that vehicle 130 moves along route 1080.

In addition, assume that an emergency occurred at spot 1070 and that "Road collapsed", "Traffic cut off", and "Congested" are broadcast as related event information.

At this time, the area 1020 corresponding to the range of influence of the event "Road collapsed", the area. 1030 corresponding to the range of influence of the event "Traffic cut off", and the area 1040 corresponding to the range of influence of the event "Congested" are obtained and the range of influence of each event is taken as the transmission range of the corresponding information.

At broadcasting station 100, information on each event is obtained first. Next, "Road collapsed", "Traffic cut off", and "Congested" are set as the information to be broadcast, and areas 1020, 1030, and 1040 are set as the broadcasting destination areas. After this, the duration of each event is set as the available hours of information, then the information specifying each area and the information-specifying the available hours of each set of information are added to the information to be broadcast, and satellite broadcast transmission signal 1010 is sent to digital radio broadcasting satellite 110.

Digital radio broadcasting satellite 110 that has received satellite broadcast transmission signal 1000 converts the signal into satellite broadcast signal 1010 and transfers this signal.

Car navigation system 150 receives location confirmation signal 1015 from GPS satellite 120 and identifies the location of vehicle 130.

Car navigation system 150 also identifies traveling route 1080, which has been entered by the driver beforehand or obtained using the route search function of the navigation system. After that, the navigation system identifies the estimated time of arrival at the spot on the route.

In addition, car navigation system 150 receives satellite broadcast signal 1010 and retrieves the information that has been broadcast, the information specifying the transmission destination areas, and the information specifying the available hours of the broadcast information.

In this embodiment of the present invention, information that specifies areas 1020, 1030, and 1040, is retrieved.

Also, information that specifies the durations of the "events Road collapsed", "Traffic cut off", and "Congested", is retrieved.

Car navigation system 150 compares the relationship between the information specifying the area of the traveling route 1080 of vehicle 130, the information specifying the area 1020 that has been retrieved from received information, information that specifies area 1030, and information that specifies area 1040, and the relationship between the information specifying the time of day on the traveling route 1080 of vehicle 130, and the event duration specifying information that has been retrieved from received information.

At this time, the time of day on the traveling route 1080 of vehicle 130 is included in the duration of each event.

Also, areas are prioritized in order of the rate of inclusion of the information relating to traveling route 1060 and the corresponding information is selected in that order.

In this case, areas 1040, 1030, and 1020 are prioritized, in that order, in terms of the rate of the information relating to traveling route 1060. "Road collapsed", "Traffic cut off", and "Congested" correspondingly take higher priority, in that order, as the event information.

Accordingly, car navigation system 150 presents information items 1052, 1054, and 1056, in that order, as information display 1050.

It is thus possible to implement a system that uses broadcast communications to select information according to the particular influence range of an event and transmit the information.

Figure 11:
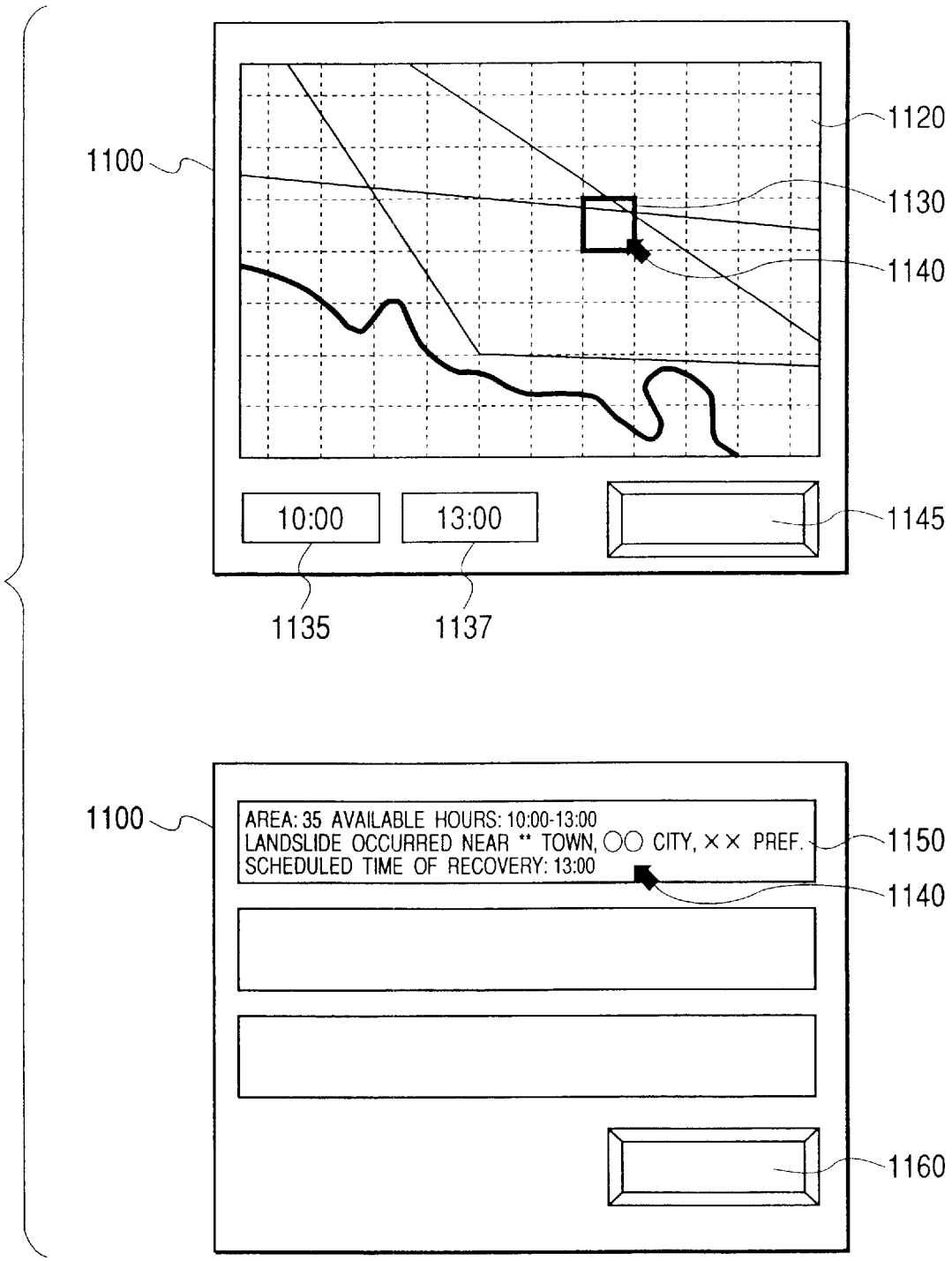
FIG. 11 is an explanatory diagram of the display formats of a transmitting hardware system based on the present invention.
Figure 14:
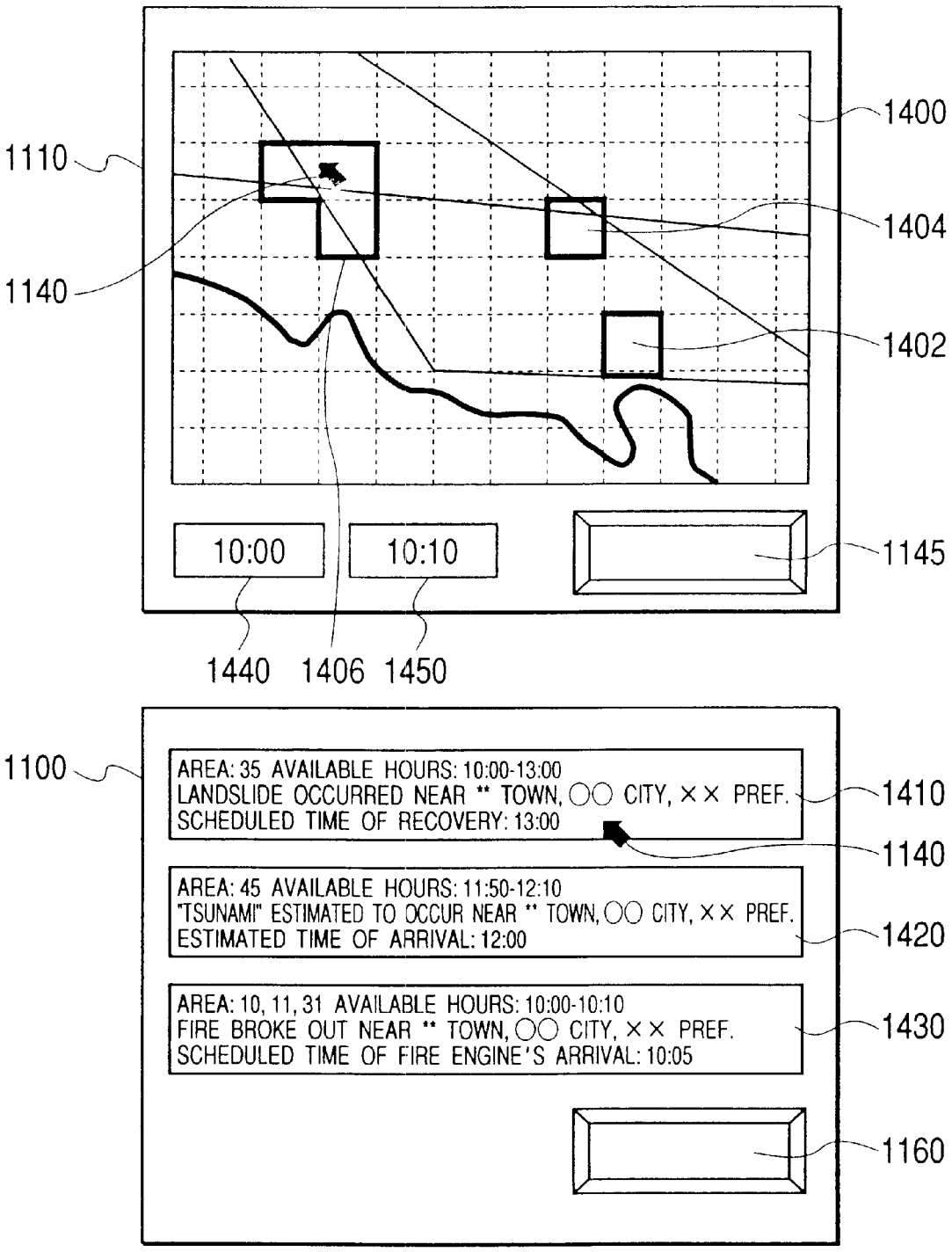
FIG. 14 is an explanatory diagram of the transmitting hardware system display formats applied when multiple sets of information is selected.
Figure 16:
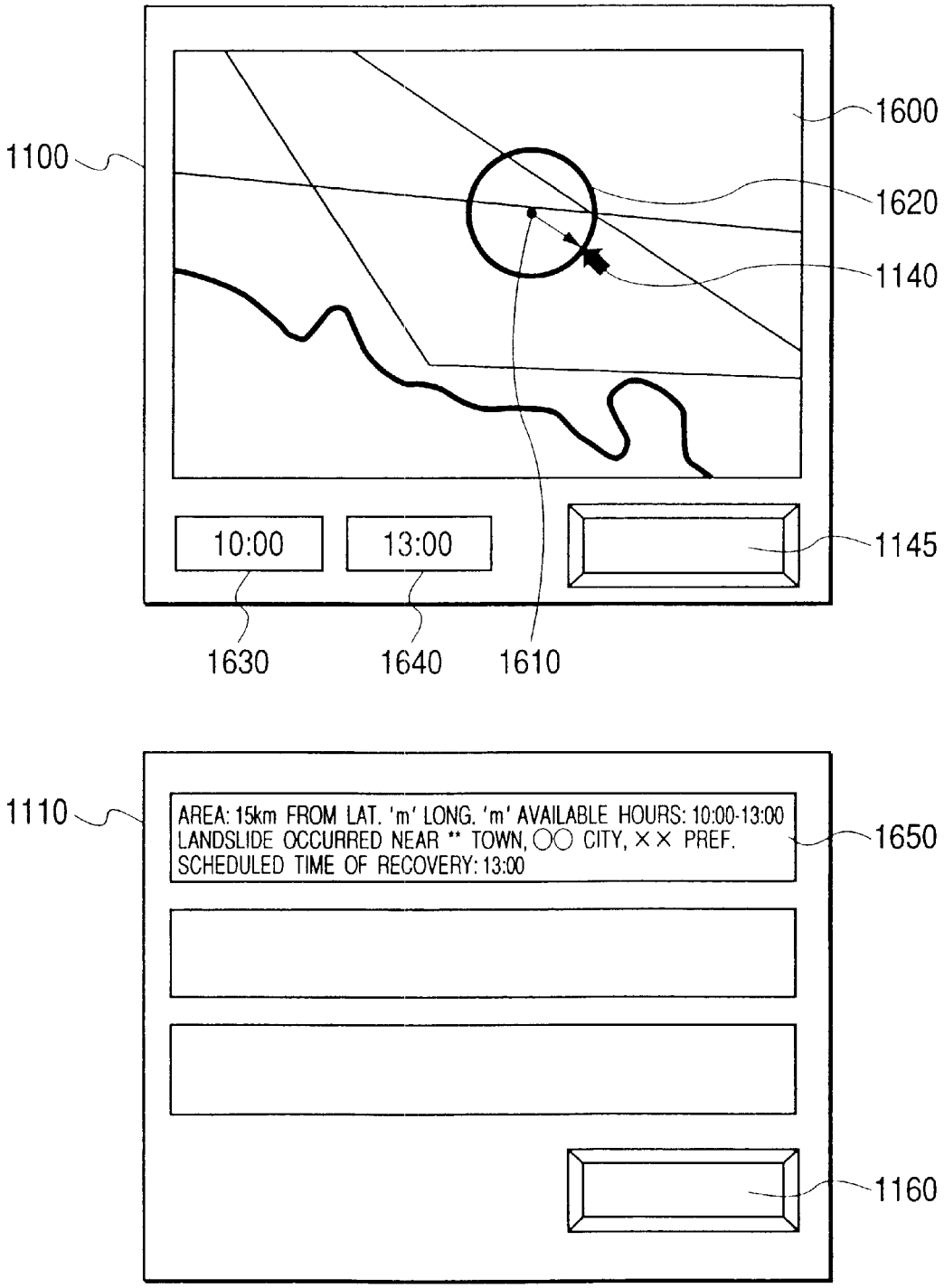
FIG. 16 is an explanatory diagram of the transmitting hardware system display formats applied when areas are specified by spots and distances.

Explanatory diagrams of the displays made in the operating and display modes of the transmitting and receiving hardware systems that can be implemented per the present invention are shown as FIGS. 11, 14, and 16.

In this embodiment of the present invention, the transmitting equipment shown in FIG. 3 is equipped with connected display and input units to enable various information to be entered and displayed.

In FIG. 11, numeral 1100 denotes the screen display for selecting information transmission destination spots or areas, and numeral 1110 denotes the screen display for entering the information to be broadcast.

In FIG. 11, numeral 1120 denotes the map display corresponding to the entire range of information transmission destination spots or areas, numeral 1130 denotes spot/area selection display, numeral 1135 denotes the display area for entering the starting time of available hours, numeral 1137 denotes the display area for entering the ending time of available hours, numeral 1140 denotes a spot/area selection indicator, numeral 1150 denotes details of the information to be broadcast, and numerals 1145 and 1160 denote entry completion buttons.

The entire range of information transmission destinations is divided into smaller areas in lateral and longitudinal directions, and the map display 1120 corresponding to the entire range of information transmission destination spots or areas has plotting line marks keyed to the area boundaries.

Area selection display 1130 can be made by selecting the plotting-line display within map display 1120.

Also, display area 1135 for entering the starting time of available hours of information, and display area 1137 for entering the ending time of available hours of the information appear when the starting time and ending time of available hours of the corresponding information are entered.

Subsequent selection of entry completion button 1145 completes the selection of the information transmission destination area and changes the display mode from screen display 1100 to screen display 1110.

On screen display 1110, information 1150 is entered as the information to be broadcast to the selected area.

Subsequent selection of entry completion button 1160 by the movement of area selection indicator 1140 to this button completes entry of the information to be broadcast, and returns the display mode from screen display 1110 to screen display 1100 again.

It is thus possible to enter and display information using the transmitting equipment set forth in the present invention.

In FIG. 14, numeral 1100 denotes the screen display for selecting information transmission destination areas, and numeral 1110 denotes the screen display for entering the information to be broadcast.

In FIG. 14, numeral 1400 denotes the map display corresponding to the entire range of information transmission destination spots or areas, numerals 1402, and 1404, and 1406 denote spot/area selection displays, numeral 1440 denotes the display area for entering the starting time of available hours, numeral 1450 denotes the display area for entering the ending time of available hours, numeral 1140 denotes a spot/area selection indicator, numerals 1410, 1420, and 1430 denote details of the information to be broadcast, and numerals 1145 and 1160 denote entry completion buttons.

The entire range of information transmission destinations is divided into smaller areas in lateral and longitudinal directions, and the map display 1400 corresponding to the entire range of information transmission destination spots or areas has plotting line marks keyed to the area boundaries.

Area selection displays 1402, and 1404, and 1406 can be made by selecting the plotting-line display within map display 1400 using area selection indicator 1140.

Also, display area 1440 for entering the starting time of available hours of information, and display area 1450 for entering the ending time of available hours of the information appear when the starting time and ending time of available hours of the corresponding information are entered.

Subsequent selection of entry completion button 1145 by the movement of area selection indicator 1140 to this button completes the selection of the areas and changes the display mode from screen display 1100 to screen display 1110.

On screen display 1110, information 1410, information 1420, and information 1430 are entered as the information to be broadcast to the selected areas.

In this embodiment of the present invention, information 1410, information 1420, and information 1430 are entered as the information corresponding to area display 1402, the information corresponding to area display 1404, and the information corresponding to area display 1406.

Subsequent selection of entry completion button 1160 by the movement of area selection indicator 1140 to this button completes entry of the information to be broadcast, and returns the display mode from screen display 1110 to screen display 1100 again.

Thus, it is also possible to enter and display information using the transmitting equipment set forth in the present invention.

In FIG. 16, numeral 1100 denotes the screen display for selecting information transmission destination spots or areas, and numeral 1110 denotes the screen display for entering the information to be broadcast.

In FIG. 16, numeral 1600 denotes the map display corresponding to the entire range of information transmission destination spots or areas, numeral 1620 denotes spot/area selection display, numeral 1610 denotes the starting point and radius of the area shown on area selection display 1620, numeral 1630 denotes the display area for entering the starting time of available hours, numeral 1640 denotes the display area for entering the ending time of available hours, numeral 1140 denotes a spot/area selection indicator, numeral 1650 denote details of the information to be broadcast, and numerals 1145 and 1160 denote entry completion buttons.

Area selection display 1620 can be made by specifying and adding a certain starting point in map display 1600 using spot/area selection indicator 1140, and then specifying the radius from the starting point.

Also, display area 1630 for entering the starting time of available hours of information, and display area 1640 for entering the ending time of available hours of the information appear when the starting time and ending time of available hours of the corresponding information are entered.

Subsequent selection of entry completion button 1145 by the movement of spot/area selection indicator 1140 to this button completes the selection of the area and changes the display mode from screen display 1100 to screen display 1110.

On screen display 1110, information 1650 is entered as the information to be broadcast to the selected area.

Subsequent selection of entry completion button 1160 by the movement of area selection indicator 1140 to this button completes entry of the information to be broadcast, and returns the display mode from screen display 1110 to screen display 1100 again.

Thus, it is also possible to enter and display information using the transmitting hardware system set forth in the present invention.

Explanatory diagrams of the displays made in the display modes of the receiving hardware system that can be implemented per the present invention are shown as FIGS. 12, 13, 15, and 17.

In this embodiment of the present invention, the receiving hardware system shown in FIG. 3 is equipped with connected display and input units to enable various information to be entered and displayed.

Figure 12:
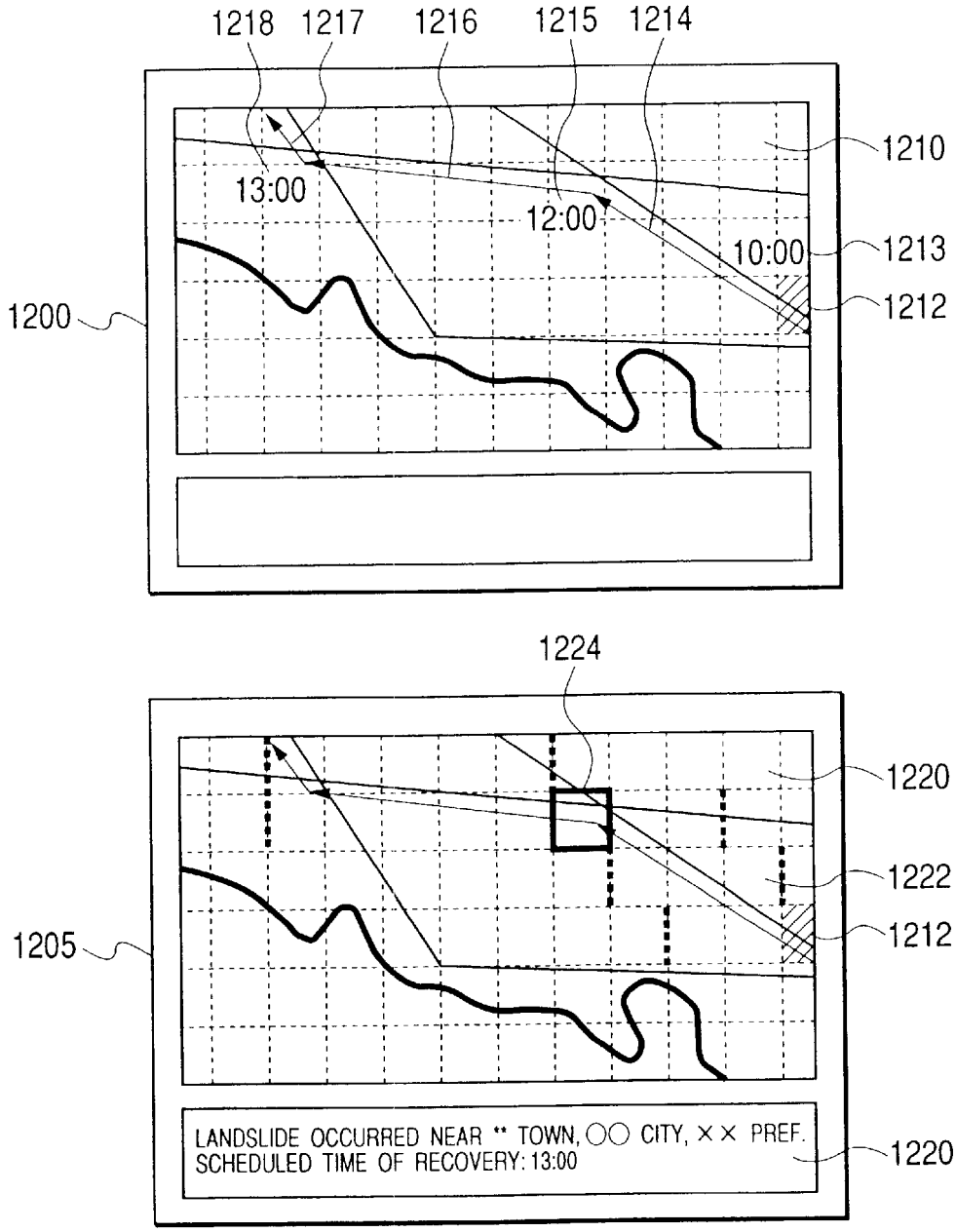
FIG. 12 is an explanatory diagram of the receiving hardware system display formats applied when information is selected.

In FIG. 12, numeral 1200 denotes the screen display for selecting the current area of the vehicle, likely future areas of the vehicle, and the time in each area, numeral 1205 denotes the screen display for entering the information to be broadcast.

Also, in FIG. 12, numeral 1210 and 1220 denote map displays, numeral 1212 denotes the display of the area where the vehicle currently exists, numeral. 1213 denotes the display of the time in the area where the vehicle currently exists, numerals 1214, 1216, and 1218 denote the display of the planned routes that the vehicle is to take in the future, and numerals 1215 and 1217 denote the display of the planned arrival time on the planned routes.

In addition, in FIG. 12, numeral 1222 denotes the area display corresponding to planned routes 1214, 1216, and 1218, numeral 1224 denotes information broadcasting area display, and numeral 1222 denotes broadcast information display.

Suppose that the information to serve as the basis for the area display 1212 denoting the current area, and the time display 1213 denoting the time in the current area, and the information to serve as the basis for planned route display 1214, planned route display 1216, planned route display 1218 planned arrival time display 1213, planned arrival time display 1215, and planned arrival time display 1217, are entered by the operator or from an external route search apparatus such as a car navigation system.

When the information that was entered in FIG. 11 is broadcast, area display 1222, which corresponds to planned routes, and area display 1224, which denotes the information broadcasting destination area, are presented.

At this time, since the information broadcasting destination area is included in the planned route area and since the planned time is included in the available hours of the information, the selection of the broadcast information is determined and broadcast information display 1220 is presented.

Thus, it is possible to perform screen display operations and other operations using the receiving hardware system set forth in the present invention.

It is also possible to select whether current area display 1212, current time display 1213, planned route display 1214, planned route display 1216, planned route display 1218, planned arrival time display 1215, planned arrival time display 1217, planned route area display 1222, and broadcast area 1224 are to be shown or hidden.

Figure 13:
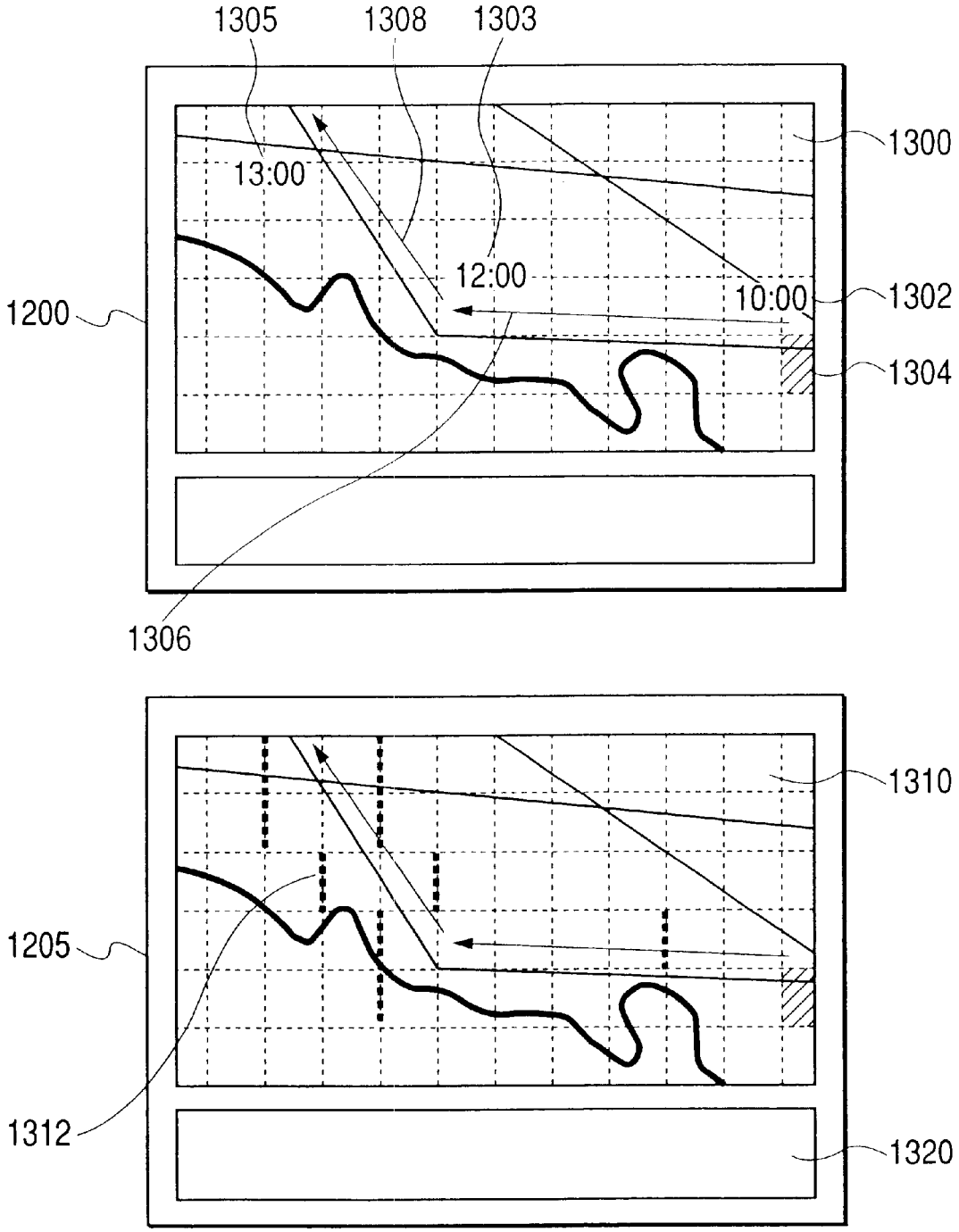
FIG. 13 is an explanatory diagram of the receiving hardware system display formats applied when no information is selected.

In FIG. 13, numeral 1200 denotes the screen display for selecting the current area of the vehicle, likely future areas of the vehicle, and the time in each area, and numeral 1205 denotes the screen display corresponding to the broadcast information.

Also, in FIG. 13, numeral 1300 and 1310 denote map displays, numeral 1304 denotes the display of the area where the vehicle currently exists, numeral 1302 denotes the display of the time in the area where the vehicle currently exists, numerals 1306 and 1308 denote the display of the planned routes that the vehicle is to take in the future, and numerals 1303 and 1306 denote the display of the planned arrival time on the planned routes.

In addition, in FIG. 13, numeral 1312 denotes the area display corresponding to planned routes 1306 and 1308, and numeral 1320 denotes the display of the transmitted information.

Suppose that the information to serve as the basis for the area display 1304 denoting the current area, and the time display 1302 denoting the time in the current area, and the information to serve as the basis for planned route display 1306, planned route display 1308, planned arrival time display 1303, and planned arrival time display 1305, are entered by the operator or from an external route search apparatus such as a car navigation system.

When the information that was entered in FIG. 11 is broadcast, area display 1312, which corresponds to planned routes, is presented.

At this time, since the information broadcasting destination area is not included in the planned route area, it is determined not to select the broadcast information, and as a result, no information is displayed on broadcast information display 1320.

Thus, it is possible to perform screen display operations and other operations using the receiving hardware system set forth in the present invention.

It is also possible to select whether current area display 1304, current time display 1302, planned route display 1306, planned route display 1308, planned arrival time display 1303, planned arrival time display 1305, and planned route area display 1312 are to be shown or hidden.

Figure 15:
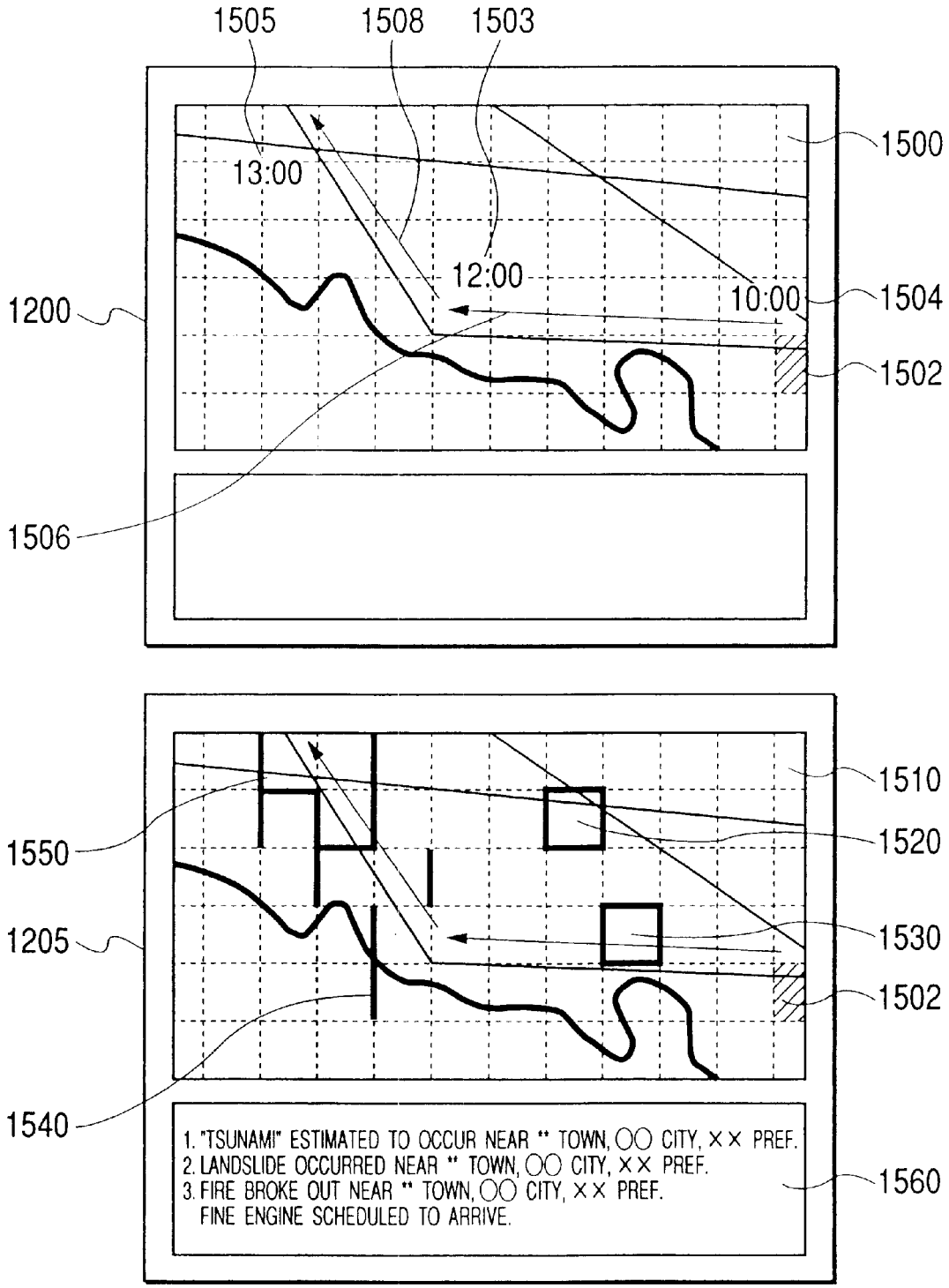
FIG. 15 is an explanatory diagram of the receiving hardware system display formats applied when the information to be prioritized is selected.

In FIG. 15, numeral 1200 denotes the screen display for selecting the current area of the vehicle, likely future areas of the vehicle, and the time in each area, and numeral 1205 denotes the screen display corresponding to the transmitted information.

Also, in FIG. 15, numeral 1500 and 1510 denote map displays, numeral 1502 denotes the display of the area where the vehicle currently exists, numeral 1504 denotes the time in the current area of the vehicle, numerals 1506 and 1508 denote the display of the planned routes that the vehicle is to take in the future, and numerals 1503 and 1505 denote the display of the planned arrival time on the planned routes.

In addition, in FIG. 15, numeral 1550 denotes the area display corresponding to planned routes 1506 and 1508, numerals 1520, 1530, and 1540 denote the display of information broadcasting areas, and numeral 1560 denotes the display of the broadcast information.

Suppose that the information to serve as the basis for the area display 1502 denoting the current area, and the time display 1504 denoting the time in the current area, and the information to serve as the basis for planned route display 1506, planned route display 1508, planned arrival time display 1503, and planned arrival time display 1505, are entered by the operator or from an external route search apparatus such as a car navigation system.

When the information that was entered in FIG. 14 is broadcast, area displays 1520, 1530, and 1540, each of which corresponds to a planned route, is presented.

At this time, depending on whether the information broadcast area is included in the planned route, on whether the planned time is included in the available hours of the information, or on whether the time comes earlier, each set of information is sequenced/prioritized and selected in that order.

At this time, broadcasting information display 1560 is presented.

Thus, it is possible to perform screen display operations and other operations using the receiving hardware system set forth in the present invention.

It is also possible to select whether current area display 1502, current time display 1504 planned route display 1506, planned route display 1508, planned arrival time display 1503, planned arrival time display 1505, planned route area display 1550, and information broadcast areas 1520, 1530, and 1540 are to be shown or hidden.

Figure 17:
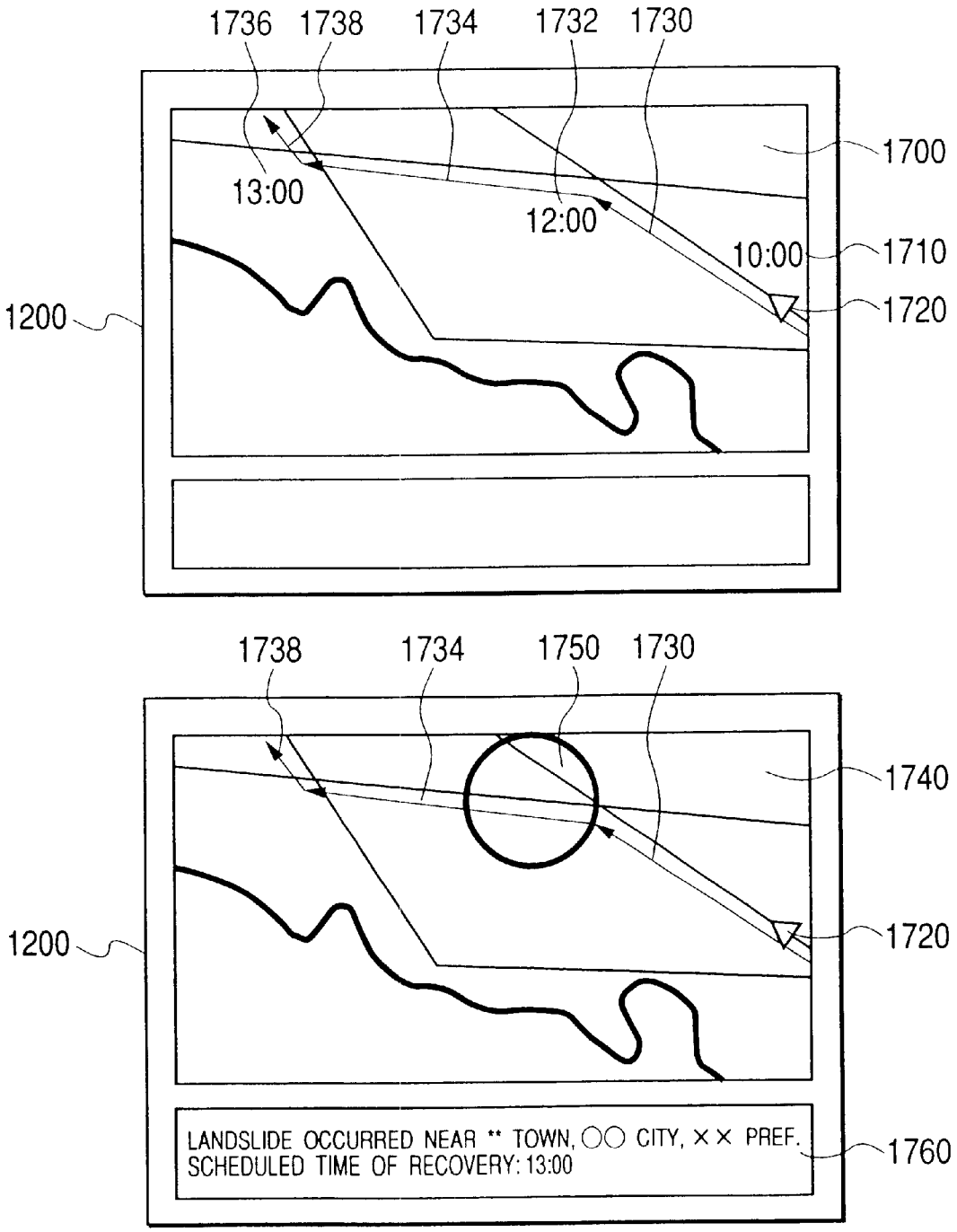
FIG. 17 is an explanatory diagram of the receiving hardware system display formats applied when areas are specified by spots and distances.

In FIG. 17, numeral 1200 denotes the screen display for selecting the current area of the vehicle, likely future areas of the vehicle, and the time in each area, and numeral 1205 denotes the screen display corresponding to the broadcast information.

Also, in FIG. 17, numeral 1700 and 1710 denote map displays, numeral 1720 denotes the display of the area where the vehicle currently exists, numeral 1710 denotes the time in the current area of the vehicle, numerals 1730, 1734, and 1738 denote the display of the planned routes that the vehicle is to take in the future, and numerals 1732 and 1736 denote the display of the planned arrival time on the planned routes.

In addition, in FIG. 17, numeral 1750 denotes the display of information broadcasting areas, and numeral 1760 denotes the display of the broadcast information.

Suppose that the information to serve as the basis for the area display 1720 denoting the current area, and the time display 1710 denoting the time in the current area, and the information to serve as the basis for planned route display 1730, planned route display 1734, planned route display 1738, planned arrival time display 1732, and planned arrival time display 1736, are entered by the operator or from an external route search apparatus such as a car navigation system.

When the information that was entered in FIG. 16 is broadcast, information broadcast area display 1750 is presented.

At this time, since the information broadcasting destination area intersects with the planned route area and since the planned time is included in the available hours of the information, the selection of the broadcast information is determined and broadcast information display 1760 is presented.

Thus, it is possible to perform screen display operations and other operations using the receiving hardware system set forth in the present invention.

It is also possible to select whether current area display 1720, current time display 1710, planned route display 1730, planned route display 1734, planned route display 1738, planned arrival time display 1732, planned arrival time display 1736, and information broadcast areas 1750 are to be shown or hidden.

Figure 18:
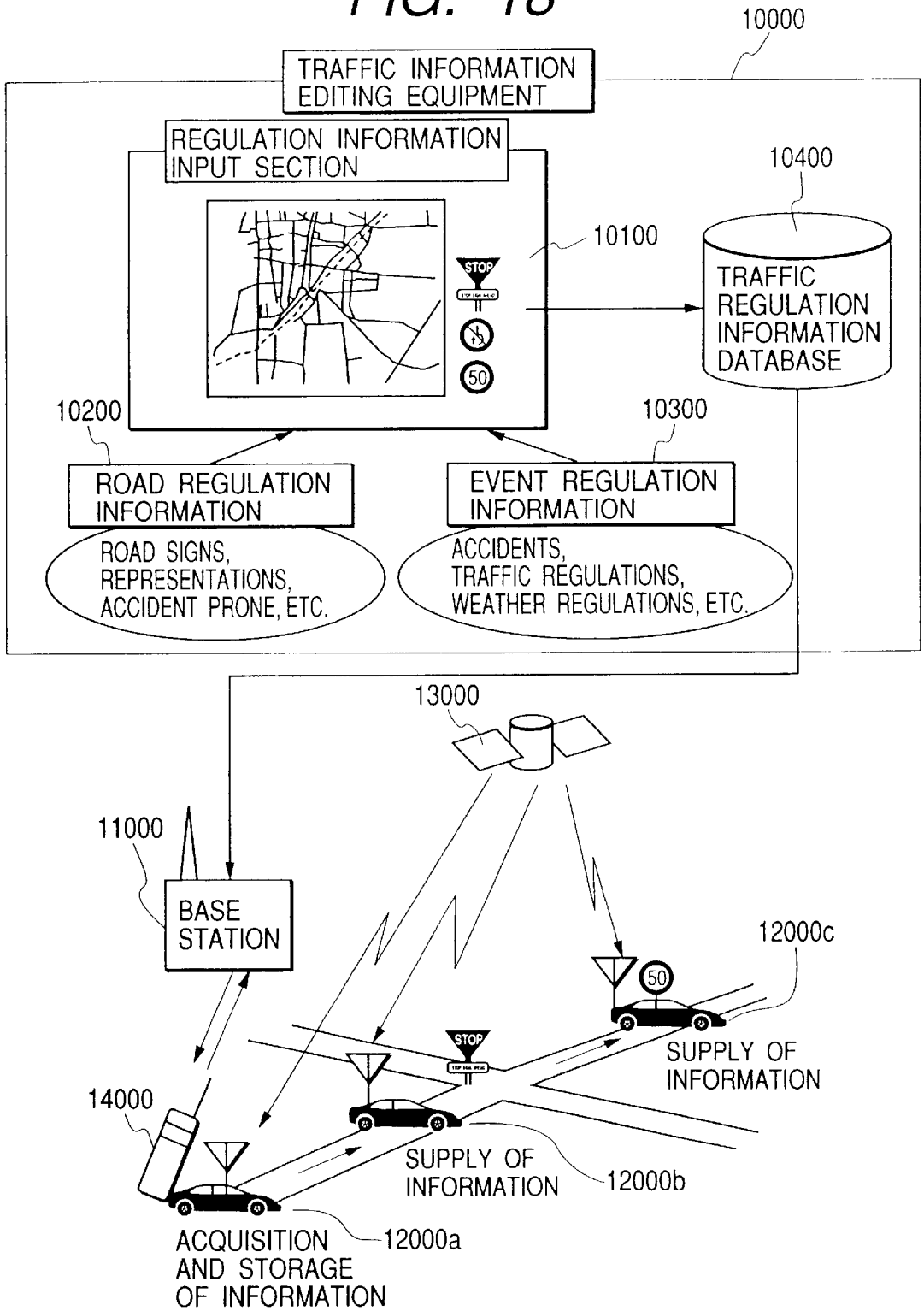
FIG. 18 shows an information providing system that includes traffic information editing equipment, an embodiment of the present invention.

FIG. 18 explains traffic information editing equipment, which is one embodiment of the present invention, and the configuration of the information providing system including the editing equipment. In FIG. 18, numeral 10000 denotes the traffic information editing equipment for editing and storing traffic regulation information, and numeral 10100 denotes the regulation information input section for entering road regulation information 10200 and event regulation information 10300.

Numeral 11000 denotes the communications base station for transmitting traffic regulation information, and numeral 12000*a* denotes a vehicle that receives traffic regulation information. This vehicle passes positions 12000*b* and 12000*c*. Numeral 13000 denotes a GPS (Global Positioning System) satellite, and numeral 14000 denotes information receiving equipment mounted in vehicle 12000*a* to receive traffic regulation information.

This embodiment relates to a traffic information system characterized in that traffic regulation information database 10400 (hereinafter, the term "database" is referred to simply as DB) is edited using traffic information editing equipment 10000, and in that traffic regulation information is transmitted to vehicle 12000*a* via communications base station 11000 by radio communications, then transferred to information receiving equipment 14000 provided in vehicle 12000*a*, and presented to the driver in the timing that the vehicle arrives at positions 12000*b* and 12000*c*, both of which satisfy the position, direction, period, and other information presentation requirements specified using traffic information editing equipment 10000.

First, traffic information editing equipment 10000 is described below. Traffic information editing equipment 10000 is intended to create traffic regulation information as the electronic data that can be transmitted through communication, and store traffic regulation information DB 10400 so as to enable its output as required. Road regulation information 10200 included in the traffic regulation information further consists of information on road signs and road regulations, and static cautionary information on roads. Of all road regulation information 10200, only information on road signs and road regulations can use a digital traffic regulation DB created by the Japan Association of Traffic Management Technology. Information that cannot be covered by the digital traffic regulation DB alone, or updated information within the digital traffic regulation DB is established so as to perform additions using the regulation information input section 10100 of the traffic information system. Typical examples of static cautionary information include notices of the spots where accidents have occurred in the past, cautionary information for the prevention of accidents, traffic volumes on roads and at intersections, risk analytical information based on statistics of driving speeds and on sensor information, forward visibility based on the shapes of roads, and cautionary information on the shapes of curves. Event regulation information 10300 is information concerning the traffic regulations and cautions/warnings required by the occurrence of events. Event regulation information refers to, for example, information on traffic prohibition or limitation associated with road work or with events, traffic limitation and cautionary information associated with changes in weather, and other traffic limitation information occurring in real time. Road regulation information 10200 and event regulation information 10300 are manually entered by traffic management personnel or automatically entered by the equipment that has collected traffic regulation information. Regulation information input section 10100 adds to road regulation information 10200 and event regulation information 10300 the position, direction, period, and other requirements for presenting information to the driver. The information presentation position is given as a point or a zone, depending on the particular type of traffic regulation information. For example, if the traffic regulation information relates to stopping at intersections, one spot located this side of an intersection at which the driver must stop will need to be given as the information presentation spot, or if the traffic regulation information relates to speed regulations, the zone where speed regulation is specified will need to be given as the information presentation zone. The direction in which the information is to be presented is determined in a form linked to whether the driver is to drive toward or away from the nearest city. Traffic regulation information can be supplied beforehand to the driver in appropriate timing by specifying the information presentation position and direction, independently from the positions and directions where the regulation information is to be actually and strictly observed. The period of information presentation can be freely entered, provided that the period is a cycle time, a term, or the like, such as: the same time frame of each day, one specific day, one specific month, or no time limit.

Other requirements relating to the presentation of information include the speed and type of vehicle. For example, if the traffic regulation information relates to speed regulation, the appropriate speed limit will need to be specified according to the particular type of vehicle, and a warning on speeding will need to be issued as an added requirement, only to vehicles exceeding the speed limit. If the traffic regulation information is accident statistical information applied to a vehicle type only and the information is for cautioning at intersections prone to accidents related to heavy-duty vehicles, a requirement for supplying information only to heavy-duty vehicles will need to be added. In order to enable traffic management personnel to enter road regulation information 10200 and event regulation information 10300, a means that enables on-map editing or editing with a map display unit via a graphical user interface (GUI) is provided as one component of regulation information input section 10100 so that the management personnel can easily enter information presentation requirements such as position, direction, and period. For automatic entry of road regulation information 10200 and event regulation information 10300 and automatic registration of both in traffic regulation information DB 10400, for example, when statistical information on traffic volumes and speeds is to be registered, statistical information that has already been collected and analyzed by other information collection equipment is acquired and then information presentation requirements, such as position, directions period, and vehicle type, are added according to the rules, or using a setting procedure, for creating these-requirements beforehand. Traffic regulation information with added information presentation requirements is then stored into traffic regulation information DB 10400.

Next, the flow of processing up to the presentation of traffic regulation information to the driver is described below. All or part of traffic regulation information 10400 is delivered to communications base station 11000. The volume of information to be stored at the communications base station is changed according to the size of the area covered by this base station. In the example of FIG. 18, communications base station 11000 establishes communication with the information receiving equipment 14000 (in the example of the figure, cellular phone) provided in vehicle 12000*a*, and then transmits the traffic regulation information stored within the base station. Vehicle 14000 stores the received traffic regulation information, then acquires the corresponding vehicle location information through GPS satellite 13000, and individual sets of traffic regulation information are presented to the driver in the timing that satisfies the position, direction, period, and other information presentation requirements specified using traffic regulation information input section 10100. When vehicle 12000*a* is present at spot 12000*b*, the 'stop' information to be supplied is presented to the driver under the conditions of position and direction that were specified for spot 12000*b*, and thus the driver is urged to stop. When the vehicle is present at spot 12000*c*, if the position and direction at spot 12000*c* and the speed and type of vehicle 12000*a* match the conditions for supplying speed regulation information, vehicle 12000*a* will issue a speeding warning to the driver to urge him or her to strictly observe the speed limit.

Figure 19:
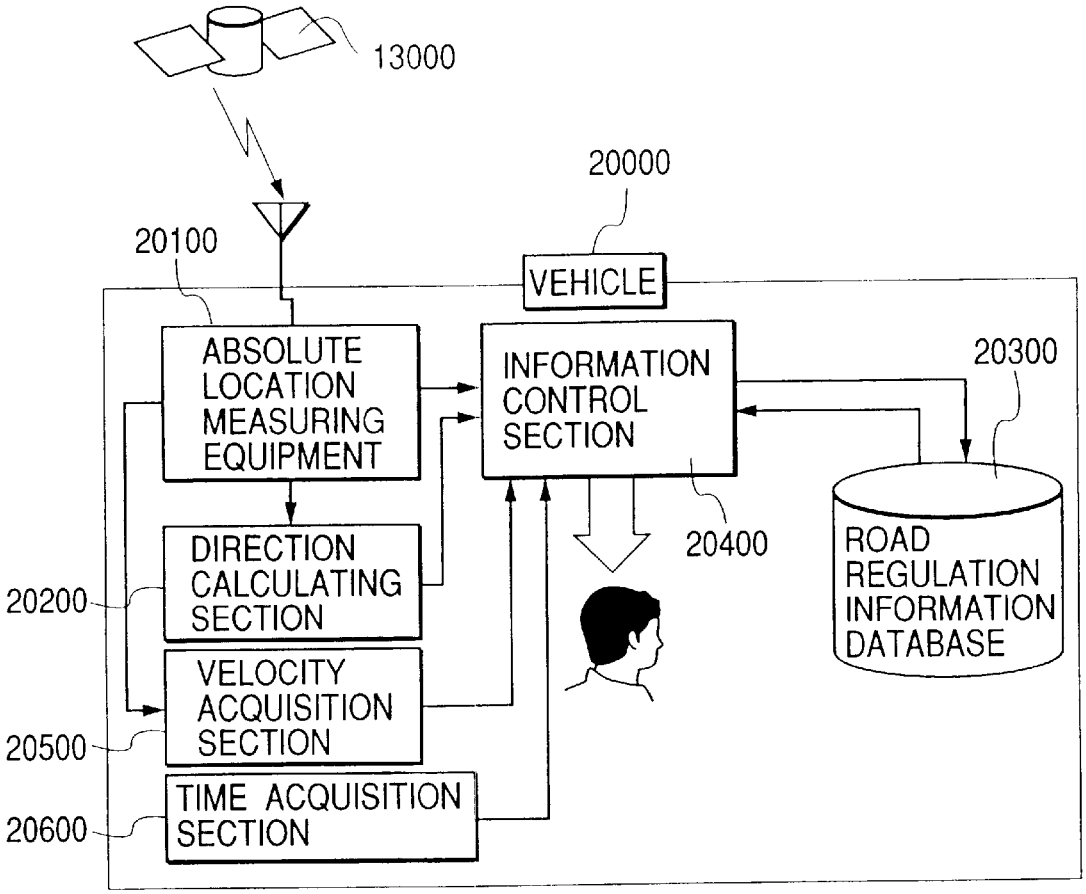
FIG. 19 shows an information providing system that stores road regulation information into the vehicle.

FIG. 19 shows another embodiment of an information providing system based on the present invention. Absolute location measuring equipment 20100 uses a global positioning system (GPS) to measure the absolute location of vehicle 20000 in real time. In this embodiment, the absolute location measuring equipment uses GPS satellite 13000. Instead, however, the equipment can use either self-contained navigation, a method based on map matching, or a combination of said methods and GPS. Road regulation information DB 203 refers to road regulation information stored in the vehicle after the information has been retrieved using storage media, such as a CD-ROM, CD-R, DVD-ROM, and flush memory, from the traffic regulation, information DB 10400 that has been created using traffic information editing equipment 10000. The above-mentioned storage media are provided in the vehicle in such a format that road regulation information can be read under the instructions of information control section 20400 (the above media consists of a CD-ROM drive and other reading units corresponding to the respective types of storage media). Although the road regulation information stored within the above-mentioned storage media become obsolete with the elapse of time, the driver can update road regulation information DB 20300 by periodically replacing the storage media with a new one. Information control section 20400 is equipment having a means for integrating various information (such as the absolute location, direction, and speed of the vehicle, the time of day, and road regulation information) and presenting the necessary road regulation information to the driver in the specified timing or in the timing calculated by information control section 20400.

This embodiment relates to a system completed with a vehicle alone, and this system is characterized in that it has absolute location measuring equipment 20100, direction-:calculating section 20200, velocity acquisition section 20500, and time acquisition section 20600, and thus in that road regulation information can be presented to the driver in the specified timing or in the timing calculated by information control section 20400.

For the broadcasting method shown in FIG. 1, the current spot or area or future spots or areas can likewise be obtained from information control section 20400.

Figure 20:
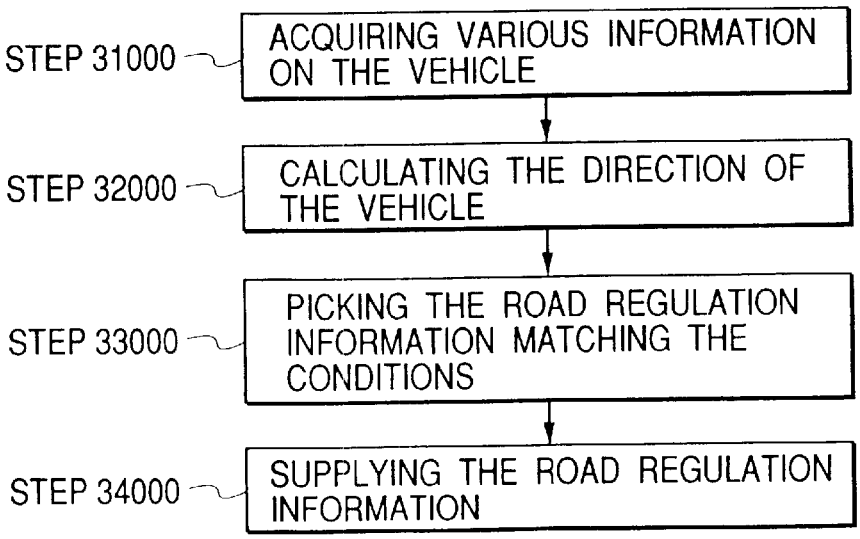
FIG. 20 is a flowchart of processing in the embodiment of FIG. 19.

FIG. 20 is a flowchart showing the flow of processing in which road regulation information is supplied to the driver in the embodiment of FIG. 19. The flow of processing in the embodiment of FIG. 19 is described below using the flowchart of FIG. 20.

First, in step 31000, information on the current status of vehicle 20000 is acquired by each type of equipment within the vehicle. Absolute location measuring equipment 20100 acquires absolute location information relating to vehicle 20000. Velocity acquisition section 20500 acquires the traveling direction and speed of vehicle 20000. The speed can be calculated using either the vehicle speed sensor or absolute location measuring equipment 20100 provided in vehicle 20000. Time acquisition section 20600 acquires the current time from the clock provided in vehicle 20000.

Next,in step 32000, the traveling direction of vehicle 20000 is calculated from the absolute location information that has been acquired by absolute location measuring equipment 20100. Information control section 20400 acquires the absolute location, traveling direction, traveling speed, and traveling time-of-day information obtained in the above two steps. Information control section 20400 also has vehicle type information on vehicle 20000 beforehand. In step 33000, the absolute location, traveling direction, traveling speed, and traveling time-of-day of the vehicle that have been acquired by information control section 20400, and various conditions that provide for the presentation of various road regulation information (more specifically, independent conditions established for the location, direction, and period of information presentation each, and for each type of road regulation information) are compared by information control section 20400, where the road regulation information corresponding to the information presentation conditions is then extracted from road regulation information DB 20300. In step 34000, the road regulation information that has been extracted by information control section 20400 is presented to the driver. Information can be supplied timely and continuously by repeating steps 31000 to 34000 cyclically. The specified information presentation location and conditions within road regulation information DB 20300 can also be used for information control section 20400 to recalculate the timing of information presentation. For example, in the case of stopping at intersections, the timing of information presentation can also be calculated according to the particular speed of the vehicle. A position at which the vehicle can be stopped is derived from the current speed of the vehicle and its deceleration performance, and this position is compared with the position where the driver must stop the vehicle. If the distance between the derived position and the legally obliged stopping position is shorter than the required value, a 'stop' warning will be given to the driver. Thus, the timing of supplying information can be adjusted according to the particular response capability of the driver.

Figure 21:
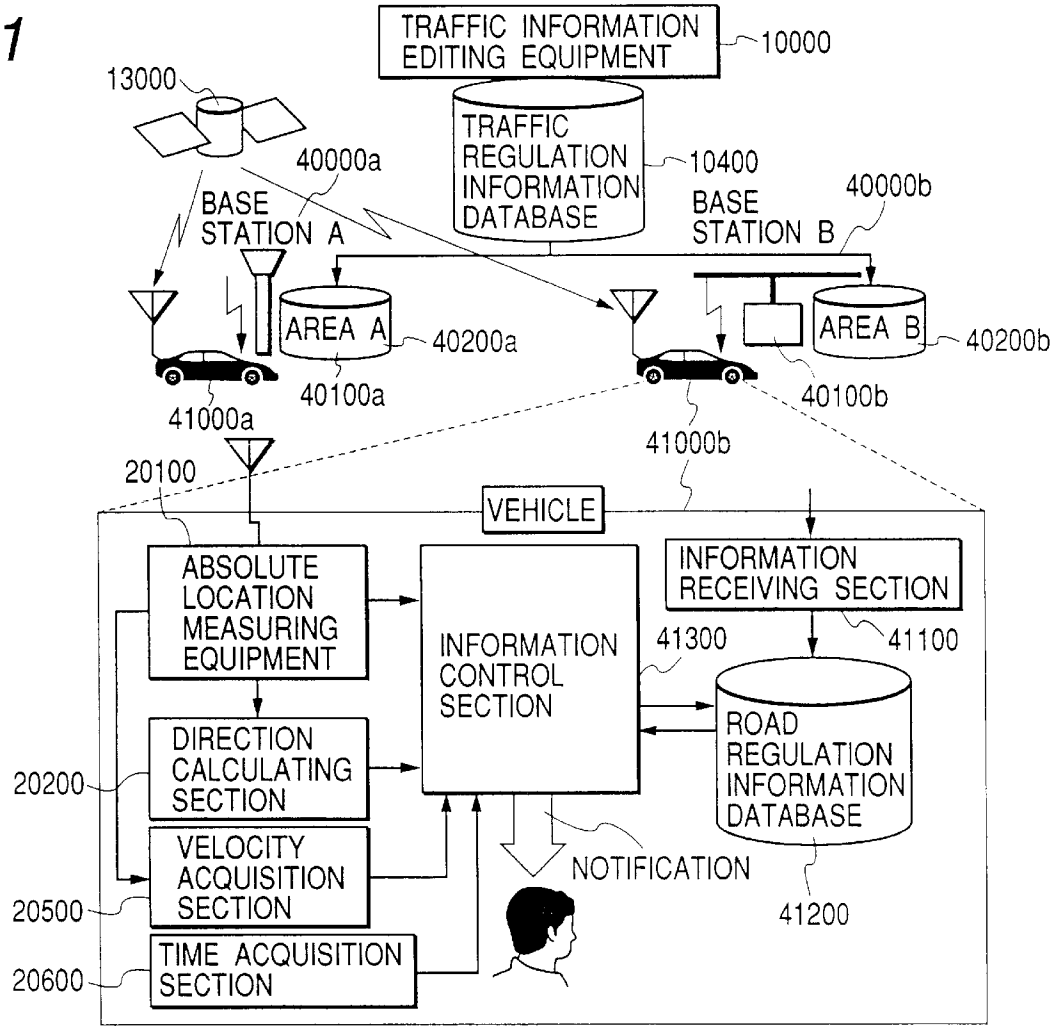
FIG. 21 shows an information providing system that uses narrow-area radio communications as its communications means.

Still another embodiment of an information providing system based on the present invention is shown-in FIG. 21, wherein narrow-area radio communications is used as a means of communication between one communications base station and one vehicle. Numeral 40000*a* denotes the communications base station corresponding to area A, and this base station consists of radio beacon 40100*a*, which functions as information transmitting equipment, and traffic regulation information DB 40200*a* for area A. Similarly, numeral 40000*b* denotes the communications base station corresponding to area B, and this base station consists of leakage coaxial (LCX) cable 40100*b*, which also functions as information transmitting equipment, and traffic regulation information DB 40200*b* for area B. Although the communications that uses a radio beacon and an LCX cable is explained as narrow-area radio communications in this embodiment, any other narrow-area radio communications means can be used instead vehicles 41000*a* and. 41000*b* run within areas A and B, respectively. Vehicle 41000*b* is provided with absolute location measuring equipment 20100, direction calculating section 20200 , velocity acquisition section 20500, time acquisition section 20600, information receiving section 41100, traffic regulation information DB 41200, and information control section 41300. Storage media that enables read/write operations, for example, a hard disk drive to function as the temporary storage unit on a RAM, is used as the storage means for traffic regulation information DB 41200. Vehicle 41000*a* also has the same components as those of vehicle 41000*b*.

This embodiment enables the latest traffic regulation information to be independently delivered to each area by using narrow-area radio communications as the communications means. Also, information acquisition timing and information presentation timing can be made independent since the vehicle has absolute location measuring equipment.

Figure 22:
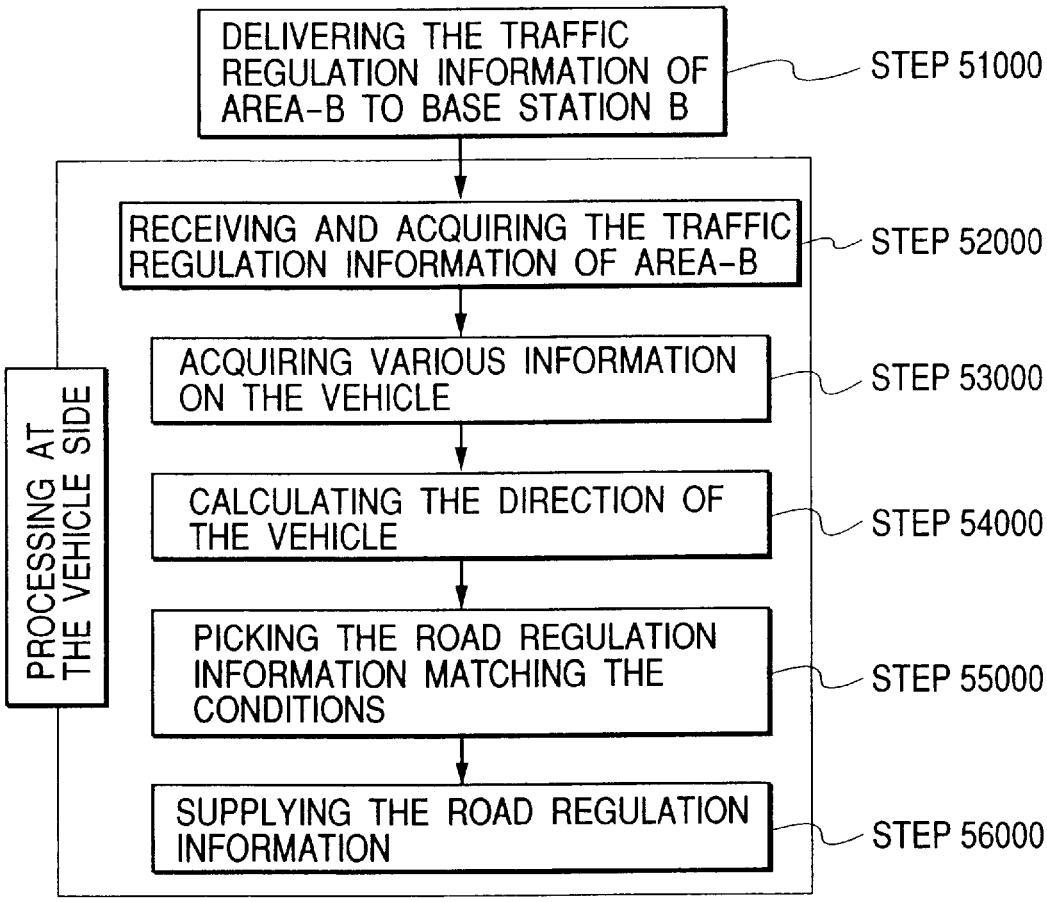
FIG. 22 is a flowchart of processing in the embodiment of FIG. 21.

FIG. 22 is a flowchart showing the flow of processing in which traffic regulation information is presented to the driver. The flow of processing in the embodiment of FIG. 21 is described below using the flowchart of FIG. 22.

Step 51000 is information processing outside the vehicle. Communications base station 40000*b* receives traffic regulation information from traffic information editing equipment 10000 and stores the information as traffic regulation information DB 40200*b*. During the use of narrow-area communications, since the location and direction of a communications base station on the road can be provided for on the installation of the communications base station, traffic regulation information DB limited to the location and direction of the communications base station can be delivered. The capacities of the storage media provided in communications base stations can be reduced by:storing the amount of traffic regulation information-DB required for each communications base station. Step 52000 onward is information processing inside the vehicle. In step 52000, the vehicle 41000*b* that has entered the narrow-area radio communications area of communications base station 40000*b* receives the contents of traffic regulation information DE 40200*b* via the radio communication between information receiving section 41100 and LCX cable 40100*b*. The received traffic regulation information is saved in traffic regulation information DB 40200*b* by information receiving section 41100. In step 53000 onward, as with step 31000 onward of FIG. 20, information control section 41300 acquires the absolute location, traveling direction, traveling speed, and traveling time-of-day of the vehicle, then extracts from traffic regulation information DB 41200 only the traffic regulation information that matches the acquired conditions, and presents the extracted information to the driver in the specified timing or in the timing calculated by -information control section 41300. Processing in step is executed when traffic regulation information on communications base station 40000*a* is modified within traffic regulation information DB 10400. Processing in step 52000 is executed when communication is established between vehicle 41000*b* and communications base station 40000*b*. Processing in step 53000 onward is executed cyclically inside the vehicle. Timely and continuous supply of information is possible by repeating steps 53000 through 56000 cyclically.

Figure 23:
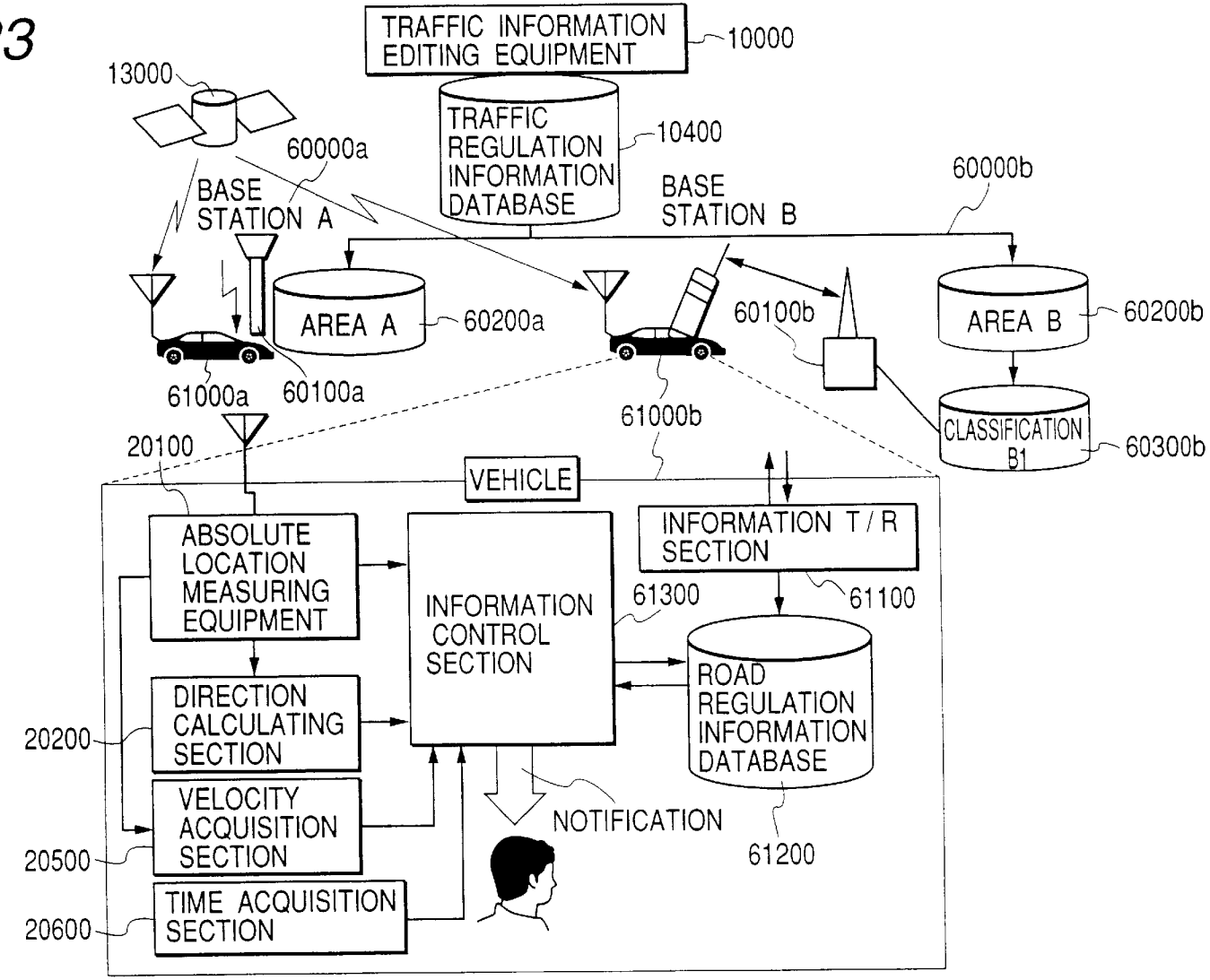
FIG. 23 shows an information providing system that uses bidirectional mobile communications as its communications means.

Still another embodiment of an information providing system based on the present invention is shown in FIG. 23, wherein bi-directional mobile communications is used as a means of communication between one communications base station and one vehicle. Numeral 60000*a* denotes the communications base station corresponding to area A, and this base station consists of optical beacon 60100*a*, which functions as information transmitting/receiving equipment, and traffic regulation information DB 60200*a* for area A. Similarly, numeral 60000*b* denotes the communications base station corresponding to area B, and this base station consists of mobile communications antenna 60100*b* for a cellular phone, traffic regulation information DB 60200*b* for area B, and traffic regulation information DB 60300*b* that forms all or part of traffic regulation information DB 60300*b*. Although the communications that uses an optical beacon and a cellular phone is explained as bidirectional mobile communications in this embodiment, any other bidirectional mobile communications means, can be used instead. Vehicles 61000*a* and 761000*b* run within areas A and B, respectively. Vehicle 61000*b* is provided with absolute location measuring equipment 20100, direction calculating section 20200, velocity acquisition section 20500, time acquisition section 20600 information transmitting/receiving section 61100, traffic regulation information DB 61200, and information control section 61300. As with the embodiment of FIG. 21, in the embodiment of FIG. 23, storage media that enables read/write operations is used as the storage means for traffic regulation information DB 61200. Vehicle 61000*a* also has the same components as those of vehicle 61000*b*.

This embodiment of the present invention is another embodiment for achieving a similar purpose to that of the embodiment shown in FIG. 21. Also, the us e of bi-directional communications as the communications means, enables the latest traffic regulation information to be delivered in further sub-classified form.

Figure 24:
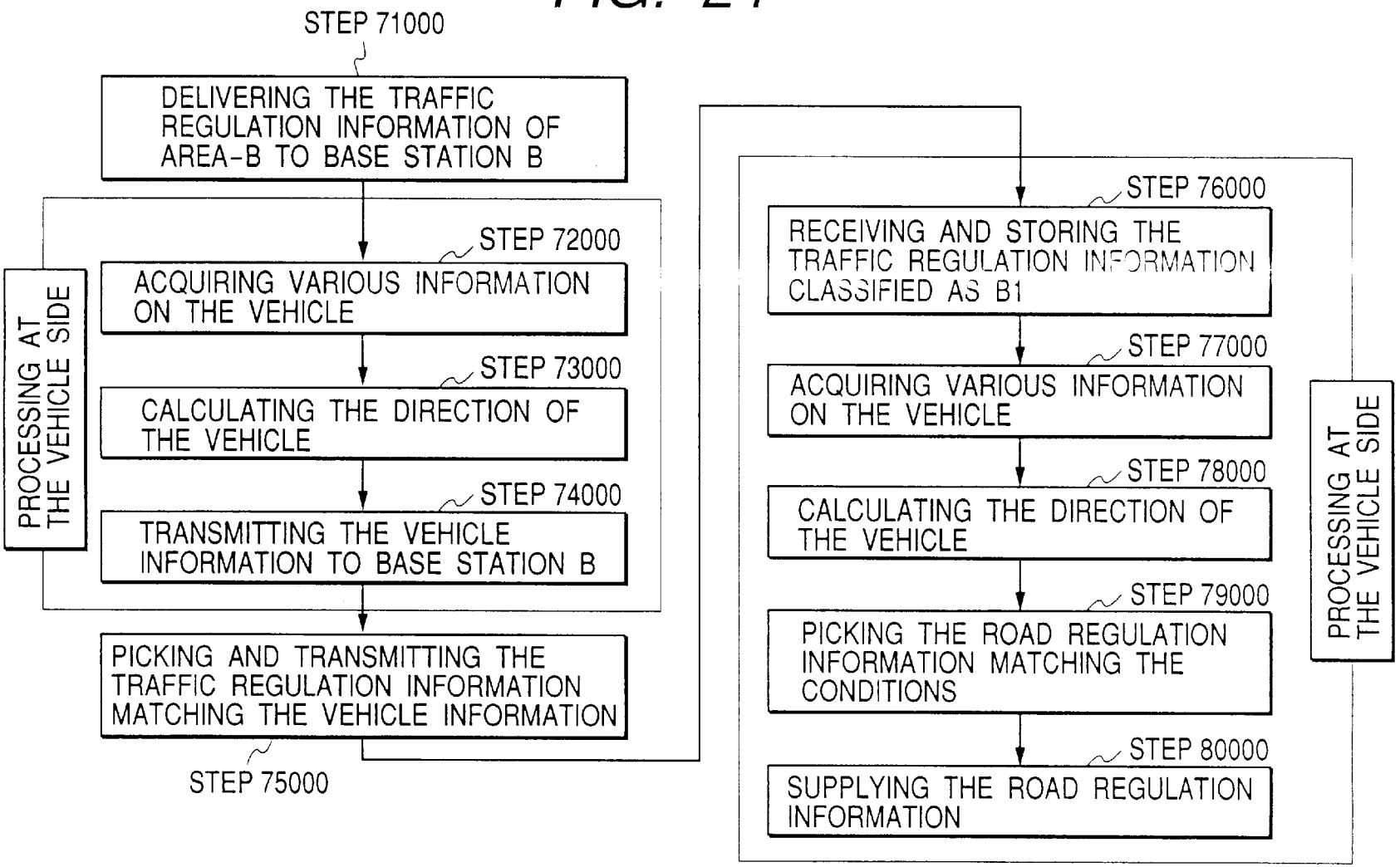
FIG. 24 is a flowchart of processing in the embodiment of FIG. 23.

FIG. 24 is a flowchart showing the flow of processing in which traffic regulation information is presented to the driver in the embodiment of FIG. 23. The flow of processing in the embodiment of FIG. 23 is described below using the flowchart of FIG. 24.

Step 71000 is information processing outside the vehicle. In this step, as with step 51000 of FIG. 22, area traffic regulation information is delivered for each base station. Steps 72000 and 73000 are preprocessing steps occurring outside the vehicle when communication is established between mobile communications base station 60100*b* and the information transmitting/receiving section 61100 of the vehicle-mounted equipment. In step 72000, vehicle 61000*b* acquires various information of the vehicle via absolute location measuring equipment 20100, velocity acquisition section 20500, and time acquisition section 20600. Also, vehicle type information is stored within the vehicle beforehand. In step 73000, direction calculating section 20200 calculates the traveling direction of the vehicle. In step 74000, information transmitting/receiving section 61100 transmits various information on the vehicle, and information on the traveling direction and type of vehicle, to base station 60000*b*. In step 74000, processing within base station 60000*b* is executed. In step 74000, base station 60000*b* extracts the traffic regulation information corresponding to the received vehicle information, from traffic regulation information DB 60200*b*, and then after creating traffic regulation information DB 60300*b*, transmits the extracted information to vehicle 61000*b*. Or base station 60000*b* creates traffic regulation information DB 60300*b* by classifying traffic regulation information DB 60200*b* beforehand, then selects traffic regulation information DB 60300*c* appropriate for the received vehicle information, and transmits the corresponding information to vehicle 61000*b*. The amount of information to be sent during one communicating operation can be reduced by selecting the location, traveling direction, and type of vehicle, as the basis for classification for the creation of traffic regulation information DB 60300*c*. In step 76000 onward, as with step 52000 of FIG. 22, the traffic regulation information that the vehicle has received is saved in traffic regulation information DB 61200, and information control section 61300 acquires the absolute location, traveling direction, traveling speed, and traveling time-of-day of the vehicle, then extracts from traffic regulation information DB 61200 only the traffic regulation information that matches the acquired conditions, and presents the extracted information to the driver in the specified timing or in the timing calculated by information control section 61300. Processing in step 71000 is executed when traffic regulation information on communications base station 60000*b* is modified within. traffic regulation information DB 10400. Processing in steps 74000 and 75000 is executed when communication is established between vehicle 61000*b* and communications base station 60000*b*. Communication is established, only during the use of a location-limiting information communications means (such as an optical beacon) when the vehicle has moved past the bottom of the optical beacon. During the use of an information communications means not limiting the location, such as a cellular phone, communication is established either at fixed time intervals or at any time.

Figure 25:
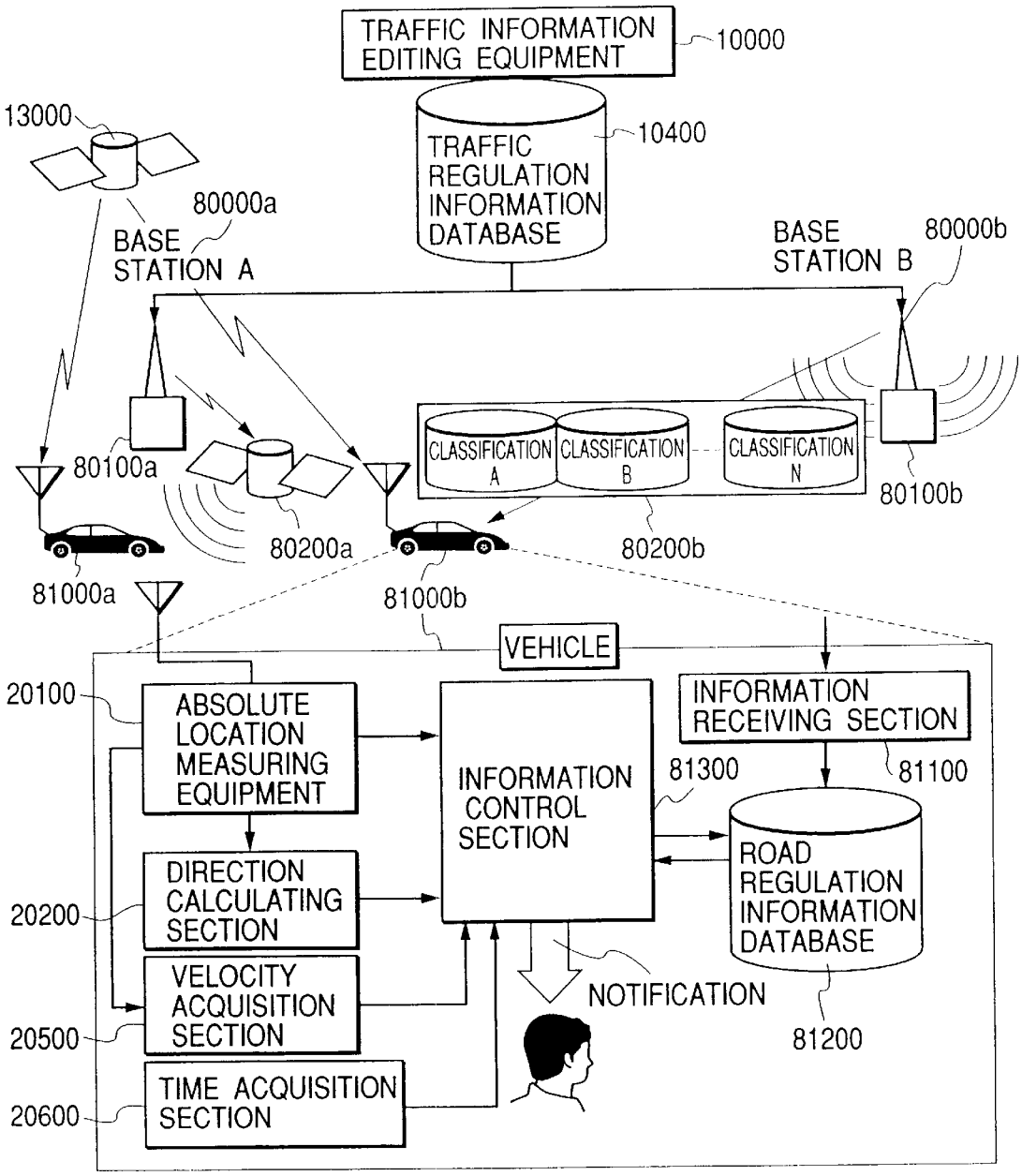
FIG. 25 shows an information providing system that uses multi-channel broadcasting as its communications means.

Still another embodiment of an information providing system based on the present invention is shown in FIG. 25, wherein multi-channel broadcasting is used as a means of communication between one communications base station and one vehicle. Numeral 80000*a* denotes a digital radio broadcasting communications base station consisting of broadcasting station 80100*a* and communications satellite 80200*a*. Similarly, numeral 80000*b* denotes a communications base station using either terrestrial digital radio broadcasting or FM multiplex broadcasting, and in this case, broadcasting station 80100*b* transmits traffic regulation information. The traffic regulation information 80200*b* to be transmitted from broadcasting station 80100*b* is classified according to location, traveling direction, and vehicle type, for each channel, and then the traffic regulation information is assigned. The traffic regulation information transmitted also takes a similar format to that adopted for communications base station 80000*a*.

Although the broadcast-type communications that uses satellite digital radio broadcasting, terrestrial digital radio broadcasting, and FM multiplex broadcasting is explained as multi-channel broadcasting in this embodiment, any other multi-channel broadcast-type communications means can be used instead. Vehicles 81000*a* and 81000*b* run within areas A and B, respectively. Vehicle 81000*b* is provided with absolute location measuring equipment 20100, direction calculating section 20200, velocity acquisition section 20500, time acquisition section 20600, information receiving section 811000, traffic regulation information DB 81200, and information control section 81300. As with the embodiment of FIG. 21, in the embodiment of FIG. 23, storage media that enables read/write operations is used as the storage means for traffic regulation information DB 81200. Vehicle 81000*a* also has the same components as those of vehicle 81000*b*.

This embodiment of the present invention is another embodiment using multi-channel broadcasting as the communications means, and for achieving a similar purpose to that of the embodiment shown in FIG. 21.

Figure 26:
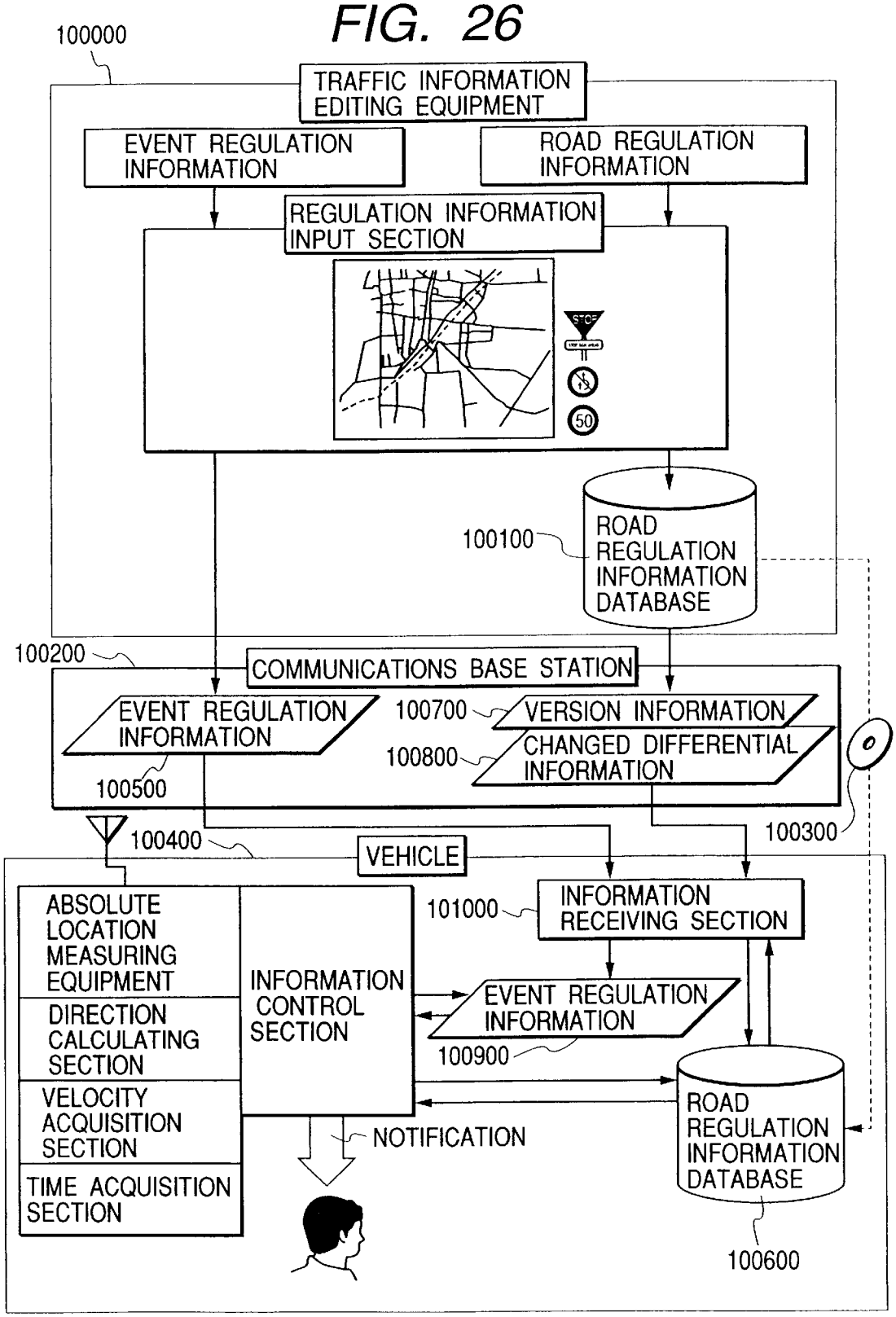
FIG. 26 is a flowchart of processing in the embodiment of FIG. 25.

FIG. 26 is a flowchart showing the flow of processing in which road regulation information is presented to the driver in the embodiment of FIG. 25. The flow of processing in the embodiment of FIG. 25 is described below using the flowchart of FIG. 26.

In steps 91000 and 92000, information undergoes processing outside the vehicle. In step 91000, communications base station 80000*b* receives traffic regulation information DB 10400 from traffic information editing equipment 10000. If the information delivery range of communications base station 80000*b* is limited to specific areas only, the communications base station will receive traffic regulation information on the corresponding areas. In step 92000, communications base station 80000*b* classifies traffic regulation information, then allocates the information to each channel, and transmits the information together with the corresponding broadcast waves. In step 93000 onward, information undergoes processing inside the vehicle. In step 93000, vehicle 81000*b* acquires various information of the vehicle via absolute location measuring equipment 20100, velocity acquisition section 20500, and time acquisition section 20600. In step 94000, information receiving section 81100 sets the broadcast wave receiving channel in accordance with the vehicle information that was received in step 93000, and selectively receives only the relevant section of traffic regulation information 80200*b*. In step 95000 onward, as with step 54000 of FIG. 22, the traffic regulation information that the vehicle has received is saved in traffic regulation information DB 81200, and information control section 81300 acquires the absolute location, traveling direction, traveling speed, and traveling time-of-day of the vehicle, then extracts from traffic regulation information DB 81200 only the traffic regulation information that matches the acquired conditions, and presents the extracted information to the driver. Processing in step 91000 is executed when traffic regulation information on communications base station 80000*b* is modified within traffic regulation information DB 10400. Processing in step 92000 is always executed repeatedly in communications base station 80000*b*. Processing in steps 93000 and 95000 is always executed repeatedly inside the vehicle, and processing in step 94000 is executed when the broadcast wave receiving channel of the vehicle is changed, namely, when the location/traveling direction of the vehicle-falls under another classification of the broadcast-wave channels.

Figure 27:
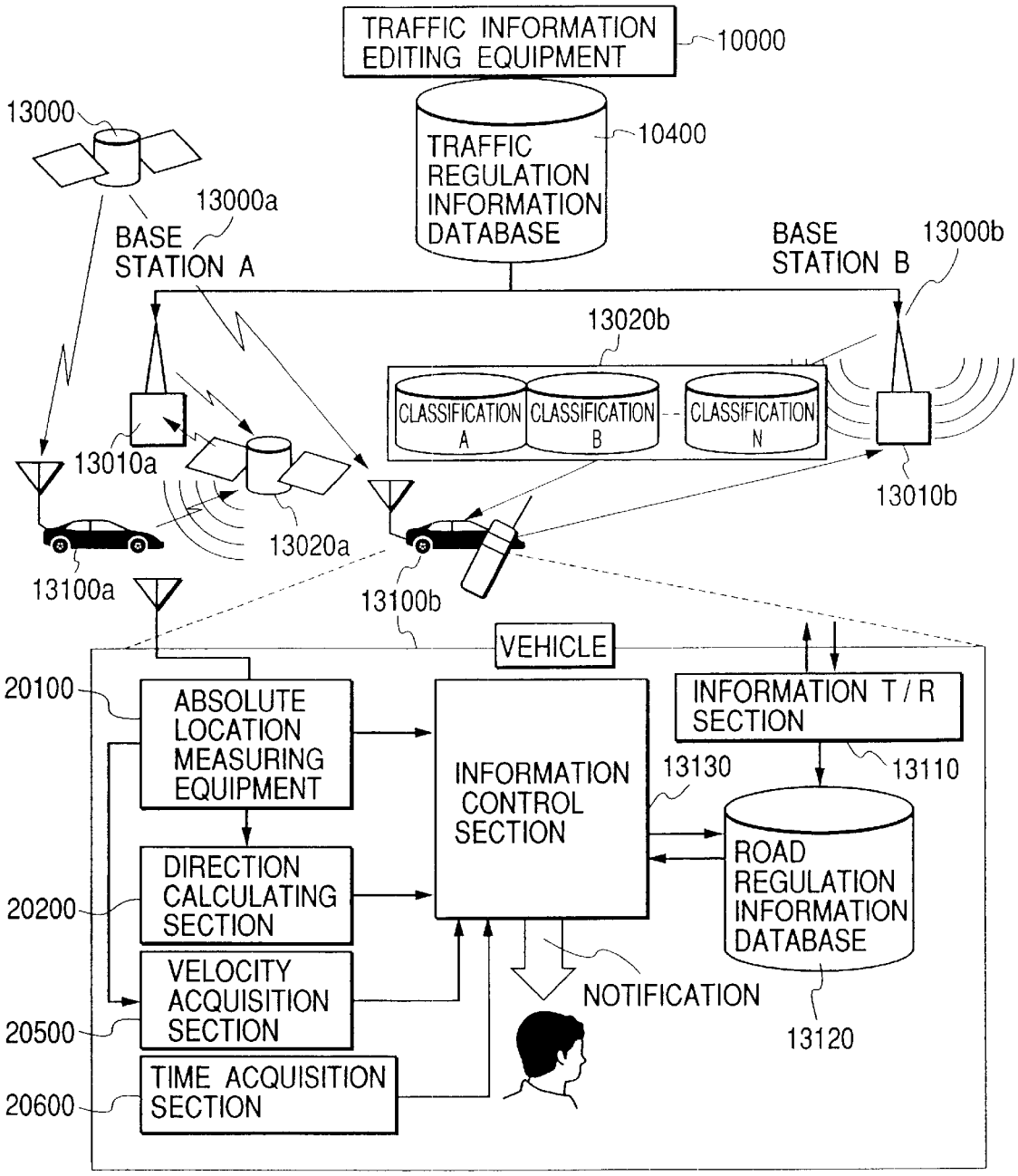
FIG. 27 shows an information providing system that uses multi-channel broadcasting and ex-vehicle information transmission as its communications means.

Still another embodiment of an information providing system based on the present invention is shown in FIG. 27, wherein the presentation of information to individual vehicles can be implemented by combining the communications means for transmitting vehicle information to base stations, and a communications means of the multi-channel broadcast type. Base station 13000*a* is a broadcast-type satellite communications means that enables bidirectional communication, and base station 13000*b* is a terrestrial broadcast-type communications means. Vehicle 13100*b* has a means for information communication to base station 13000*b*. This embodiment is characterized in that information on individual vehicles is transmitted to base stations, and each vehicle can receive the traffic regulation information pertaining to the particular vehicle.

As described in the above embodiment, the vehicle-mounted equipment acquires information on the location, direction, and type of the vehicle, and transmits the vehicle information to base stations via communication. At the base station side, the traffic regulation information to be supplied to the vehicle is extracted using-the received information. The extracted traffic regulation information is transmitted to the vehicle over the channel that has been assigned to the particular vehicle. Subsequent processing is similar to that of the embodiment described above; received traffic regulation information is stored into memory and then supplied to the driver in the specified timing or in the timing calculated at the vehicle side.

Figure 28:
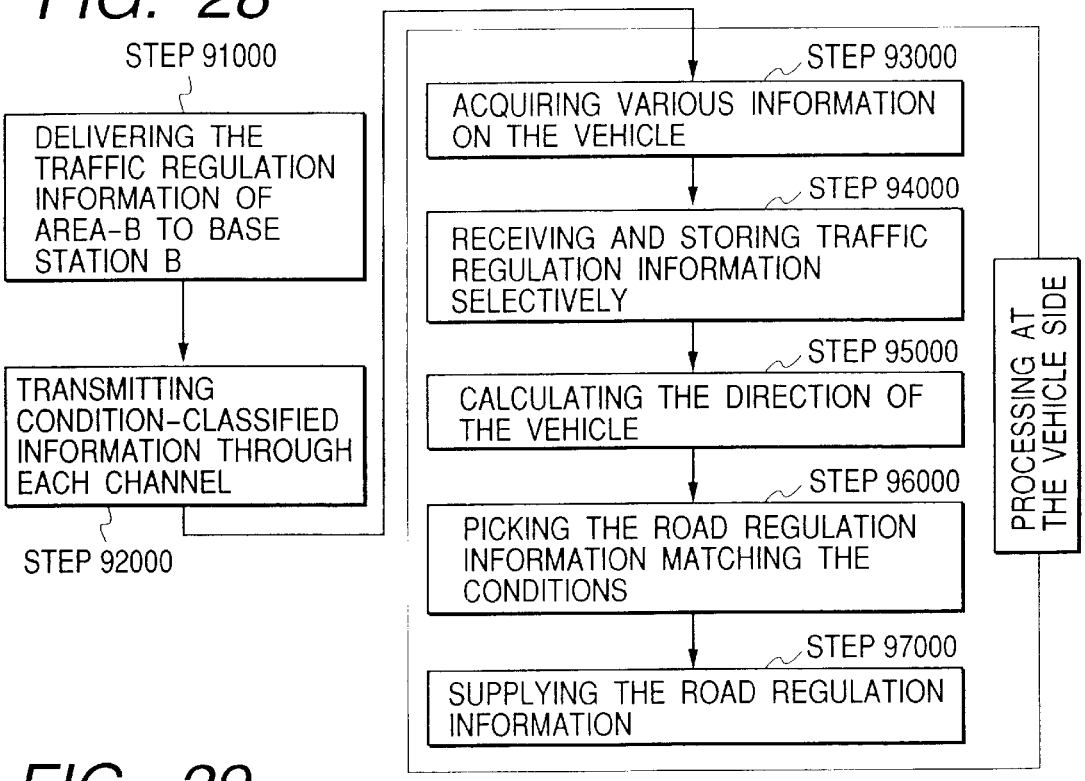
FIG. 28 shows an information providing system that manages the version of traffic regulation information.

The broadcasting hardware system and method shown in FIG. 1 can be used, instead of the broadcasting hardware system and method of FIG. 27 or 28. In that case, it is possible to form the information communications paths that enable information to be selected and received according to the current moving status of the vehicle and its future moving schedule, and thus to achieve the minimization of information storage units incapacity, associated with the transmission of the appropriate information to each vehicle.

Still another embodiment of an information providing system based on the present invention is shown in FIG. 28, wherein the version of traffic regulation information can be managed. The traffic regulation information, when entered, has its version stored into traffic information editing equipment 100000. This embodiment is characterized in that while minimizing the amount of communications information, the latest information can be stored at the vehicle side by managing the version of road regulation information DB 100100.

First, to ensure that road regulation information DB 100600 is stored at the vehicle side, there is a need to provide a large-capacity storage unit or large-capacity storage media that can store all road regulation information relating to the running areas of the vehicle. Storage media 100300 stores road regulation information DB 100600, and the media is large-capacity storage media such a CD-ROM,-DVD-ROM, or DVD-RAM.

Figure 29:
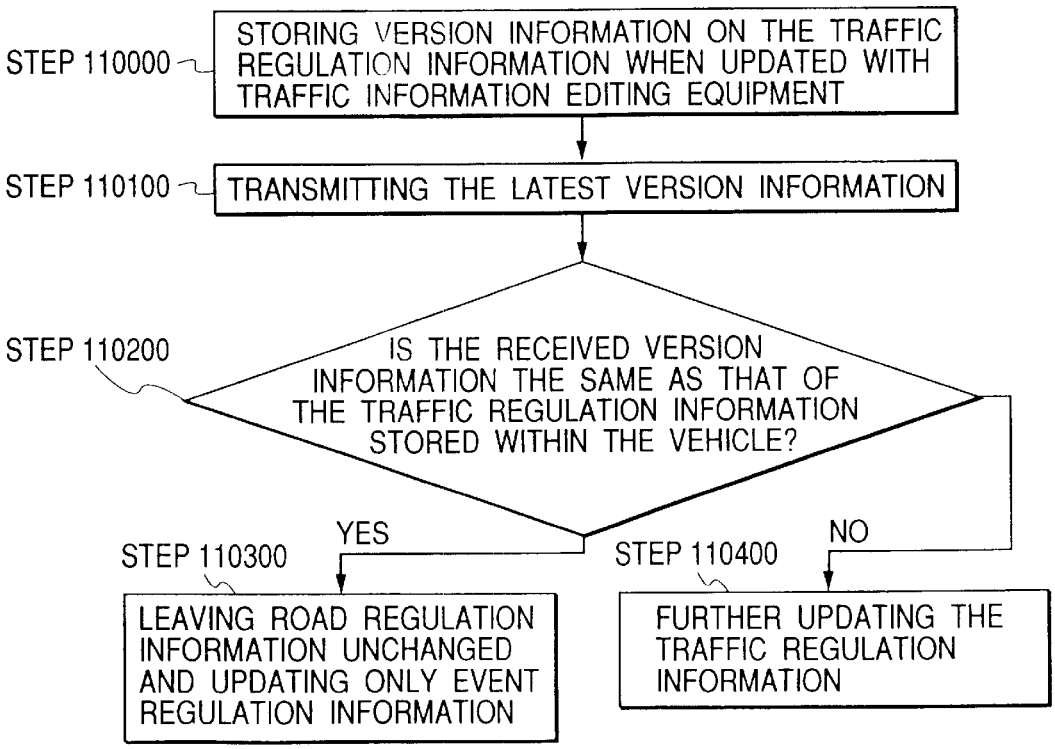
FIG. 29 is a flowchart of processing in the embodiment of FIG. 28.

FIG. 29 is a flowchart showing the flow of processing in which traffic regulation information is updated in the embodiment of FIG. 28. The flow of processing in the embodiment of FIG. 28 is described below using the flowchart of FIG. 29.

In step 110000, processing within traffic information editing equipment 100000 occurs. When road regulation information is modified, the information will be stored into road regulation information DB 100100 and at the same time, both the latest version information 100700 and road regulation information modifications associated with the version change will be delivered as differential modification information 100800 to communications base station 100200. Also, traffic information editing equipment 100000 will periodically save in storage media 100300 the road regulation information DB 100100 to which the version information has been added. Vehicle 100400 contains storage media 100300 beforehand, and the storage media is built into the appropriate loading unit (if the storage media is a CD-ROM, then a CD-ROM drive) so that information can be loaded as road regulation information DB 100600. In the case of event regulation information, information that has been edited by traffic information editing equipment 100000 is delivered as event regulation information 100500 in location/direction-specified form to communications base station 100200. In step 110100, processing in communications base station 100200 occurs. Communications base station 100200 transmits event regulation information 100500, version information 100700 relating to road regulation information and differential modification information 100800 to vehicle 100400 through radio communication. In step 110200 onward, processing occurs in the information receiving section 101000 of vehicle 100000. In step 110200, information receiving section 101000 receives version information 100700 and event regulation information 100500. At this time, if the version information contained in road regulation information DB 100600 and the version information 100700 are the same, processing will advance to step 110300, or if the two sets of version information differ, processing will advance to step 110400. In step 110300, received event regulation information 100500 is temporarily stored as event regulation information 100900. Since event regulation information 100900 is traffic information most likely to be supplied in real time, a RAM or a hard disk will need to be used as the storage unit, and when the period of supply specified in event regulation information 100900 is exceeded, the event regulation information will be erased from the storage unit. In step 110400, in addition to storage of event regulation information 100900 in step 110300, differential modification information 100800 is received and then stored together with version information 100700 into road regulation information DB 100600, in added form. At this time, if storage media 100300 is one that enables writing, such as a DVD-RAM, version information 100700 and differential modification information 100800 will be written directly onto storage media 100300 to update the version of road regulation information DB-100600. If storage media 100300 is one that does not enable writing, such as a CD-ROM or a DVD-ROM, a hard disk will be provided as another storage unit that enables writing, and version information 100700 and differential modification information 100800 will be stored onto the hard disk. For road regulation information DB 100600, however, no distinction is made between storage media 100300 and the storage unit, and both are handled as a single entity. Processing that follows the storage of the traffic regulation information is similar to processing shown in other embodiments; when the vehicle is positioned at the location where, and in the direction that, the traffic regulation information is to be supplied, the corresponding information will be called up and presented to the driver.

In this embodiment, road regulation information, although large in capacity, is low in the frequency of updating, and event regulation information is real-time information. The type of information to be stored within the vehicle, and the type of information which uses communication can be divided by utilizing the above characteristics, and thus, information traffic can be reduced.

An example of an information providing system in which the storage capacity of the storage unit within the vehicle is too small for the unit to store all traffic regulation information, especially, road regulation information, is also shown below.

The information acquired from the communications base station by the vehicle is traffic regulation information that has been classified either according to the location/direction of transmission from the vehicle and the vehicle type information relating to the vehicle, or by the locations, directions, and types of vehicles, and version information is managed for each such classification. At the vehicle side, of all received traffic regulation information and version information, only the total amount of traffic regulation information and version information that is equivalent to the available capacity of the storage unit will be actually stored into this unit. After communication has been established between the communications base station and the vehicle, when traffic regulation information is sent from the communications base station to the information receiving section of the vehicle, version information is sent first. If the vehicle contains the traffic regulation information whose version matches the received version information, the traffic regulation information will not be updated. If the vehicle does not contain the traffic regulation information whose version matches the received version information, the traffic regulation information or differential modification information will be received. At this time, if the storage unit within the vehicle has a vacancy in storage capacity, the vehicle will store the frequency of access to the classified traffic regulation information, then traffic regulation information low in the frequency of access will be deleted, and the area from which the information has been deleted will be reserved as the storage area for the received information. In other words, updating can be minimized by storing information as much as possible for the areas where the vehicle frequently runs, and even if the storage capacity is small, the latest information can be stored within the vehicle by regarding the areas where the vehicle seldom runs as the areas where the vehicle will not run in the future, either, and deleting information on these areas.

Figure 30:
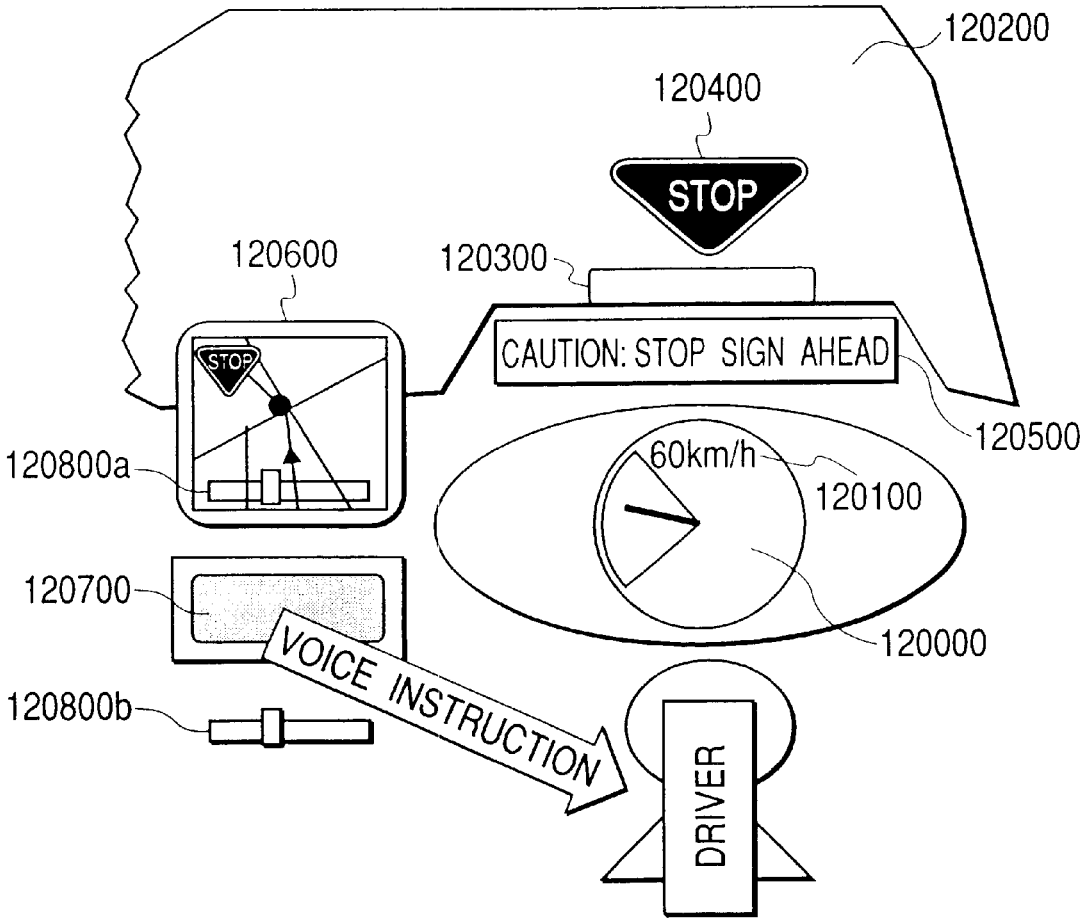
FIG. 30 shows an example of the information representation means for presenting traffic regulation information to the driver.

FIG. 30 shows an embodiment of the vehicle-mounted information representation means for presenting traffic information to the driver. Numeral 120000 in FIG. 30 denotes a speedometer. Likewise, numerals 120200 120300, 120400, 120500, 120600, and 120700 denote a front windshield, a projector for displaying video 120400, a character information display unit, another display unit, and a speaker, respectively. Also, numerals 120800*a* and 120800*b* denote information representation level adjustment controls.

This embodiment is an example in which video and audio traffic information transmission means and video/audio traffic information representation level adjustment means are shown. At least one of the representation means shown in this embodiment is provided.

Display 120100 refers to the speed limit or safe driving speed information displayed on speedometer 120000. When absolute location measuring equipment exists in the vehicle, display will be updated each time the vehicle moves and the speed regulation information contained in traffic regulation information is modified. Even if absolute location measuring equipment does not exist, display will be updated each time the speed regulation information within the traffic regulation information that was acquired during communication is modified. Thereby, speed regulation information can be timely presented to the driver. Video 120400 is a display of road regulation information, made on front windshield 120200 by projector 120300. When the vehicle runs the spot or zone that has been specified from the traffic information editing equipment as the road regulation information presenting position, video 120400 is displayed to urge the driver to drive safely. 'Stop' information, for example, is displayed continuously during the zone from the spot given as the information presenting position, to the spot where an actual 'stop' sign exists. Character information display unit 120500 represents traffic regulation information as character information, and presents the information to the driver. Information display on character information display unit 120500 is suitable for continuously presenting warning information over a fixed zone, and more specifically, this display is suitable for presenting the 'DO NOT PASS' information given as a road sign, and presenting cautionary information in zones with a succession of curves. Display unit 120006 displays traffic regulation information on maps. Information relating to road signs can be easily represented using map display. Speaker 120700 converts traffic information into audio information and presents the information to the driver. Audio indication is suitable for representing information in which the information supplying position is expressed as a point.

Information representation level adjustment controls 120800*a* and 120800*b* use one or more of said information representation means to adjust the amount of information to be presented to the driver. Information representation level adjustment control 120800*a* is displayed on display unit 120600. Although the information representation level adjustment control 120800*a* shown in this embodiment has the shape of a knob, this control can be expressed in other forms such as a table. Information representation level adjustment control 120800*b* is included as one component of the vehicle-mounted equipment. Both the 120800*a* and 120800*b* controls enable the selection of whether or not the traffic regulation information presented to the driver is to be displayed, depending on the particular attributes of the information. For example, of all road regulation information, only 'stop' information or information concerning area B can be selected by specifying the respective conditions. By providing these information representation level adjustment controls, the driver can receive the information suiting his or her purpose.

Figure 31:
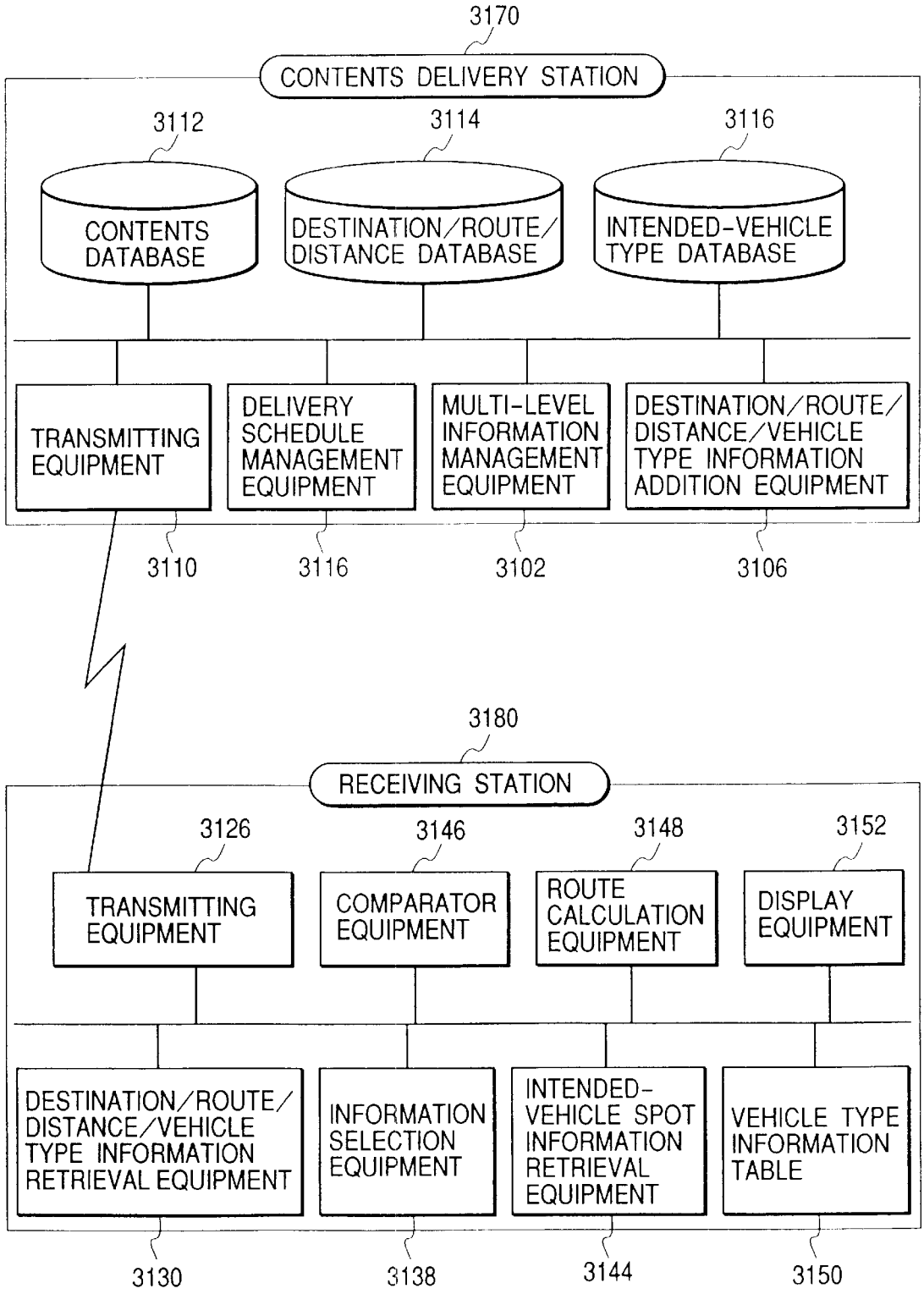
FIG. 31 is a system block diagram showing an embodiment of the present invention.

FIG. 31 is a system block diagram of another embodiment of the present invention. This embodiment is an example of supplying the optimum advertisement information according to the position where the user is present, the type of vehicle now driven by the user, and/or other particular driving factors of the user, not in the format that the same advertisement information is supplied under the same conditions by conventional advertisement information providers, irrespective of the driving factors of the user.

The system in this embodiment uses radio broadcasting infrastructure to deliver advertisement information. In other words, this system uses digital terrestrial waves, stationary satellites, hyper-elliptic orbit satellites, FM broadcasting, and/or the like.

The system has the advantages that when digital terrestrial waves or hyper-elliptic orbit satellites (HEO satellites) are used, a mechanism for controlling the directivity of antennas is not required, and that when HEO satellites are used, since, depending on the particular orbits or layout of these satellites, at least one such satellite is always positioned near the zenith, there occurs almost no dead band of radio waves due to the presence of buildings and other obstructions.

The system of FIG. 31 consists of contents delivery station 3170, from which the advertisement information provider is to deliver advertisement information, and contents receiving station 3180, at which the advertisement information delivered from contents delivery station 3170 is to be received. Information from contents delivery station 3170 to contents receiving station 3180 is delivered via radio communications infrastructure such as digital terrestrial waves, stationary satellites, and/or hyper-elliptic orbit satellites. Contents receiving station 3180 is provided in the vehicle.

Contents delivery station 3170 comprises: contents database 3112, which contains multiple sets of advertisement contents provided beforehand according to the particular driving situation of the user; destination/route/distance database 3114, which contains information on the destination spot corresponding to the user situation-specific contents stored within the contents database, on the route to the destination, and on the distance to the destination; vehicle type database 3116, which contains information on the user's vehicle size, type, and other factors corresponding to the user-situation-specific contents stored within the contents database; transmitting equipment 3110, which delivers advertisement.-contents with added information on the destination spot, the route to the destination, and the distance to the destination, or on the vehicle type; destination/route/distance/vehicle type adding equipment 3106, which adds, to the advertisement contents stored within contents database 3112, the information on destination spot, route to the destination, distance to the destination, that has been stored within destination/route/distance database 3114, and the vehicle type information stored within vehicle type database 3116; multi-level information management equipment, by which the multiple sets of advertisement contents provided beforehand according to the particular driving situation of the user are managed for each advertisement information provider, and; delivery schedule management section 3116, which manages the delivery schedules that specify what advertisement provider's information is to be delivered at what time.

Contents receiving station 3180 comprises: receiving equipment 3126 for receiving advertisement contents to which the information sent from contents delivery station 3170 has been added (namely, information on the destination spot, the route to the destination, the distance to the destination, and the type of vehicle); destination/route/distance/vehicle type information retrieval equipment 3130 for retrieving the above-mentioned information; intended-vehicle location information retrieval equipment 3144 for detecting the location of the vehicle via a GPS, gyro, or ground-installed location information transmitting/notifying equipment; route calculating equipment 3148 for calculating the destination spot, route to the destination, distance to the destination, that have been retrieved by equipment 3130 mentioned above, calculating the destination, namely, the route to the advertisement contents provider, and calculating the distance to advertisement contents provider; vehicle type information table 3150, which contains size information on the overall width, overall length, overall height, weight, and other factors of the vehicle, and information on engine types such as an LPG engine, and information on light-duty, medium-duty, and heavy-duty, and-other vehicle classes; comparator equipment 3146 for comparing the route and distance to the advertisement contents provider, calculated by route calculating equipment 3148, and the similar information retrieved by destination/route/distance/vehicle type information retrieval equipment 3130, or for comparing the vehicle type information within vehicle type information table 3150, and the similar vehicle-type information retrieved by equipment 3130; information selecting equipment 3138 for selecting only the appropriate advertisement contents according to the particular situation of the user, from all the advertisement contents that have been received on the basis of the comparisons obtained by comparator equipment 3146, and; display equipment 3152, which displays the advertisement contents selected by information selecting equipment 3138.

Next, information delivery is described below. First, a delivery instruction based on the program table scheduled for the particular advertisement contents provider is issued from delivery schedule management equipment 3116 to multi-level information management equipment 3102. In this program table, "program providing time" and "program provider" are specified. After receiving the delivery instruction, multi-level information management equipment 3102 inquires to delivery schedule management equipment 3116 about the name of the specified "program provider", and then on the basis of the results (the name of the specified "program provider"), retrieves information on the program provider (namely, the information matching the situation of the user) from contents database 3112, destination/route/distance database 3114, and vehicle database 3116. Next, an information adding instruction is issued to destination/route/distance/vehicle type adding equipment 3106. After receiving the information adding instruction, destination/route/distance/vehicle type adding equipment 3106 adds the user-situation-specific contents relating to the retrieved program provider, to the corresponding information on the destination spot, the route to the destination, the distance to the destination, and the type of vehicle. And the multiple sets of advertisement contents to which the information relating to the destination spot, the route to the destination, the distance to the destination, and the type of vehicle, has been added are transmitted from transmitting equipment 3110.

Figure 32:
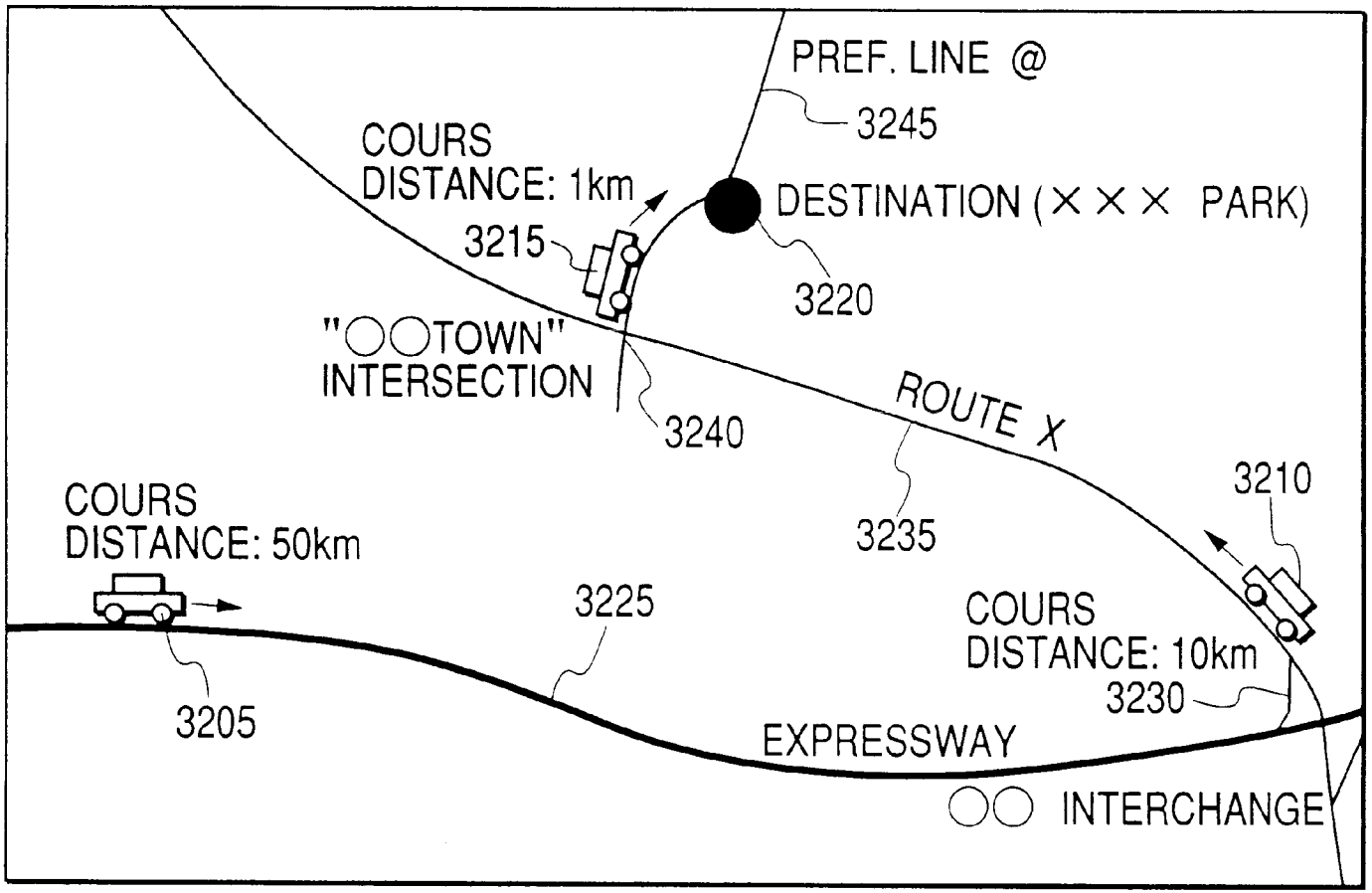
FIG. 32 is a system block diagram showing an embodiment of the present invention. FIG.

Next, examples of selecting the optimum contents on the basis of the location where the user is present are explained using FIGS. 32 to 35. FIG. 32, shows the layout of advertisement provider (ΔΔΔ Park) 3220, the locations of the vehicle (namely, location 3205 at a distance of 50 km to the advertisement provider, location 3215 at a distance of 10 km to the advertisement provider, and location. 3215 at a distance of 1 km to the advertisement provider), road (expressway) 3225, route X (3235), and prefectural road Δ(3245). FIGS. 33 to 35 show the advertisement contents to which the information relating to the destination spot, the route to the destination, the distance to the destination, has been added. Location information 3310 on the ΔΔΔ Park is included in advertisement contents 3300, 3400, and 3500.

Advertisement contents 3300 is information applied in the case that the distance to the destination ranges from 20 km to 60 km and the route to the destination is defined as "expressway (3225)→route X (3235)→prefectural road Δ(3245)". Advertisement contents 3300 consist of: "from 20 km to 60 km" as information 3320 denoting the distance to the destination (ΔΔΔ Park); "expressway (3225)→route X (3235)→prefectural road Δ(3245)"as information 3330 denoting the route to the destination (ΔΔΔ Park), and; "(1) Approx. 60 min from oo Interchange toward xx City along Route X (Congested near the Interchange) (2) Approx. 50 min from oo Interchange toward xx City along;Route X" as advertisement information 3340.

Advertisement contents 3400 is information applied in the case that the distance to the destination ranges from 2 km to 20 km and the route to the destination is defined as "expressway (3225)→route X (3235)→prefectural road Δ(3245)". Advertisement contents 3400 consist of: "from 2 km to 20 km" as information 3420 denoting the distance to the destination (ΔΔΔ Park); "expressway (3225)→route X (3235)→prefectural road Δ(3245)" as information 3430 denoting the route to the destination (ΔΔΔ Park), and; "(1) 1 km ahead after right-turn at the oo Town intersection" as advertisement information 3440.

Similarly, advertisement contents 3500 is information applied in the case that the distance to the destination is up to 2 km and the route to the destination is defined as "expressway (3225)→prefectural road Δ(3245)". Advertisement contents 3500 consist of: "up to 2 km" as information 3520 denoting the distance to the destination (ΔΔΔ Park); "expressway (3225)→prefectural road A (3245)"as information 3530 denoting the route to the destination (ΔΔΔ Park), and; "Parking Lot #1: Occupied Parking Lot #2: Occupied Parking Lot #3: Occupied Parking Lot #4: Occupied" as advertisement information 3540.

Processing within the contents receiving station of the intended vehicle (vehicle 3205, 3210, or 3215) is described below. The vehicle has contents receiving station 3180 and activates receiving equipment 3126 to receive from the contents delivery station the multiple sets-of advertisement contents (namely advertisement contents 3300, advertisement contents 3400, and advertisement contents 3500) that have been provided beforehand for the particular situation of the user (the route and distance to the advertisement information provider). Information on the destination spot, the route to the destination, the distance to the destination, and the type of vehicle, is then retrieved from each such received set of advertisement contents by destination/route/distance/vehicle type information retrieval equipment 3130. Subsequently, on the basis of the vehicle location information that was retrieved from intended-vehicle location information retrieval equipment 3144, and of the destination information that was retrieved from equipment 3130, the route to the destination and the distance to the destination are calculated by route calculating equipment 3148. Next, comparator equipment 3146 judges whether the route to the destination, calculated above by route calculating equipment 3148, is included in the "route to the destination" information that was retrieved by equipment 3130, and whether the distance to the destination, calculated above by route calculating equipment 3148, is included in the "distance to the destination" information that was retrieved by equipment 3130, and if these conditions are satisfied, the. corresponding advertisement contents will be selected by information selecting equipment 3138 and displayed at the terminal of display equipment 3152.

First, for vehicle 3205, that is, when the intended vehicle is present at a distance of about 50 km from advertisement provider 3220 (ΔΔΔ Park), if route calculating equipment 3148 has already derived "expressway (3225)→route X (3235)→prefectural road Δ(3245)" as the route to the destination and calculated the distance to the destination as 50 km, comparator 3146 compares these values and each set of contents (the distances 3320, 3420, and 3520 to the destination, and the routes 3330, 3430, and 3530 to the destination; more specifically, the "route to the destination" information that was retrieved from advertisement contents 3300, namely, "expressway (3225) →route X (3235) →prefectural road Δ(3245)" is the same as the derived "route to the destination", namely, "expressway (3225) →route X (3235)→prefectural road Δ(3245)", and the "distance to the destination" information that was retrieved from advertisement contents 3300, namely, "20 km to 60 km" is included in the calculated "distance to the destination" information, namely, "50 km").

After that, information selecting equipment 3138 selects the corresponding advertisement contents 3300, and then display equipment 3152 displays the advertisement information 3340 "(1) Approx. 60 min from oo Interchange toward xx City along Route X (Congested near the Interchange) (2) Approx. 50 min from AA Interchange toward xx City along Route X".

Next, for vehicle 3210, that is, when the intended vehicle is present at a distance of about 10 km from advertisement provider 3220 (ΔΔΔ Park), if route calculating equipment 3148 has already derived "expressway (3225)→prefectural road Δ(3245)"as the route to the destination and calculated the distance to the destination as 10 km, comparator 3146 compares these values and each set of contents (the distances 3320, 3420, and 3520 to the destination, and the routes 3330, 3430, and 3530 to the destination; more specifically, the "route to the destination" information that was retrieved from advertisement contents 3400, namely, "expressway (3225) →route X (3235)→prefectural road Δ(3245)"includes the derived "route to the destination", namely, "expressway (3225) prefectural road Δ(3245)", and the "distance to the destination" information that was retrieved from advertisement contents 3400, namely, "2 km to 20 km" is included in the calculated "distance to the destination" information, namely, "10 km").

After that, information selecting equipment 3138 selects the corresponding advertisement contents 3400, and then display equipment 3152 displays the advertisement information 3440 "(1) 1 km ahead after right-turn at the oo Town intersection. Congested near the oo Town Intersection".

Likewise, for vehicle 3215, that is, when the intended vehicle is present at a distance of about 1 km from advertisement provider 3220 (ΔΔΔ Park), if route calculating equipment 3148 has already derived "prefectural road Δ(3245)"as the route to the destination and calculated the distance to the destination as 1 km, comparator 3146 compares these values and each set of contents (the distances 3320, 3420, and 3520 to the destination, and the routes 3330, 3430, and 3530 to the destination; more specifically, the "route to the destination" information that was retrieved from advertisement contents 3500, namely, "expressway (3225) →prefectural road Δ(3245)"includes the derived "route to the destination", namely, "prefectural road Δ (3245)", and the "distance to the destination" information that was retrieved from advertisement contents 3500, :namely, "2 km" is included in the calculated "distance to the destination" information, namely, "1 km").

After that, information selecting equipment 3138 selects the corresponding advertisement contents 3500, and then display equipment 3152 displays the advertisement information 3540 "Parking Lot #1: Occupied Parking Lot #2: Occupied Parking Lot #3: Occupied Parking Lot #4: Occupied".

Thus, the user can select, from the information delivered by the advertisement information provider, only the necessary and appropriate information according to the particular location and route of the vehicle.

Figure 36:
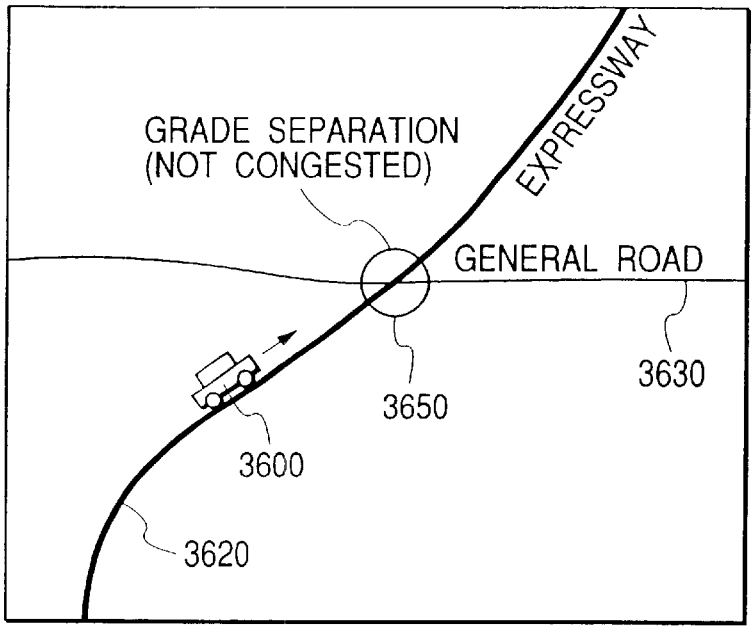
FIG. 36 shows an example of route calculation based on the linked relationship between roads.
Figure 37:
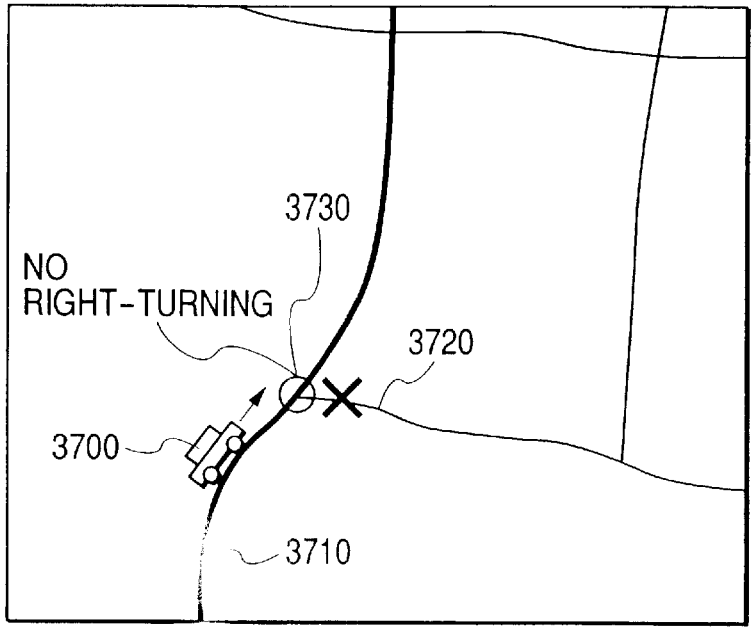
FIG. 37 shows an example of route calculation based on traffic regulation information.
Figure 38:
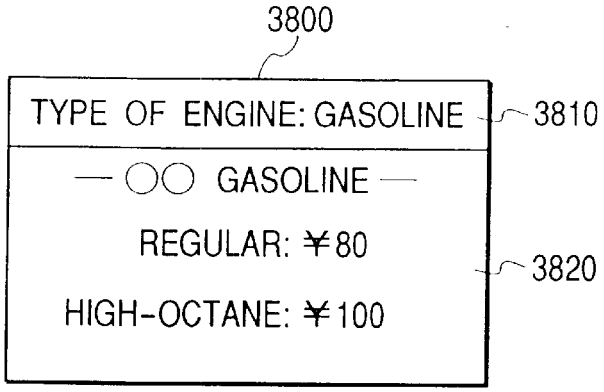
FIG. 38 shows an example in which independent advertisement contents are supplied for each type of vehicle.
Figure 39:
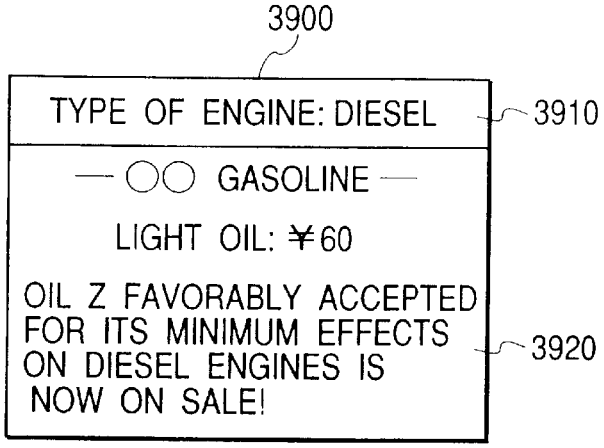
FIG. 39 shows an example in which independent advertisement contents are supplied for each type of vehicle.
Figure 40:
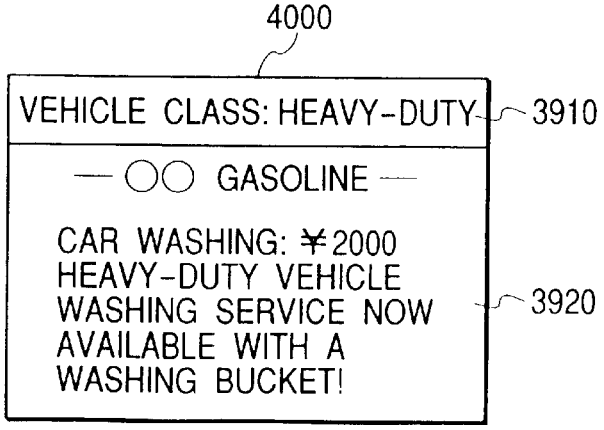
FIG. 40 shows an example in which independent advertisement contents are supplied for each type of vehicle.

Next, the way the route to the advertisement information provider is derived by route calculating equipment 3148 is described using FIGS. 36 and 37. An example of route calculation based on the linked relationship between roads is shown in FIG. 36, and an example of route calculation based on traffic regulation information is shown in FIG. 37.

In. FIG. 36, general road 3630 and expressway 3620 are shown and both intersect as a grade separation at spot 3650. Between general road 3630 and expressway 3620, there can be no traffic at spot 3650. If vehicle 3600 is running on expressway 3620, such a route is derived that-does not enable the driver to enter general road 3630 by turning to the left or right at spot 3650, since a linked relationship exists between roads. Also, when vehicle 3600 is running on expressway 3620, a route is always derived that takes the same direction as the actual traveling direction of the vehicle.

In FIG. 37, roads 3710 and 3720 are connected at T-intersection 3730, and turning to the right at T-intersection 3730 is prohibited. Vehicle 3700 is present this side of T-intersection 3730 and cannot turn right to enter road 3720. Therefore, a route is derived that does not enable vehicle 3700 to turn right to enter road 3720.

In other words, during route calculation, it is necessary to take into account the linked relationship between roads, the traveling direction of the vehicle, traffic regulation information, and other factors. Thus, the user can acquire the optimum information according to place, position, and route.

Next, examples of supplying independent advertisement contents for each type of vehicle (for each engine type or for each vehicle scale in terms of loading capability, such as a light-duty, medium-duty, or heavy-duty vehicle) are explained using FIGS. 38 to 43. These examples are for a filling station to select the necessary advertisement contents, depending on whether the engine of the customer 's vehicle is of the gasoline type or the diesel type or on whether the corresponding vehicle is a light-duty, medium-duty, or heavy-duty vehicle in terms of loading capability. Advertisement contents 3800 intended for "gasoline" engine vehicles, advertisement contents 3900 intended for "diesel" engine vehicles, advertisement contents 4000 intended for "heavy-duty" vehicles, and advertisement contents 4100 intended for "medium-duty" vehicles are available as the contents delivered by filling stations. Advertisement contents 3800 are further divided into engine-classified information 3810 "Gasoline" and advertisement contents 3820 "Regular oil: ¥80 High-octane gasoline: ¥100". Likewise, advertisement contents 3900 are further divided into engine-classified information 3910 "Light oil" and advertisement contents 3920 "Light oil: ¥60 Oil Z favorably accepted for its minimum effects on diesel engines is now on sale→"; advertisement contents 4000 into scale-classified information 4010 "Heavy-duty vehicle" and advertisement contents 4020 "Car washing: ¥2000 Heavy-duty vehicle washing service now available with a washing bucket→", and; advertisement contents. 4100 into scale-classified information 4110 "Medium-duty vehicle" and advertisement contents 4120 "Car washing: ¥1000 Medium-duty vehicle washing service now available with tissue paper→".

Processing for advertisement contents selection based on the vehicle type information that was added to advertisement contents is described below. Vehicle type information on the vehicle is recorded in a vehicle type table beforehand.

For example, for a heavy-duty vehicle equipped with a diesel engine, vehicle type information on this vehicle (namely, "Engine type: Diesel, Loading scale: Heavy-duty") is specified in vehicle type information table 3150 beforehand.

When the advertisement contents 3800, 3900, 4000, and 4100 for a filling station are delivered from contents delivery station 3170, the vehicle (contents receiving station 3180) will receive the advertisement contents via receiving equipment 3126, retrieve only vehicle type information among all the received advertisement contents via destination/route/distance/vehicle type information retrieval equipment 3130, compare the retrieved vehicle type information and the internal vehicle type information of the vehicle type table via comparator equipment 3146, select advertisement contents based on comparison results via information selecting equipment 3138, and display the selected advertisement contents at the terminal of display equipment 3152.

For example, for a heavy-duty vehicle equipped with a diesel engine, the vehicle (contents receiving station 3180) compares the received advertisement contents (engine-classified information 3810 and 3910) and the information contained in vehicle type information table 3150 (namely, "Engine type: Diesel, Loading scale:

Heavy-duty") . . . in the above case, engine-classified information 3910 "Diesel" within received contents 3900 and the engine-classified information "Diesel" within vehicle type information table 3150 are the same, and engine-classified information 4010 "Diesel " within received contents 4000 and the engine-classified information "Diesel" within vehicle type information table 3150 are the same . . . and then advertisement-contents 3900 on diesel engines and advertisement contents 4000 on heavy-duty vehicles are selected by information selecting equipment 3138. Finally, "Fuel price: ¥60/1 (Light oil) Car washing: ¥2000 Heavy-duty vehicle washing service now available with a washing bucket→" is displayed as information 4200 at the terminal of display equipment 3152.

Figure 42:
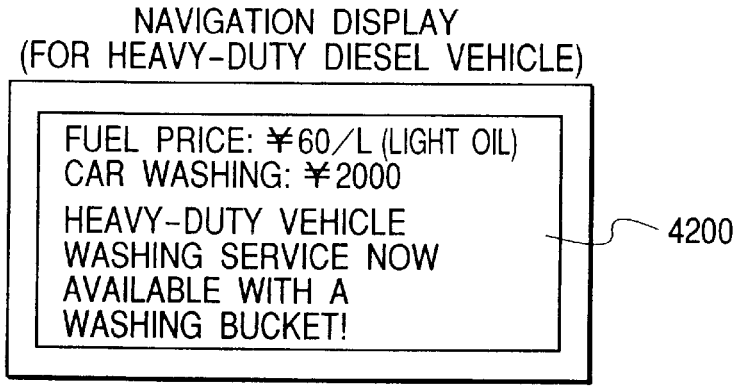
FIG. 42 shows an example in which independent advertisement contents are supplied for each type of vehicle.
Figure 43:
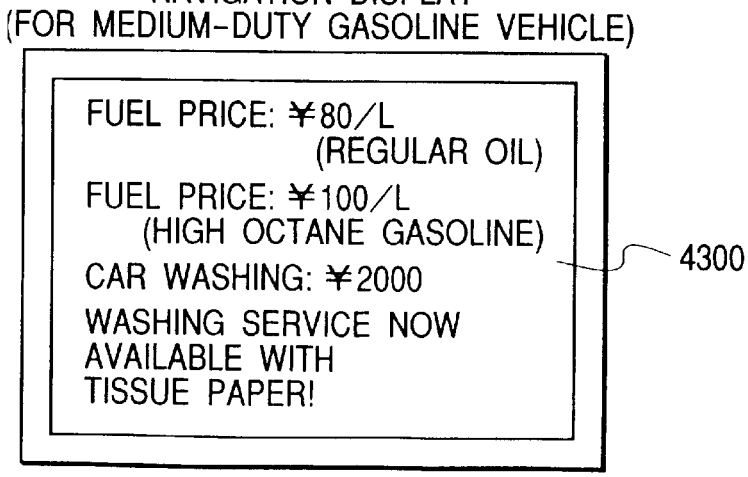
FIG. 43 shows an example in which independent advertisement contents are supplied for each type of vehicle.
Figure 44:
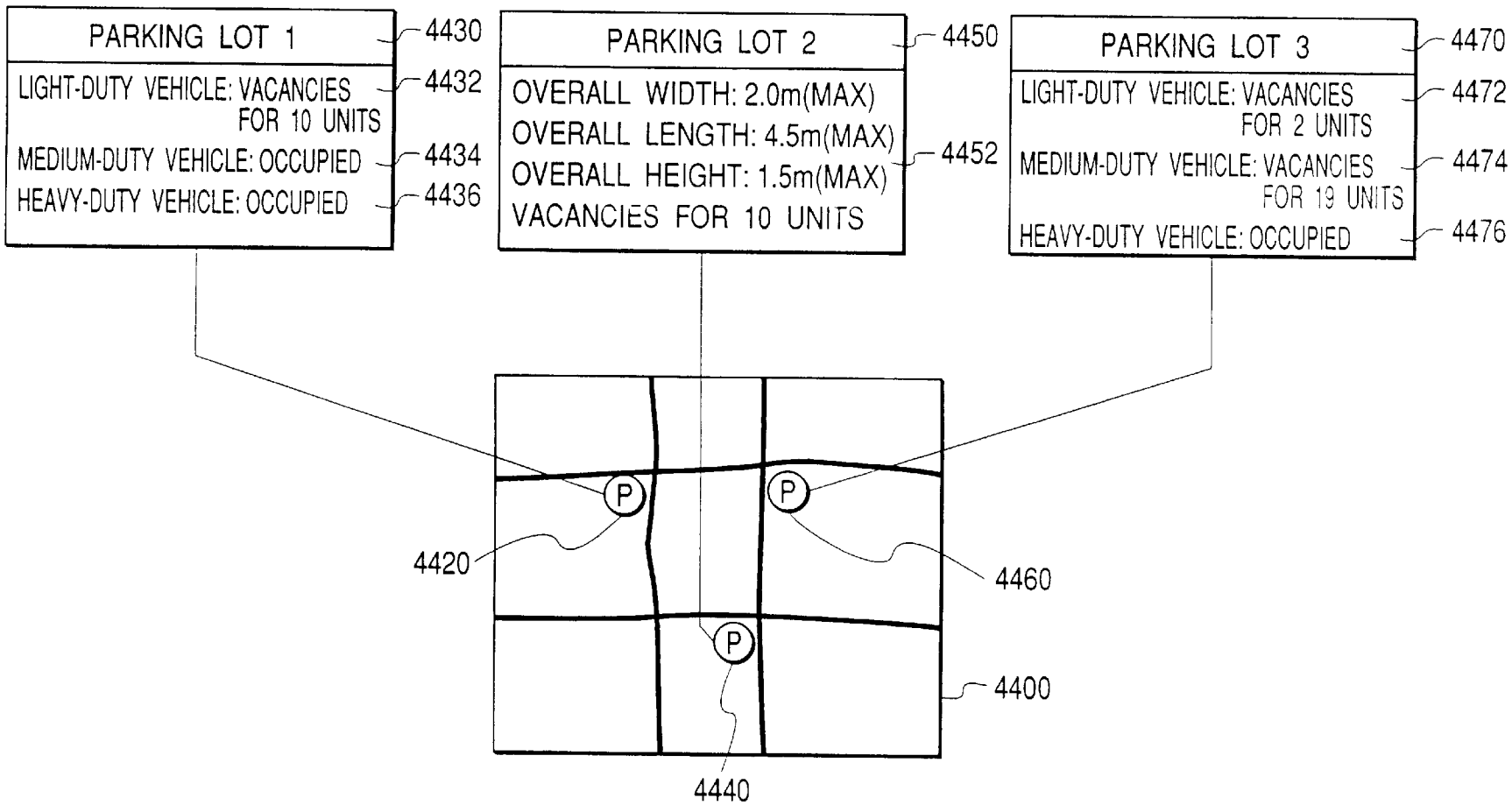
FIG. 44 shows the layout of three information providing-sources and the contents of the corresponding information.

See FIG. 42.

Next, for a medium-duty vehicle equipped with a gasoline engine, the vehicle (contents receiving station 3180) compares the received advertisement contents (engine-classified information 3810 and 3910) and the information contained in vehicle type information table 3150 (namely, "Engine type: Gasoline, Loading scale:

Medium-duty") . . . in the above case, engine-classified information 3810 "Gasoline" within received contents 3800 and the engine-classified information 3810 "Gasoline" within vehicle type information table 3150 are the same, and engine-classified information 4110 "Medium-duty" within received contents 4100 and the engine-classified. information "Medium-duty" within vehicle type information table 3150 are the same . . . and then advertisement contents 3800 on gasoline engines and advertisement contents. 4100 on medium-duty vehicles are selected by information selecting equipment 3138. Finally, "Fuel price: ¥80/1 (Regular oil) Fuel price: ¥100/1 (High-octane gasoline) Car washing: ¥2000 Medium-duty vehicle washing service now available with tissue paper→" is displayed as information 4300 at the terminal of display equipment 3152 See FIG. 43.

Thus, the user can select, from the information delivered by the advertisement information provider, only the necessary and appropriate information according to the particular type of vehicle.

Figure 41:
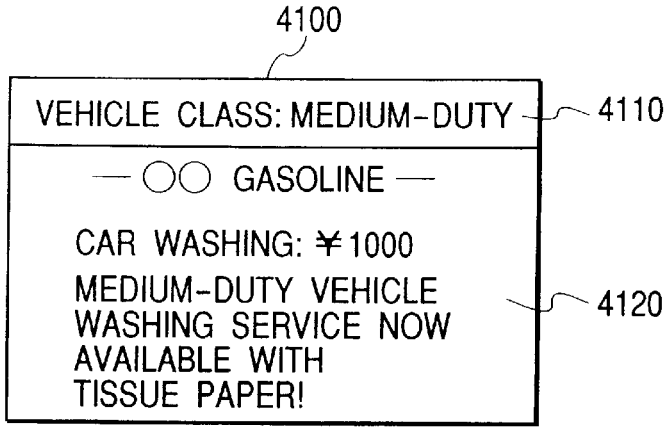
FIG. 41 shows an example in which independent advertisement contents are supplied for each type of vehicle.

Next, the case in which the advertisement information provider is an owner or runner of three parking lots is considered below. The layout of the three parking lots and details of the information delivered about these parking lots are shown in FIG. 41. The three parking lots. . . parking lot

#1: 4420, parking lot #2: 4440, parking lot #3: 4460 . . . are all present on map 4400.

Parking status information 4430 on parking lot #1 is divided into light-duty vehicle parking status information 4432 "Vacancies for 10 units", medium-duty vehicle parking status information 4434 "Occupied", and heavy-duty vehicle parking status information 4436 "Occupied", according to loading scale, and the above three sets of advertisement contents (light-duty vehicle parking status information 4432, medium-duty vehicle parking status information 4434, and heavy-duty vehicle parking status information 4436) are delivered for parking lot #1.

Parking status information 4450 on parking lot #2 consists only of parking status information 4452 on vehicles measuring "Overall width: 2.0 m (max), Overall length: 4.5 m (max), Overall height: 1.5 m (max)". Therefore, one set of advertisement information (parking status information 4452 on vehicles measuring "Overall width: 2.0 m (max), Overall length: 4.5 m (max), Overall height: 1.5 m (max)": Vacancies for 10 units) is delivered for parking lot #2.

Parking status information 4470 on parking lot #3 is divided into light-duty vehicle parking status information 4472 "Vacancies for 2 units", medium-duty vehicle parking status information 4474 "Vacancies for 19 units", and heavy-duty vehicle parking status information 4476 "Occupied", according to loading scale, and the above three sets of advertisement contents (light-duty vehicle parking status information 4472, medium-duty vehicle parking status information 4474, and heavy-duty vehicle parking status information 4476) are delivered for parking lot #3.

Processing for advertisement contents selection based on the vehicle type information that was added to advertisement contents is the same as described in the foregoing example of advertisement contents delivery at a filling station.

Next, the case in which the vehicle is a light-duty vehicle measuring 1.2 m in overall width, 3.5 m in overall length, and 1.2 m in overall height is considered below. Vehicle type information on this vehicle (namely, "Dimensions: 1.2 m in overall width, 3.5 min overall length, and 1.2 m in overall height, Loading scale: Light-duty vehicle") is recorded in vehicle type information table 3150.

Figure 45:
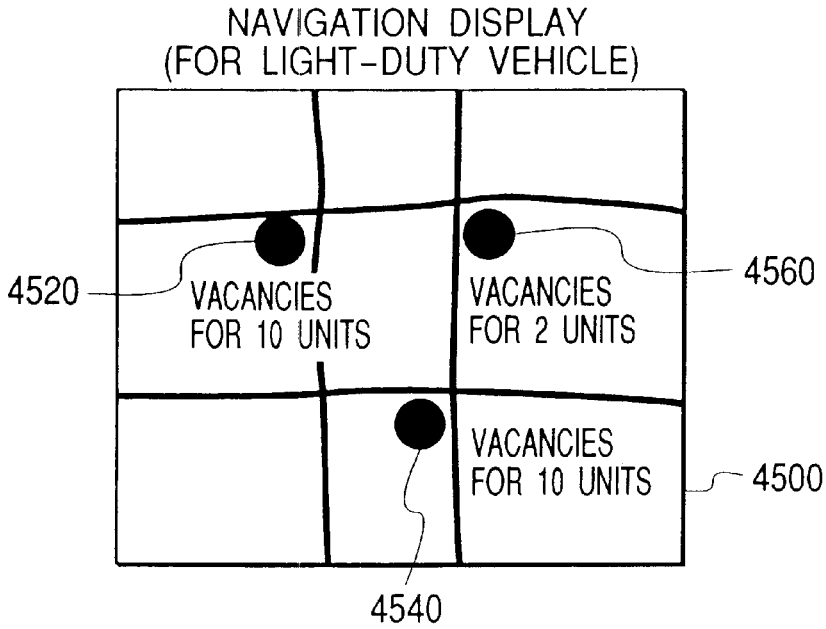
FIG. 45 shows a map.

The vehicle (contents receiving station 3180) compares the loading scale-classified information and size-classified information within the received advertisement contents, and the information contained in vehicle type information table 3150 (namely, "Dimensions: 1.2 m in. overall width, 3.5 m in overall length, and 1.2 m in overall height, Loading scale: Light-duty vehicle") . . . in the above case, loading scale-classified information "Light-duty vehicle" within received contents 4432 and the loading scale-classified information "Light-duty vehicle" within vehicle type information table 3150 are the same, and the size-classified information "Dimensions: 1.2 m in overall width, 3.5 m in overall length, and 1.2 m in overall height" within vehicle type information table 3150 is included in the size-classified information "Overall width: 2.0 m (max), Overall length: 4.5 m (max), Overall height: 1.5 m (max)"within received contents 4432 . . . and then advertisement contents 4432 and 4472 on light-duty vehicles and advertisement contents 4452 on vehicles measuring 2.0 m (maximum) in overall width, 4.5 m (maximum) in overall length, and 1.5 m (maximum) in overall height are selected by information selecting equipment 3138. Finally, as with the display on map 4500 of FIG. 45, information 4520 "Parking lot #1: Vacancies for 10 units", information 4540 "Parking lot #2: Vacancies for 10 units", and information 4560 "Parking lot #3: Vacancies for 2 units" are displayed at the terminal of display equipment 3152.

Furthermore, the case in which the vehicle is a medium-duty vehicle measuring 1.8 m in overall width, 4.2 m in overall length, and 1.3 m in overall height is considered below. Vehicle type information on this vehicle (namely, "Dimensions: 1.8 m in overall width, 4.2 m in overall length, and 1.3 m in overall height, Loading scale: Medium-duty vehicle") is recorded in vehicle type information table 3150.

Figure 46:
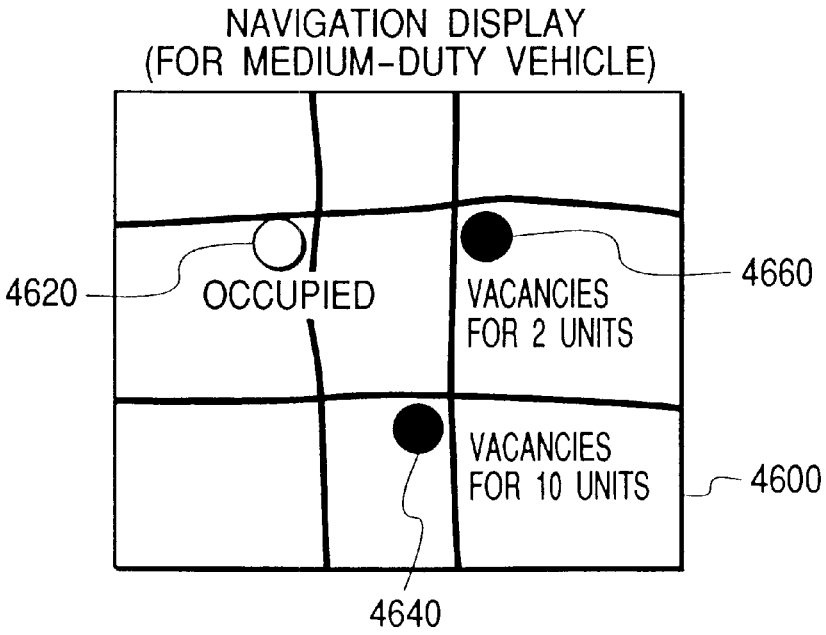
FIG. 46 shows a map.

The vehicle (contents receiving station 3180) compares the loading scale-classified information and size-classified information within the received advertisement contents, and the information contained in vehicle type information table 3150 (namely, "Dimensions: 1.8 m in overall width, 4.2 m in overall length, and 1.3 m in overall height, Loading scale: Medium-duty vehicle") . . . in the above case, loading scale-classified information "Medium-duty vehicle" within received contents 4434 and the loading scale-classified information "Medium-duty vehicle" within vehicle type information table 3150 are the same, and the size-classified information "1.8 m in overall width, 4.2 m in overall length, and 1.3 m in overall height" within vehicle type information table 3150 is included in the size-classified information "Overall width: 2.0 m (max), Overall length: 4.5 m (max), Overall height: 1.5 m (max)"within received contents 4432 . . . and then advertisement contents 4434 and 4474 on medium-duty vehicles and advertisement contents 4452 on vehicles measuring 2.0 m (maximum) in overall width, 4.5 m (maximum) in overall length, and 1.5 m (maximum) in overall height are selected by information selecting equipment 3138. Finally, as with the display on map 4600 of FIG. 46, information 4620 "Parking lot #1: Occupied", information 4640 "Parking lot #2: Vacancies for 10 units", and information 4660 "Parking lot #3: Vacancies for 2 units" are displayed at the terminal of display equipment 3152.

Thus, the user can select, from the information delivered by the advertisement information provider, only the necessary and appropriate information according to the particular type of vehicle.

Figure 47:
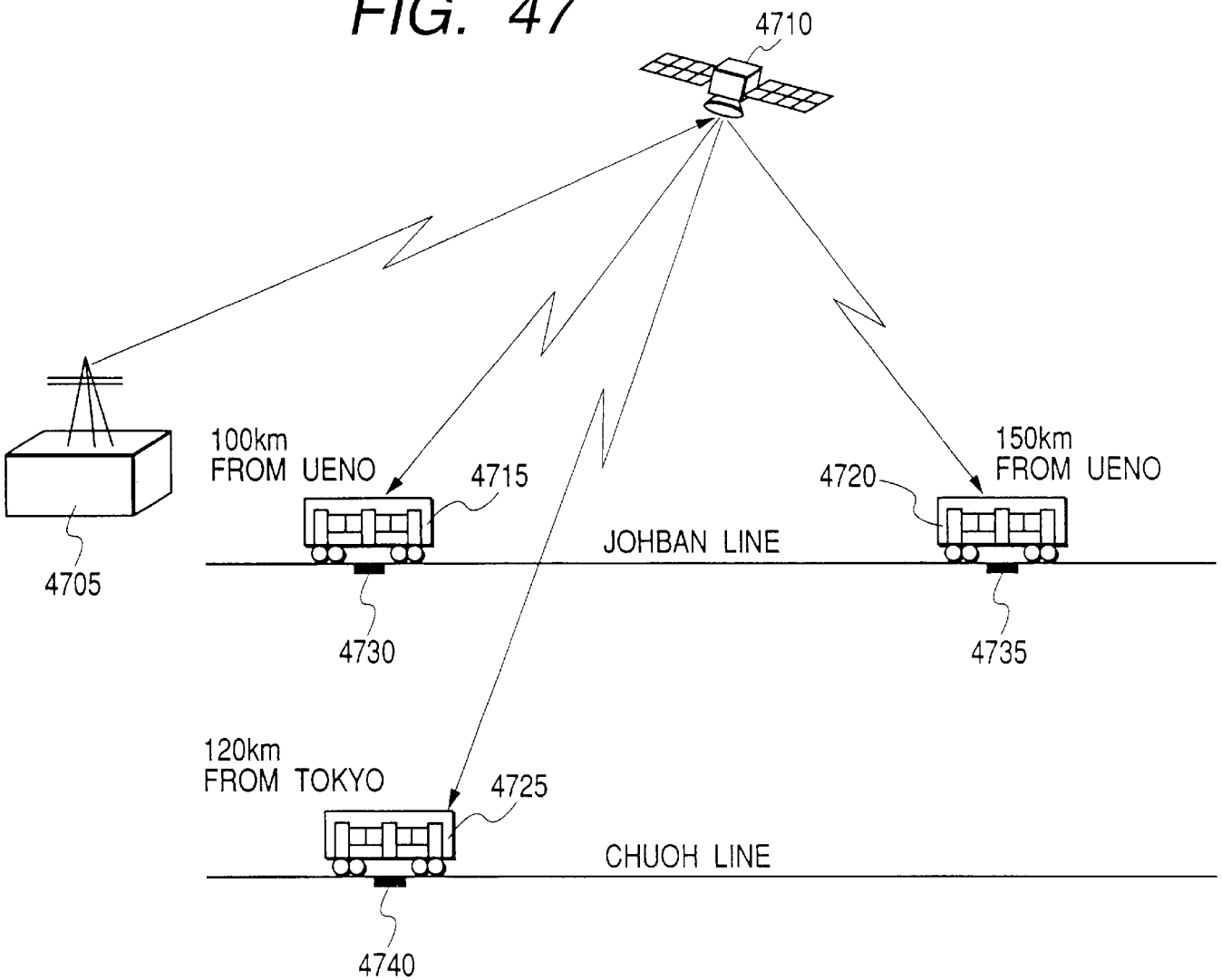
FIG. 47 is a diagram that outlines one method of supplying tourist guidance information intended for trains.

Next, examples in which a railway business company supplies trains with information for each railway line or for each distance from the starting points of trains are considered. In these examples, sight-seeing guidance information concerning the nearest station from the current location of each train running on various lines is supplied to the trains by a railway business company. FIG. 47 outlines a method of supplying sight-seeing guidance information to the trains mentioned above. The railway business company supplies sight-seeing guidance information from information delivery station 4705 to trains 4715, 4720, and 4725, via HEO satellite 4710. At this time, trains 4715, 4720, and 4725 acquire-the distances from the respective starting points via transponders 4730, 4735, and 4740 provided to supply information on the distance from the starting point of each train. Subsequently, the sight-seeing guidance information required for the trains is acquired using the distance information that has been acquired above, and the line information stored within the trains.

Trains 4715 and 4720 are now running on the Johban Line, and train 4715 is present at a distance of 100 km from Ueno Station, the starting point of the train, and train 4715 is present at a distance of 150 km from Ueno Station, which is also the starting point of the train. Train 4740 is now running on the Chuoh Line, and this train is present at a distance of 120 km from Ueno Station, the starting point of the train.

Delivery of sight-seeing guidance information from information delivery station 4705 is described below. Information delivery station 4705 has; a group of contents consisting of stored sight-seeing guidance information; line information for limiting the contents providing destinations; line information to become the basis for supplying information relating to the distances from the starting points of trains, and; distance information, which represents the distances from the starting points of trains.

Information delivery station 4705 adds the corresponding line information and distance information to each set of contents, and then delivers these contents. The sight-seeing guidance contents with the added line information and distance information, are delivered to trains 4715, 4720, and 4725 via HEO satellite 4710. Trains 4715, 4720, and 4725 contain the information relating to the respective running lines. Trains 4715, 4720, and 4725 also acquire distance information from transponders 4730, 4735, and 4740. Trains 4715, 4720, and 4725 compare the line information that was added to the contents to be delivered, and the line information stored within the respective trains, and also compare the distance information that was added to the contents, and the distance information obtained from transponders 4730, 4735, and 4740 . . . Only the contents that have matched in the details of the above information are selected and displayed on a monitor, which is provided to display sight-seeing guidance information in the train, or on an electronic bulletin board.

For example, the case in which train 4715 now running on the Johban Line and present at a distance of 100 km from Ueno Station is to receive sight-seeing guidance information is considered. FIGS. 48 to 50 show the contents 4800, 4900, and 5000 delivered from delivery station 4705. Contents 4800 are intended for the train now running on the Johban Line and present at a distance of 100 km from Ueno Station (starting point), contents 4900 are intended for the train now running on the Johban. Line and present at a distance of 150 km from Ueno Station, and contents 5000 are intended for the train now running on the Johban Line and present at a distance of 120 km from Ueno Station. Contents 4800 contain "Johban Line" as line information 4810, "100 km from Ueno" as distance information 4820, and "Mito Festival now taking place at: Mito Park (2-min walk from Mito Station)" as sight-seeing guidance information. Contents 4900 contain "Johban Line" as line information 4910, "150 km from Ueno" as distance information 4920, and "Iwaki Fireworks on Aug. 15 Iwaki Park: 5-min walk from Iwaki Station" as sight-seeing guidance information. Contents 5000 contain "Chuoh Line" as line information 5010, "120 km from Ueno" as distance information 5020, and "Grape Festival now taking place at: Grape Park (5-min walk from Kouhu Station" as sight-seeing guidance information.

Train 4715 acquires the distance information "100 km from Ueno" from transponder 4730. Subsequently, comparisons are performed between the distance information "100 km from Ueno" and the distance information that was added to the contents to be delivered, and between the line information "Johban Line" stored within train 4715 and the. line information that was added to the contents to be delivered. Next, the contents 4800 that have matched in the details of the above information are selected. Finally, the sight-seeing guidance information 4830 "Mito Festival now taking place at: Mito Park (2-min walk from Mito Station)" within the selected contents 4800 is displayed on the monitor or electronic bulletin board within the train.

Next, the case in which train 4725 now running on the Chuoh Line and present at a distance of 120 km from Tokyo is to receive sight-seeing guidance information is considered.

Train 4725 acquires the distance information "120 km from Tokyo" from transponder 4740. Subsequently, comparisons are performed between the distance information "120 km from Tokyo" and the distance information that was added to the contents to be delivered, and between the line information "Chuoh Line" stored within train 4725 and the line information that was added to the contents to be delivered. Next, the contents 5000 that have matched in the details of the above information are selected. Finally, the sight-seeing guidance information 5030 Grape Festival now taking place at: Kouhu Park (5-min walk from Kouhu Station)" within the selected contents 5000 is displayed on the monitor or electronic bulletin board within the train.

Thus, the optimum information can be supplied to each of multiple trains running on different lines and present at different locations.

[Effects of the Invention]

According to the present invention, it is possible, by transmitting information via broadcast communications and then selecting received information according to the current moving status of mobile bodies and their future moving schedules, to create an environment under which the appropriate information can be presented according to the particular situation of each mobile body.

The present invention also enables the following to be implemented:

Selecting and transmitting information according to the particular approaching relationship with respect to a mobile body Selecting and transmitting information according to the particular influence relationship with respect to an event It is easy to supply traffic regulation information to the driver by creating electronic traffic regulation information databases using traffic information editing equipment based on the present invention.

In an information providing system based on the present invention, casualties due to oversight of road signs or the like by the driver can be minimized by supplying traffic regulation information to the driver.

Also, in another information providing system based on the present invention, since traffic regulation information is presented in integratedly managed form to the driver, there is no need to install road signs on actual roads, even when information is to be updated again.

In addition, in a still another information providing system based on the present invention, acquired traffic regulation information or the traffic regulation information stored within the vehicle can be timely presented from the appropriate location to the driver by providing a means of acquiring absolute location information. Furthermore, it is possible to reduce the necessity for the installation of communications equipment at each information presentation point and thus to reduce significantly the traffic information transmitting equipment to be installed on roads.

Furthermore, in a still another information providing system based on the present invention, communications traffic and processing inside the vehicle can be reduced by supplying regulation information limited to each area only.

What is claimed is:

1. An information broadcasting method comprising:

adding, to each of a plurality of information contents to be broadcast, location information specifying spots or areas for which the information content is intended, and timing information specifying the effective time-of-day/available hours of the information content;

broadcasting the information contents with the added location information and timing information;

receiving the broadcast information by a mobile unit;

retrieving first information that specifies a spot or area where the mobile unit currently exists, or spots or areas where the mobile unit is likely to exist in the future;

retrieving the location information for each information content in the received broadcast information as second information;

retrieving third information that specifies time-of-day corresponding to the spot or area where the mobile unit currently exists, or corresponding to spots or areas where the mobile unit is likely to exist in the future;

retrieving the timing information for each information content in the received broadcast information as fourth information;

comparing the first information and the second information, and comparing the third information and the fourth information;

selecting among the received broadcast information contents on the basis of the comparison results; and displaying the selected information contents.

2. The information broadcasting method of claim 1, wherein a coverage area is segmented into areas not overlapping each other, and intended areas are specified by designating the segmented areas.

3. The information broadcasting methods of claim 1, wherein intended areas are specified by designating defined areas.

4. The information broadcasting method of claim 1, wherein the selecting step includes prioritizing among multiple received information contents, and the displaying step includes displaying the received information contents either in a defined order of priority or together with information relating to priority of the displayed information contents.

5. A broadcast transmitting apparatus comprising:

equipment for providing information contents describing a plurality of destination spots or areas;

equipment for adding, to the information contents, location information specifying spot or area for which each information content is intended;

equipment for providing timing information specifying the effective time-of-day/available hours of each information content;

equipment for adding the timing information to the information contents; and transmitting equipment for broadcasting the information contents with the added location information and timing information.

6. A broadcast receiving apparatus for a mobile unit for receiving broadcast information, the broadcast information including information contents together with location information specifying spots or areas for which each information content is intended, and timing information specifying the effective time-of-day/available hours of each information content, the receiving apparatus comprising:

receiving equipment for receiving the broadcast information;

equipment for retrieving first information specifying a spot or area where the mobile unit currently exists and spots or areas defining an intended travel route of the mobile unit;

equipment for retrieving the location information that has been added to the broadcast information as second information;

equipment for retrieving third information that specifies time-of-day corresponding to the spot or area where the mobile unit currently exists, or to the spots or areas where the mobile unit is likely to exist in the future;

equipment for retrieving the timing information for each information content in the received broadcast information as fourth information;

comparator equipment for comparing the first information and second information and for comparing the third and fourth information;

information selection equipment for selecting among the received information contents on the basis of an output of the comparator equipment; and equipment for displaying the selected information contents.

7. The broadcast transmitting apparatus of claim 5, wherein the equipment for providing timing information provides traveling route information of a mobile body by treating the traveling route as information transmission spots, and sets the effective time-of-day or available hours of information of the mobile body on the basis of scheduled time of day present at the spots on the traveling route of the mobile body.

8. A broadcast transmission apparatus of claim 5, wherein an information content describes an event, and wherein a range of influence of the event is specified as the location information of the information content, and a duration of the event is specified as the available hours of the information content.

9. A traffic information editing equipment comprising:

a means for inputting traffic regulation information including road regulation information and event regulation information, wherein road regulation information includes regulation information shown as road signs and road markings and static cautionary information for specific zones on the road, and event regulation information includes event-associated traffic limit and cautionary information occurring in real time, and for specifying information-providing conditions including location, direction, and time period conditions required for presentation of the traffic regulation information; and a means for storing the inputted traffic regulation information.

10. A traffic information providing system comprising:

the traffic information editing equipment of claim 9;

a communications base station that retains all or part of the traffic regulation information stored within the traffic information editing equipment;

a mobile unit; and a means for communicating between the communications base station and the mobile unit, wherein the mobile unit has a means for receiving traffic regulation information from the communications base station and a means for presenting the information to an operator of the mobile unit.

11. The traffic information providing system of claim 10, wherein the mobile unit includes:

absolute location measuring equipment;

a means for deriving a traveling direction of the mobile unit from the absolute location information;

a means for acquiring a current time of day;

a means for deriving a traveling speed of the mobile unit;

a storage means for retaining road regulation information; and a means for presenting the traffic regulation information to the operator if the specified information-providing conditions of location, direction, and time period are met, or a means for calculating a timing of information presentation based on the specified information-providing conditions and for presenting the traffic regulation information to the operator in the calculated timing.

12. A traffic information providing system comprising:

the traffic information editing equipment of claim 9;

a communications base station that retains all or part of the traffic regulation information stored within the traffic information editing equipment;

a mobile unit equipped with absolute location measuring equipment; and a narrow-area radio communications means for communicating between the communications base station and the mobile unit, wherein the mobile unit further includes:

a means for deriving a traveling direction of the mobile unit from the absolute location information;

a means for acquiring a current time of day;

a means for deriving a traveling speed of the mobile unit;

means for receiving traffic regulation information from the communications base station;

a storage means for retaining road regulation information; and a means for presenting the traffic regulation information to the operator if the specified information-providing conditions of location, direction, and time period are met, or a means for calculating a timing of information presentation based on the specified information-providing conditions and for presenting the traffic regulation information to the operator in the calculated timing.

13. A traffic information providing system comprising:

the traffic information editing equipment of claim 9;

a communications base station that retains all or part of the traffic regulation information stored within the traffic information editing equipment;

a mobile unit equipped with absolute location measuring equipment; and a means for connecting the communications base station and the mobile unit via bidirectional mobile communications, wherein the communications base station has a means for selectively extracting traffic regulation information from information received from the mobile unit, and transmitting the extracted information to the mobile unit, wherein the mobile unit further includes:

a means for deriving a traveling direction of the mobile unit from absolute location information;

a means for acquiring a current time of day;

a means for deriving a traveling speed of the mobile unit;

a means for transmitting the absolute location, traveling direction, and mobile unit type information;

a means for receiving traffic regulation information from the communications base station;

a storage means for retaining the traffic regulation information; and a means for presenting the traffic regulation information to the operator if the specified information-providing conditions of location, direction, and time period are met, or a means for calculating a timing of information presentation based on the specified information-providing conditions and for presenting the traffic regulation information to the operator in the calculated timing.

14. A traffic information providing system comprising:

the traffic information editing equipment of claim 9;

a communications base station that retains all or part of the traffic regulation information stored within the traffic information editing equipment;

a mobile unit equipped with absolute location measuring equipment; and a means for communicating from the communications base station to the mobile unit by multi-channel broadcasting, wherein the communications base station has a means for sorting the traffic regulation information retained within the base station on the basis of the location, direction, and time period specified using the traffic information editing equipment, allocating the information to each channel, and transmitting the information, wherein the mobile unit further includes:

a means for deriving a traveling direction of the mobile unit from absolute location information;

a means for acquiring a current time of day;

a means for deriving a traveling speed of the mobile unit;

a means for receiving the traffic regulation information transmitted from the communications base station by changing channels according to the absolute location, traveling direction, and type of the mobile unit;

a means for retaining the traffic regulation information; and a means for presenting the traffic regulation information to the operator if the specified information-providing conditions of location, direction, and time period are met, or a means for calculating a timing of information presentation based on the specified information-providing conditions and for presenting the traffic regulation information to the operator in the calculated timing.

15. The traffic information providing system of any one of claims 12, 13, and 14, wherein the traffic information editing equipment further includes a storage means for retaining a current version of traffic regulation information, and wherein the mobile unit further includes a storage means for retaining previously obtained traffic regulation information, a storage means for retaining the current version of the traffic regulation information, and a means for comparing the current version and the previously obtained traffic regulation information, and if they differ, replacing the stored previously obtained traffic regulation information with the current version of the traffic regulation information.

16. The traffic information providing system of any one of claims 10, 11, 12, 13, and 14, wherein the means for presenting traffic regulation information to the operator further includes either a visual display means or an audio notification means, or both.

17. An information broadcasting method comprising:

adding, to each of a plurality of information contents to be broadcast, location information specifying spots or areas for which the information content is intended;

broadcasting the information contents with the added location information;

receiving the broadcast information by a mobile unit;

retrieving first information that specifies a spot or area where the mobile unit currently exists and spots or areas defining an intended travel route of the mobile unit;

retrieving the location information for each information content in the received broadcast information as second information;

comparing the first information and the second information;

selecting among the received broadcast information contents on the basis of the comparison results; and displaying the selected information contents;

wherein the selecting step includes prioritizing among multiple received information contents, and the displaying step includes displaying the received information contents either in a defined order of priority or together with information relating to priority of the displayed information contents.

* * * * *